US011565847B2

(12) United States Patent
Sneddon

(10) Patent No.: US 11,565,847 B2
(45) **Date of Patent: *Jan. 31, 2023**

(54) STORAGE DEVICE

(71) Applicant: Brian Matthew Sneddon, Bluffdale, UT (US)

(72) Inventor: Brian Matthew Sneddon, Bluffdale, UT (US)

(73) Assignee: Brian Matthew Sneddon, Bluffdale, UT (US)

( * ) Notice: Subject to any disclaimer, the term of this patent is extended or adjusted under 35 U.S.C. 154(b) by 155 days.

This patent is subject to a terminal disclaimer.

(21) Appl. No.: 16/937,505

(22) Filed: Jul. 23, 2020

(65) Prior Publication Data

US 2020/0354106 A1 Nov. 12, 2020

Related U.S. Application Data

(60) Division of application No. 16/014,928, filed on Jun. 21, 2018, now Pat. No. 10,759,562, which is a continuation-in-part of application No. 14/996,131, filed on Jan. 14, 2016, now Pat. No. 10,023,357.

(51) Int. Cl.

| | |
|---|---|
| ***B65D 6/24*** | (2006.01) |
| ***B65D 21/02*** | (2006.01) |
| ***B65D 43/02*** | (2006.01) |

(52) U.S. Cl.

CPC ..... *B65D 21/0213* (2013.01); *B65D 11/1873* (2013.01); *B65D 21/0212* (2013.01); *B65D 43/02* (2013.01)

(58) Field of Classification Search

CPC ..... B65D 11/1873; B65D 21/0213; B65D 21/0212; B65D 43/02; B65D 21/0204; B65D 21/0205

See application file for complete search history.

(56) References Cited

U.S. PATENT DOCUMENTS

| | | | | |
|---|---|---|---|---|
| 984,784 | A * | 2/1911 | Tilton | |
| 1,782,307 | A * | 11/1930 | Lagasse | B65D 21/0212 206/821 |
| 3,424,334 | A | 1/1969 | Goltz | |
| 4,243,255 | A | 1/1981 | Hornak | |
| 4,243,256 | A | 1/1981 | Frydrych | |
| 4,300,695 | A | 11/1981 | Hsu | |

(Continued)

FOREIGN PATENT DOCUMENTS

| | | | |
|---|---|---|---|
| DE | 4107584 | A1 | 9/1992 |
| DE | 4310895 | A1 | 10/1993 |

(Continued)

OTHER PUBLICATIONS

Extended European Search Report dated Sep. 23, 2019 for European Patent No. 17739077.0, 8 pages.

(Continued)

*Primary Examiner* — Stephen J Castellano

(74) *Attorney, Agent, or Firm* — Lee & Hayes, P.C.

(57) ABSTRACT

A storage device includes a base, and a number of side panels selectively coupled to the base. Each of the side panels include a protrusion. The base includes a number of voids defined therein. The protrusions, once inserted into the voids, restrict movement of the side panels relative to the base in at least two coordinate directions.

20 Claims, 39 Drawing Sheets

(56) References Cited

U.S. PATENT DOCUMENTS

| | | | | |
|---|---|---|---|---|
| 5,060,819 | A * | 10/1991 | Apps | B65D 21/0212 220/519 |
| 5,632,392 | A | 5/1997 | Oh | |
| 6,290,081 | B1 | 9/2001 | Merey | |
| 10,023,357 | B2 | 7/2018 | Sneddon | |
| 10,759,562 | B2 * | 9/2020 | Sneddon | B65D 43/02 |
| 2004/0238400 | A1 | 12/2004 | Knutsson et al. | |
| 2009/0114645 | A1 | 5/2009 | Zemer | |
| 2017/0203876 | A1 | 7/2017 | Sneddon | |

FOREIGN PATENT DOCUMENTS

| | | | |
|---|---|---|---|
| DE | 202009007608 | U1 | 8/2009 |
| EP | WO2009153693 | A1 | 12/2009 |
| GB | 2273487 | | 6/1994 |
| GB | 2476137 | A | 6/2011 |
| SU | 988670 | A1 | 1/1983 |
| WO | WO03024815 | A1 | 3/2003 |
| WO | WO2017123997 | A1 | 7/2017 |

OTHER PUBLICATIONS

Non Final Office Action dated Feb. 12, 2020 for U.S. Appl. No. 16/014,928 "Storage Device," Sneddon, 6 pages.
PCT Search Report and Written Opinion dated Sep. 19, 2019, for PCT Application No. PCT/US1938440, 12 pages.
Extended European Search Report dated Feb. 25, 2022 for European Patent Application No. 19822535.1, 7 pages.

* cited by examiner

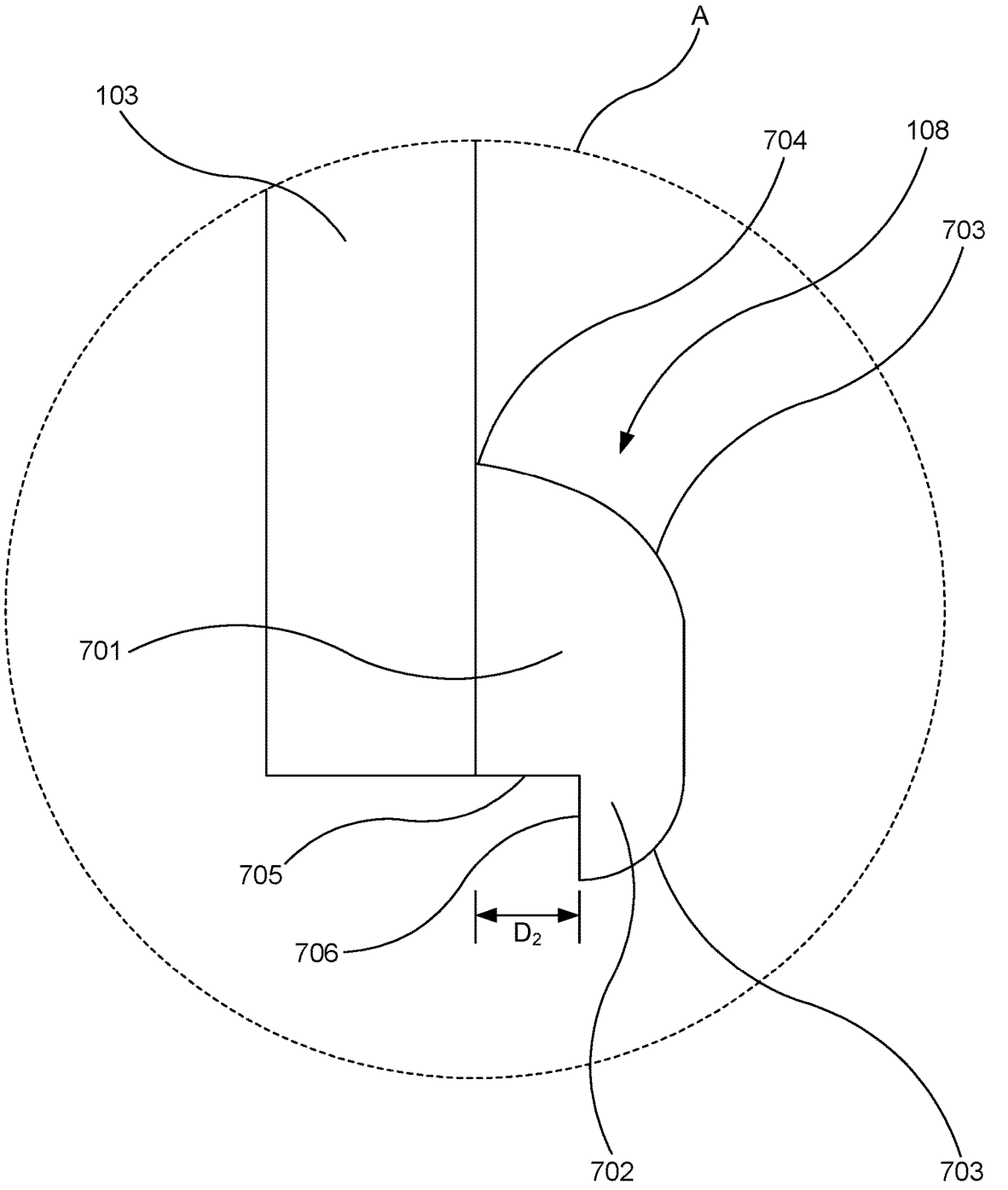
Fig. 7
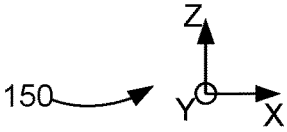

STORAGE DEVICE

RELATED DOCUMENTS

The present application is a divisional of Ser. No. 16/014,928 filed 21 Jun. 2018, now U.S. Pat. No. 10,759,562 which is a continuation-in-part of Ser. No. 14/996,131 filed 14 Jan. 2016, now U.S. Pat. No. 10,023,357. All of which are herein incorporated in their entirety.

BACKGROUND

Storage devices such as bins, boxes, cupboards, and other storage devices are useful in organizing and securing items to be stored. These storage devices come in many shapes and sizes to accommodate for a number of different storage items.

BRIEF DESCRIPTION OF THE DRAWINGS

The accompanying drawings illustrate various examples of the principles described herein and are a part of the specification. The illustrated examples are given merely for illustration, and do not limit the scope of the claims.

FIG. 7 is a cutaway side view of the protrusion of the third side panel within circle A of FIG. 6, according to one example of the principles described herein.

Throughout the drawings, identical reference numbers designate similar, but not necessarily identical, elements.

DETAILED DESCRIPTION

Figure 1:
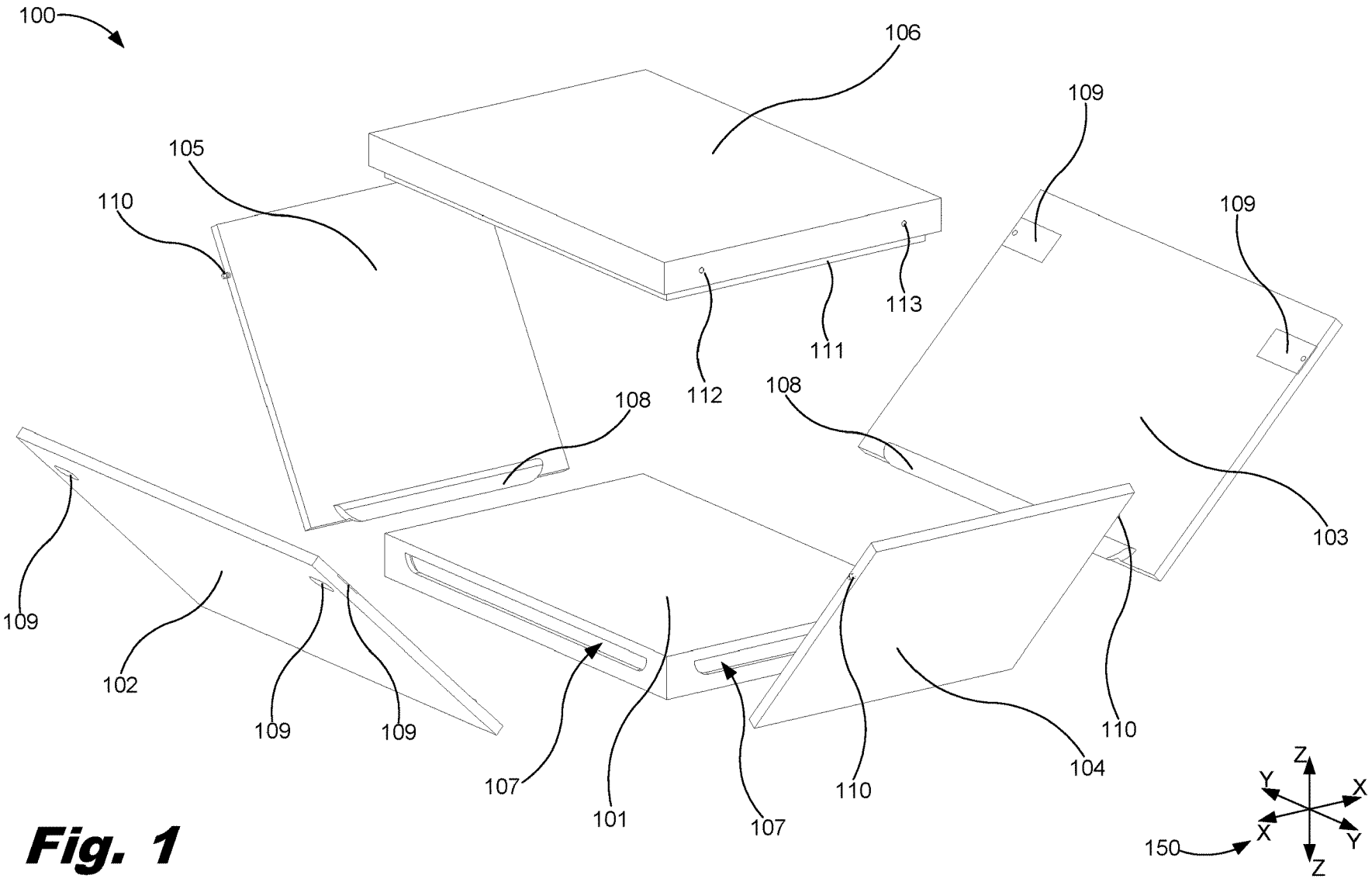
FIG. 1 is an exploded isometric view of a storage device, according to one example of the principles described herein.

As mentioned above, storage devices such as bins, boxes, cupboards, and other storage devices are useful in organizing and securing items to be stored. This may be especially helpful if the storage devices are being used in properties such as apartment or condominiums where space may be limited. However, in some storage devices, gaining access to the items stored therein may be difficult since many storage devices open from the top. If several storage devices are stacked on one another, and a user is looking for items in a lower storage device, then several storage devices may have to be unstacked and relocated to another area in order to access the desired storage bin.

Further, some storage devices, when stacked on one another, are extremely unstable. This results in a potentially hazardous situation wherein a storage device may fall over on a user. Still further, some storage devices may require a user to assemble the storage devices. This assembly may include the use of tools including specialized tools along with screws, bolts, nuts and other coupling devices. In these situations, the user may improperly construct the storage devices, and may even inappropriately assemble the storage devices such that the storage devices become ineffective, substandard as a storage device, or even a potential hazard to the user. Still further, many storage devices are not aesthetically appealing enough to induce a user to place the storage devices in plain view of, for example, persons visiting the user's dwelling.

Examples described herein provide a storage device. The storage device includes a base, and a number of side panels selectively coupled to the base. Each of the side panels include a protrusion. The base includes a number of voids defined therein. The protrusions, once inserted into the voids, restrict movement of the side panels relative to the base in at least two coordinate directions.

The protrusions each include an extension to seat in a bottom portion of the void. The extension extends past a first wall of the opening of the void and downward into the void to secure the side panels to the base in a first coordinate direction. The protrusions also include tapered ends. The tapered ends match a number of curved sides defined in the void. The tapered ends secure the side panels to the base in a second coordinate direction. The protrusions also include a sloping face beginning at an apex of the protrusion and terminating at the bottom of the extension.

The apex of the sloping face abuts a second wall of the opening of the void when the side panels are brought into a perpendicular position relative to a top surface of the base. The apex and a bottom surface of the protrusion secure the side panels to the base in a third coordinate direction. The protrusions are dimensioned such that the side panels are secured to the base in at least two coordinate directions when the extension is inserted into the void and the extension extends past the first wall of the opening of the void and downward into the void. Further, the protrusions are dimensioned such that the side panels are secured to the base in three coordinate directions when the protrusion is inserted into the void and the side panels are brought into a perpendicular position relative to a top surface of the base. The distance between a first portion of the extension proximal to the side panel and the exterior surface of the storage device is equal to the thickness of the first wall of the opening of the void.

Each side panel includes a securing device to secure the side panels to an adjacent one of the side panels. Each securing device includes a pin embedded in a first side panel, a groove defined in the pin, and a spring-loaded catch embedded in a second side panel adjacent the first side panel The spring-loaded catch is spring biased to engage with the groove of the pin when the pin enters an aperture defined in the second side panel. The securing devices of the side panels secure the side panels to one another in three coordinate directions. Each of the spring-loaded catches is flush with the surface of the side panels such that no portion of the spring-loaded catch protrudes past a surf ace of the side panels.

The storage device further includes a lid dimensioned to be flush with an outside surface of the side panels when the side panels are coupled to on another. The lid includes a lip around the bottom edge of the lid. The lip is dimensioned to fit into an interior of the storage device when the side panels are coupled to one another. The lid includes a number of spring-loaded pins embedded in the lid, and a number of magnets embedded in the lid. The spring-loaded pins embedded in the lid couple to magnets embedded in another lid of another storage device. The magnets embedded in the lid couple to spring-loaded pins embedded in the other lid of the other storage device.

Examples described herein provide a system for storing items. The system includes a number of storage devices. Each storage device includes a base, and a number of side panels selectively coupled to the base. Each of the sides includes a protrusion. The base includes a number of voids defined therein. The protrusions, once inserted into the voids, restrict movement of the side panels relative to the base in at least two coordinate directions.

The protrusions each include an extension to seat in a bottom portion of the void. The extension extends past a first wall of the opening of the void and downward into the void to secure the side panels to the base in a first coordinate direction. The protrusions also each include tapered ends. The tapered ends match a number of curved sides defined in the void. Further, the tapered ends secure the side panels to the base in a second coordinate direction. The protrusions also each include a sloping face beginning at an apex of the protrusion and terminating at the bottom of the extension.

Each storage device further includes a lid. The lid includes a number of spring-loaded pins embedded in the lid, and a number of magnets embedded in the lid. The spring-loaded pins embedded in the lid couple to magnets embedded in an adjacent lid of an adjacent storage device. Further, the magnets embedded in the lid couple to spring-loaded pins embedded in the adjacent lid.

Each storage device includes a base lip. The base lip is formed by the side panels as coupled to the base and an exterior of the base. A first storage device is stackable on and secured to a second storage device due to the base lip coupling to the interior of the second storage device.

Further, each storage device includes a lid dimensioned to be flush with an outside surf ace of the side panels when the side panels are coupled to on another. The lid includes a lid lip around the bottom edge of the lid. The lid lip is dimensioned to fit into an interior of the storage devices when the side panels are coupled to one another. The lid includes a number of spring-loaded pins embedded in the lid, and a number of magnets embedded in the lid. The spring-loaded pins embedded in the lid couple to magnets embedded in an adjacent lid. The magnets embedded in the lid couple to spring-loaded pins embedded in the adjacent. Further, the system is flush along all outer edges.

Examples described herein provide a coupling system of a storage device. The coupling system includes a protrusion extending from a side panel, and a void defined in a base. The protrusion includes an extension to seat in a bottom portion of the void. The extension extends past a first wall of the opening of the void and downward into the void to secure the side panels to the base in a first coordinate direction. The protrusion also includes tapered ends. The tapered ends match a number of curved sides defined in the void, and secure the side panels to the base in a second coordinate direction. The protrusion also includes a sloping face beginning at an apex of the protrusion and terminating at the bottom of the extension. The protrusion, once inserted into the void, restricts movement of the side panel relative to the base in at least two coordinate directions.

Thus, examples described herein provide a storage device with three-axis stability between a number of side panels and a base of the storage device. Further, examples described herein provide a storage device with three-axis stability between adjacent side panels using a latch and pin system. Still further, examples described herein provide a storage device with three-axis shear stability between adjacent storage devices that are arranged in an array due a coupling device that uses retractable magnetic pins incorporated into each of the lids of the storage devices. Even still further, examples described herein provide a storage device where all components are internal to and flush with the side panels with respect to both the exterior and interior of the side panels in order to allow for stacking in any configuration. Yet further, no parts or tools are required for assembly or disassembly of the storage devices, resulting in a more easily constructed storage device. The side panels open from either front or back when assembled or stacked providing access to the interior of the storage devices from with side of a stack of storage devices. Further, the lids of the storage devices link to form single top surface that may be used as a table top or other working surface. Even still further, examples described herein provide a storage device where stability is maintained between adjacent storage devices.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is an exploded isometric view of a storage device (100), according to one example of the principles described herein. The storage device (100) may include a base (101), a first side panel (102), a second side panel ('103), a third side panel (104), a fourth side panel (105), and a lid (106). In this manner, when these elements of the storage device (100) are coupled to one another as described herein, the storage device forms a cube. The dimensions of the base (101), a side panels (102, 103, 104, 105), and lid (106) define the interior volume of the storage device (100). Thus, although no dimensions are provided herein, these elements may include any dimensions as may suit a particular application. For example, the storage device (100) may be dimensioned to fit a number of specific items. However, in another example, the storage device (100) may be dimensioned to fit any number or type of items.

While throughout the specification specific example are described with reference to the components of the storage device (100) being used to form a cube like shape tor storage purposes, the components of the storage device (100) may vary in size, shape, and function. As a result, the components of the storage device may be used to form other types of storage devices, types of furniture, or be integrated into existing storage devices and/or existing furniture. For example, the components of the storage device (100) may be used for forming a desk. In this example, a first side panel may be shaped and used for the top of the desk. The first side panel may include a number of protrusions that may be inserted into voids of a number of storage devices acting as legs for the desk.

In another example, the base of the storage device may be attached to existing furniture, such as a cabinet, such that the storage devices may be added next to or within the cabinet In this example, the first side panels of the storage devices may be selectively removed to mimic the look and feel of the cabinet. In this example, the base (101) may be coupled to a back wall of the cabinet, and a side panel (102, 103, 104, 105) may be used to enclose a section of the cabinet to create an enclose within the cabinet Although desk storage and cabinet storage examples have been described herein, the present systems may be incorporated into any type of device or system that utilizes enclosed storage systems such as those described herein.

Throughout the figures, a three-dimensional Cartesian coordinate indicator (150) is depicted to orient the reader as to directions of movement and forces placed on and interaction between the various elements of the storage device (100). For example, the X-direction indicates a depth of the storage device (100), the Y-direction indicates the width of the storage device (100), and the Z-direction indicates the height of the storage device (100). Further, forces placed on elements may include placing those forces in directions as indicated herein based on the Cartesian coordinate indicator (150).

Figure 2:
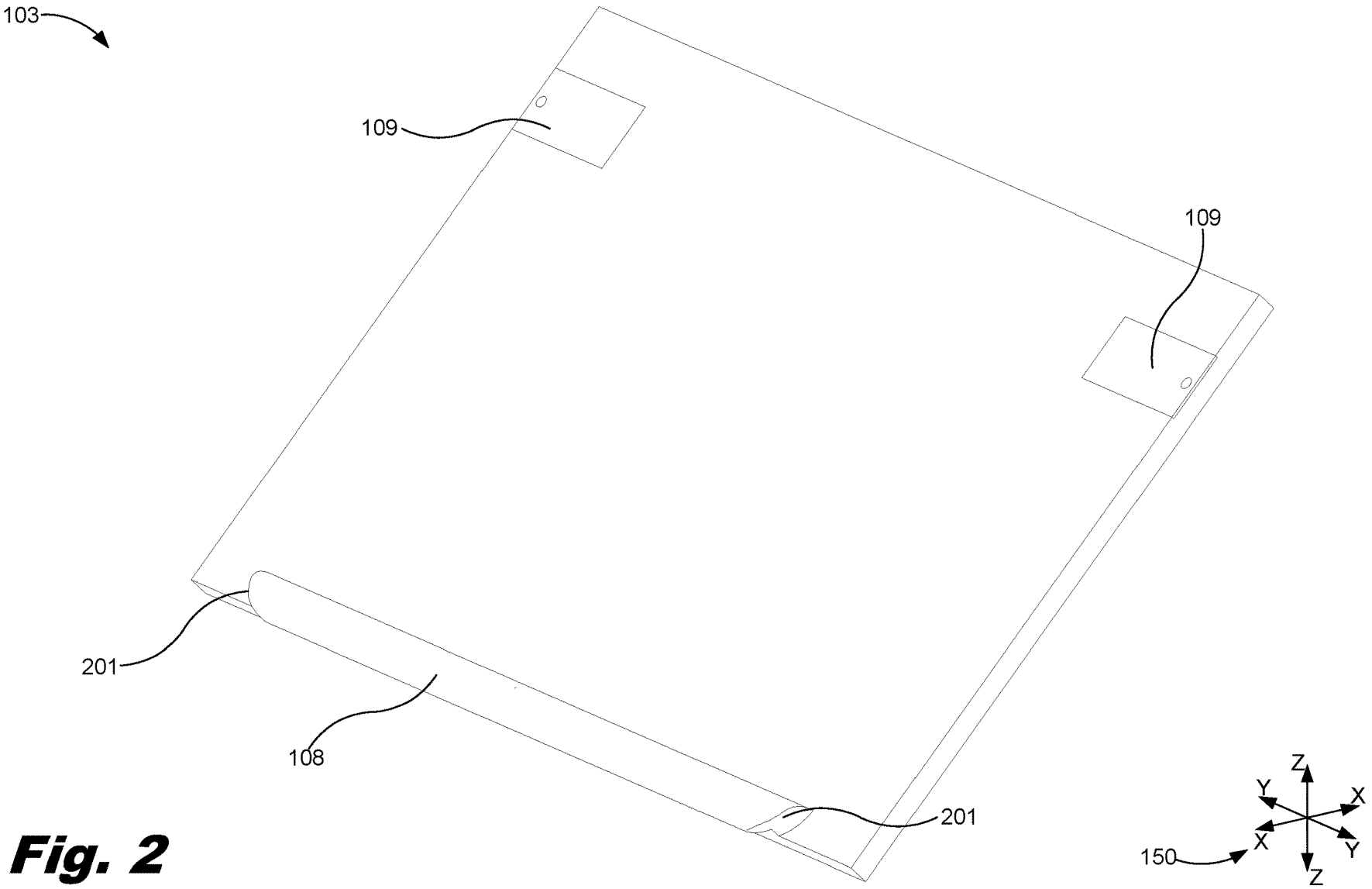
FIG. 2 is an isometric view of a first side panel of the storage device of FIG. 1, according to one example of the principles described herein.

FIGS. 2 through 5 will now be used to describe the base (101), a side panels (102, 103, 104, 105), and lid (106) of the storage device (100). FIG. 2 is an isometric view of a first side panel (102) of the storage device (100) of FIG. 1, according to one example of the principles described herein. In one example, the first side panel (102) is identical to the second side panel (103) in form, shape, and function. The first (102) and second (103) side panels include a protrusion (108). More regarding the shape and dimensions of the protrusion will be described below. However, the protrusion (108) is used to couple the first (102) and second (103) side panels to the base (101). In one example, the protrusion (108) assists in the alignment and securing of the first (102) and second (103) side panels to the base (101) in one coordinate direction. In another example, the protrusion (108) assists in the alignment and securing of the first (102) and second (103) side panels to the base (101) in two coordinate directions. In still another example, the protrusion (108) assists in the alignment and securing of the first (102) and second (103) side panels to the base (101) in three coordinate directions. In still another example, the protrusion (108) assists in the alignment and securing of the first (102) and second (103) side panels to the base (101) in a number of coordinate directions based on a position or state of the first (102) and second (103) side panels relative to the base (101).

The first (102) and second (103) side panels may also include a number of spring-loaded catches (109}. The spring-loaded catches (109) are used to couple the first (102) and second (103) side panels to the adjacently arranged third (104) and fourth (105) side panels. More specific description regarding the spring-loaded catches (109) will be described below.

Figure 3:
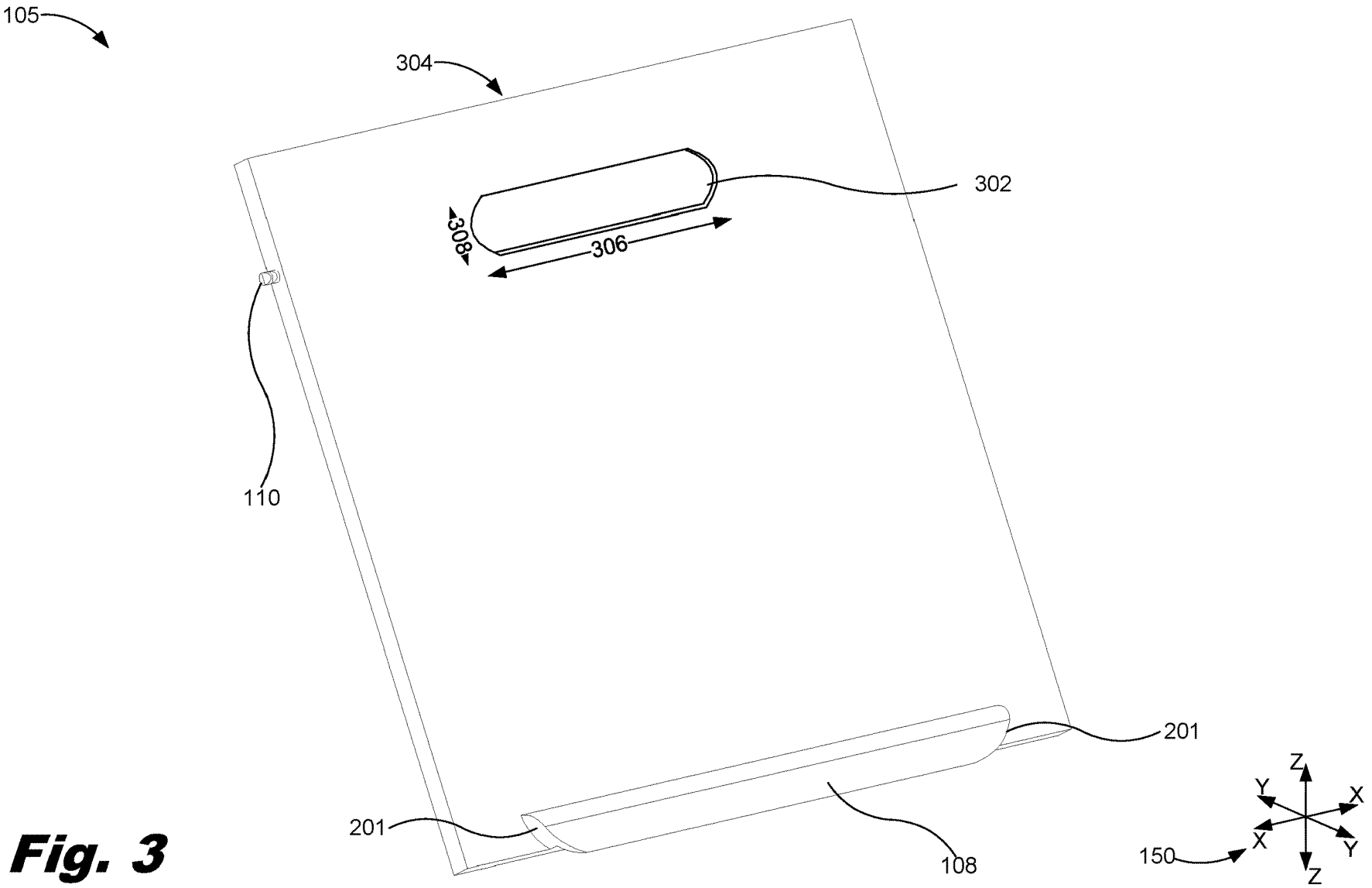
FIG. 3 is an isometric view of a third side panel of the storage device of FIG. 1, according to one example of the principles described herein.

FIG. 3 is an isometric view of a third side panel (104) of the storage device (100) of FIG. 1, according to one example of the principles described herein. In one example, the third side panel (104) is identical to the fourth side panel (105) in form, shape, and function. The third (104) and fourth (105) side panels include a protrusion (108). in one example, the protrusions (108) of the third (104) and fourth (105) side panels may be identical in to the protrusions (108) of the first (102) and second (103) side panels in form, shape, and function.

In one example, the protrusions (108) of the side panels (102, 103, 104, 105) are identical except for their respective dimensions. For example, the protrusions (108) of the third (104) and fourth (105) side panels may be shorter in length relative to the protrusions (108) of the first (102) and second (103) side panels as depicted in FIG. 1 so that the protrusions (108) of the third (104) and fourth (105) side panels fit into the relatively smaller voids (107) on their respective sides of the base (101). However, in one example, the depth of the storage device (100) as indicated by the X-direction of the Cartesian coordinate indicator (150) may be equal or unequal to the width of the storage device (100) as indicated by the Y-direction of the Cartesian coordinate indicator (150). In these examples, the lengths of the protrusions (108) of the side panels (102, 103, 104, 105) are dimensioned to fit in the voids (107) defined on their respective sides of the base (101).

In some examples, the side panels (102, 103, 104, 105) such as, for example, the third (104) and fourth (105) side panels each include a handle (302). The handle (302) allows a person to transport the storage device (100) from one location to another location. The handle (302) may be located towards the top (304) of the third (104) and fourth (105) side panels. Further, the handle (302) may be centered horizontally in the third (104) and fourth (105) side panels. With each handle (302) located towards the top (304) and centered horizontally in the third (104) and fourth (105) side panels, this location provides stability when transporting the storage device (100) because the center of gravity of the storage device (100) when filled with contents, is located below the handle (302).

The handle (302) may be sized such that a person may grasp the handle (302). For example, the length (306) of the handle (302) may be longer than the width of an average size human hand. The height (308) of the handle (302) may be such that fingers of a person are able to be inserted into the handle (302).

In an example, the handle (302) is routered into the third (104) and fourth (105) side panels such that the handle (302) is recessed. This includes removing a portion of the material of the third (104) and fourth (105) side panels to form each handle (302), but not removing the material of the third (104) and fourth (105) side panels to create the handle (302) such that an opening is formed. This allows the storage device (100) to have handles, but not allow others to view the contents contained within the storage device (100). Further, with the handle (302) recessed into the storage device (100), storage devices may be stacked as described in FIG. 15 without each handle (302) interfering with adjacent storage devices (100).

In other examples, the handle (302) is cut into the third (104) and fourth (105) side panels such that the handle (302) creates an opening completely through the third (104) and fourth (105) side panels. While handles that are recessed prevent a person from viewing the contents within the storage device (100), a handle (302) for completely through the side panels (102, 103, 104, 105) may provide the user with the ability to wrap his or her hand around the handle and reduce the strain on the user's hands and fingers. Further, other types of handles may be used with the storage device (100). These handles may permanently protrude from the storage device (100) or be removably secured to the storage device (100).

Figure 4:
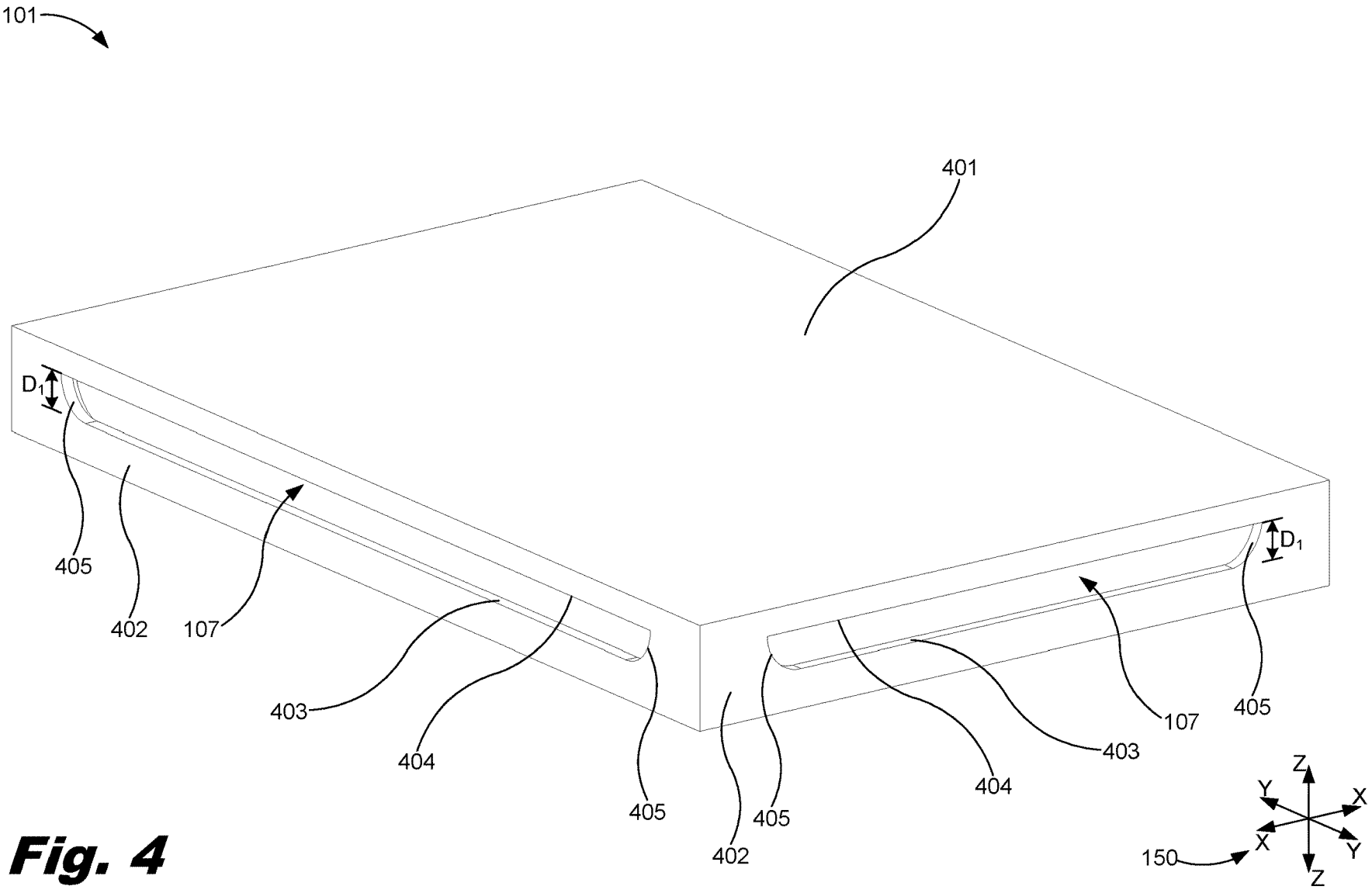
FIG. 4 is an isometric view of a base of the storage device of FIG. 1, according to one example of the principles described herein.

FIG. 4 is an isometric view of a base (101) of the storage device (100) of FIG. 1, according to one example of the principles described herein. The base includes a top surface (401) and a number of side walls (402). Voids (107) are defined in the side walls (402) to receive the protrusions (108) of the side panels (102, 103, 104, 105). Each void includes a first void wall (403) that runs along the bottom of the void (**10-*r*) and a second void wall (404) that runs along the top of the void (107). The distance between the first void wall (403) and the second void wall (404) may be referred to herein as o, as indicated in FIG. 4**.

The voids (107) further include curved side walls (405). The curved side walls (405) match tapered ends formed on the protrusions (108). In this manner, the curved side walls (405) of the voids and the tapered ends formed on the protrusions (108) are dimensioned to create a transition fit between the curved side walls (405) and the protrusions (108).

Figure 5:
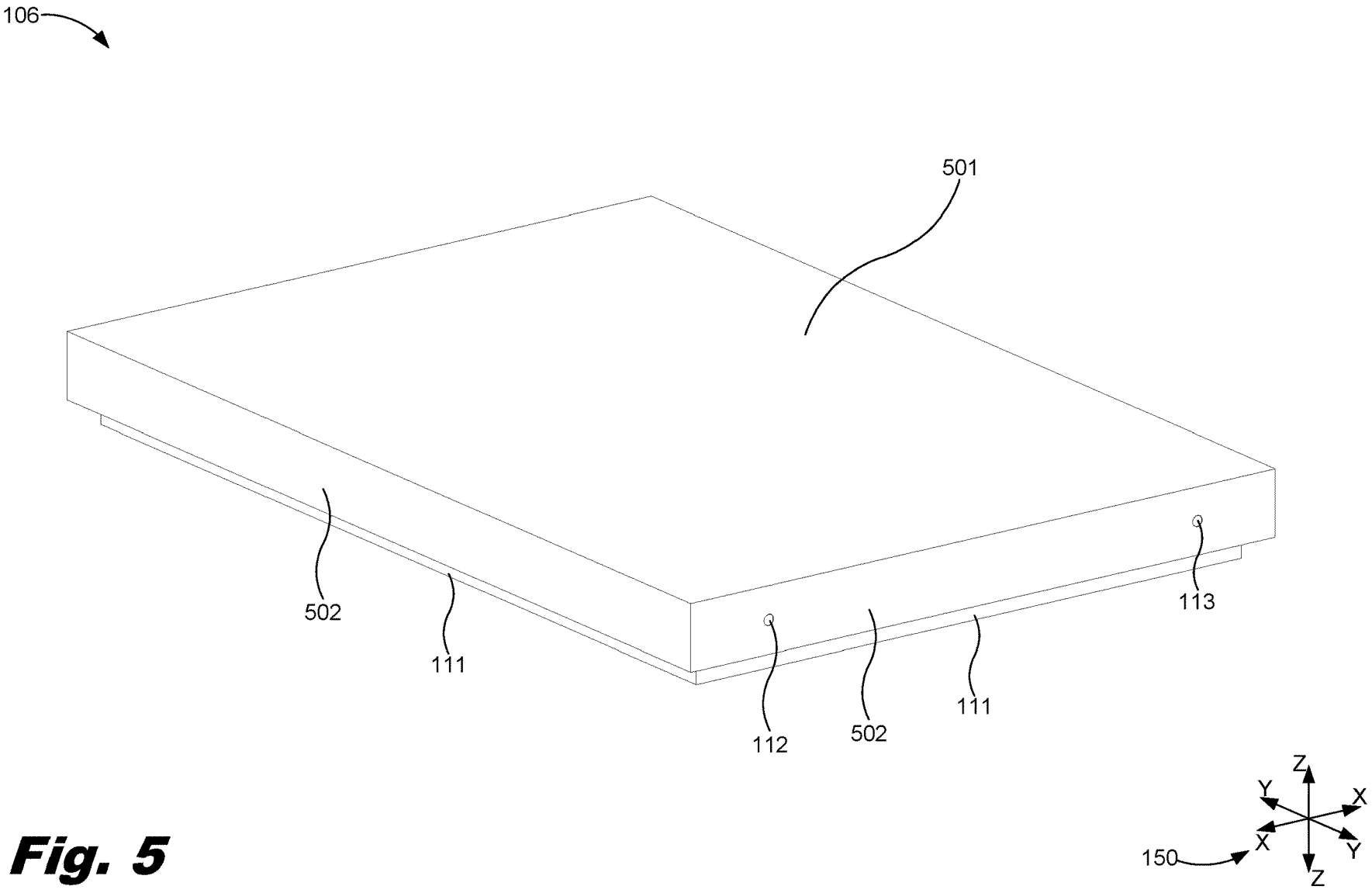
FIG. 5 is an isometric view of a lid of the storage device of FIG. 1, according to one example of the principles described herein.

FIG. 5 is an isometric view of a lid (106) of the storage device (100) of FIG. 1, according to one example of the principles described herein. The lid (106) includes a lip (111). The lip (111) is formed in the lid (106) in order to allow the lid (106) to seat on the side panels (102, 103, 104, 105) when the side panels (102, 103, 104, 105) are coupled to the base (101) and oriented in a vertical position perpendicular to the top surface (401) of the base (101) and a top surface (501) of the lid (106) as depicted in, for example, FIGS. 9-11, 15, and 17-19. Once the lid (106) is seated on the side panels (102, 103, 104, 105) in this manner, side walls (502) of the lid (106) are flush with the side panels (102, 103, 104, 105). Thus, the lid (106) and its lip (111) are dimensioned to ensure that the exterior surface of the storage device (100) remains flush among the elements of the storage device (100).

The lid further includes a number of spring-biased lid pin coupling devices (112, 113). The lid pin coupling devices (112, 113) include a pin coupled to a spring biased in the retracted position such that the pin is internal to or at least flush with a first cavity of the lid (106). A mating portion of the lid pin coupling devices (112, 113) includes a magnet incorporated into a second cavity defined in another lid (106) of another storage device (100). When the two portions of the lid pin coupling device (112, 113) are brought adjacent to one another, the magnet in the second cavity overcomes the spring coupled to the pin, and draws the pin out of the first cavity and into the second cavity. In this manner, a second storage device (100) placed adjacent to a first storage device (100) may be coupled to the first storage device (100) via the spring-biased lid pin coupling devices (112, 113). In this manner, the lids (106) and their respective spring-biased lid pin coupling devices (112, 113) assist in providing a three-axis shear stability between adjacent storage devices (100).

Figure 6:
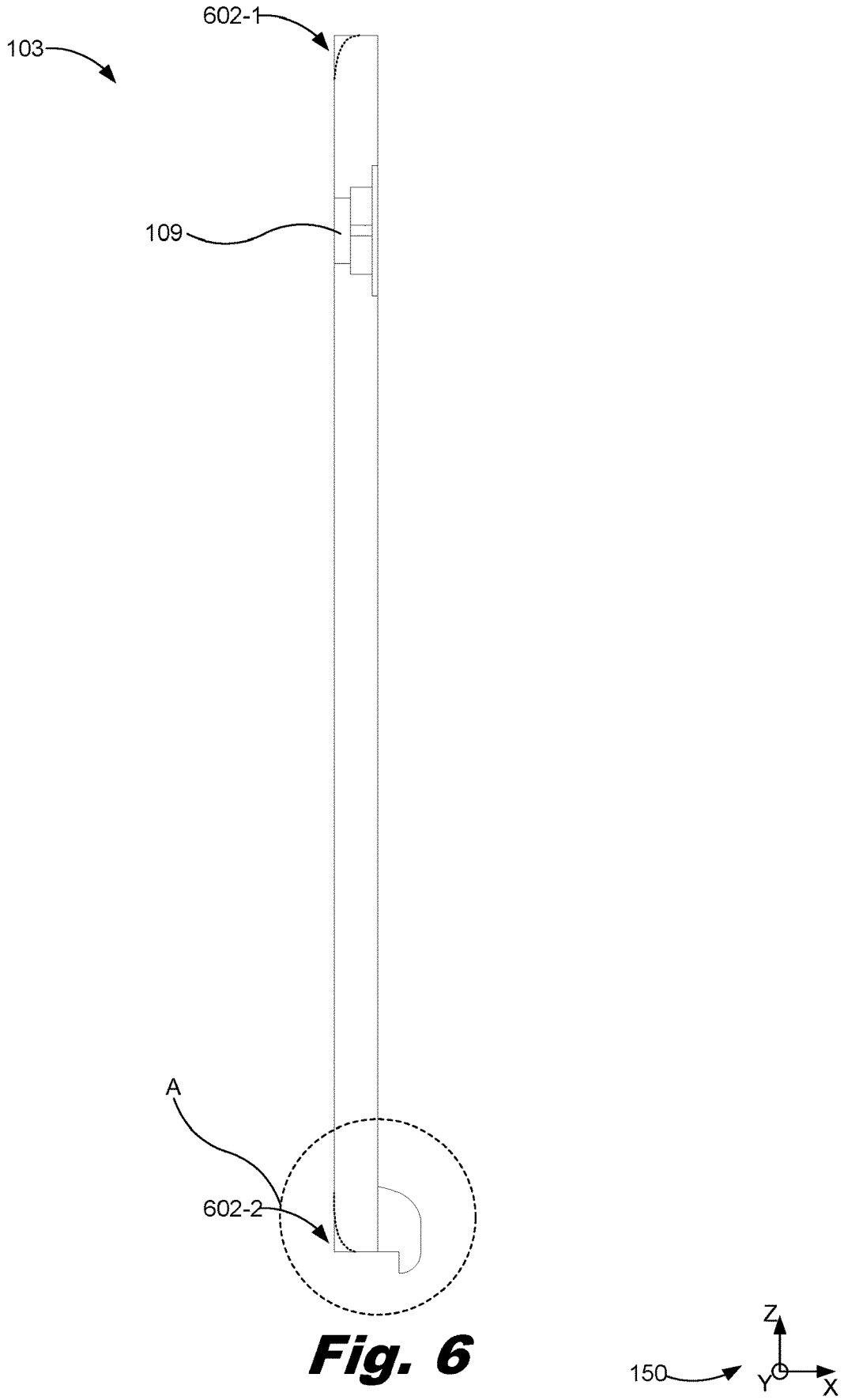
FIG. 6 is a cutaway side view of the third side panel of the storage device of FIG. 1, according to one example of the principles described herein.

Details regarding the interface between the protrusions (108) of the side panels (102, 103, 104, 105) and the voids defined in the side walls (402) of the base (101) will now be describe in more detail in connection with FIGS. 4, and 6-8. Having already introduced FIG. 4, FIG. 6 is a cutaway side view of the third side panel (104) of the storage device (100) of FIG. 1, according to one example of the principles described herein. In one example, the top edge (602-1) and the bottom edge (302-2) of the first (102) and second (103) side panels include a square edge as illustrated in FIG. 6. in another example, the top edge (602-1) and the bottom edge (302-2) of the first (102) and second (103) side panels include a beveled edge (602) as indicated by the dashed lines. The beveled edges (602-1, 602-2) are created such that adjoining panels are not obstructed as they are moved into a vertical position and once they are oriented in a vertical position as depicted in, for example, FIGS. 9-11, 15, and 17-20. This reduces binding between the base (101), the side panels (102, 103, 104, 105), and the lid (106) with respect to a storage device (100) and other storage devices stacked on the storage device (100).

Figure 8:
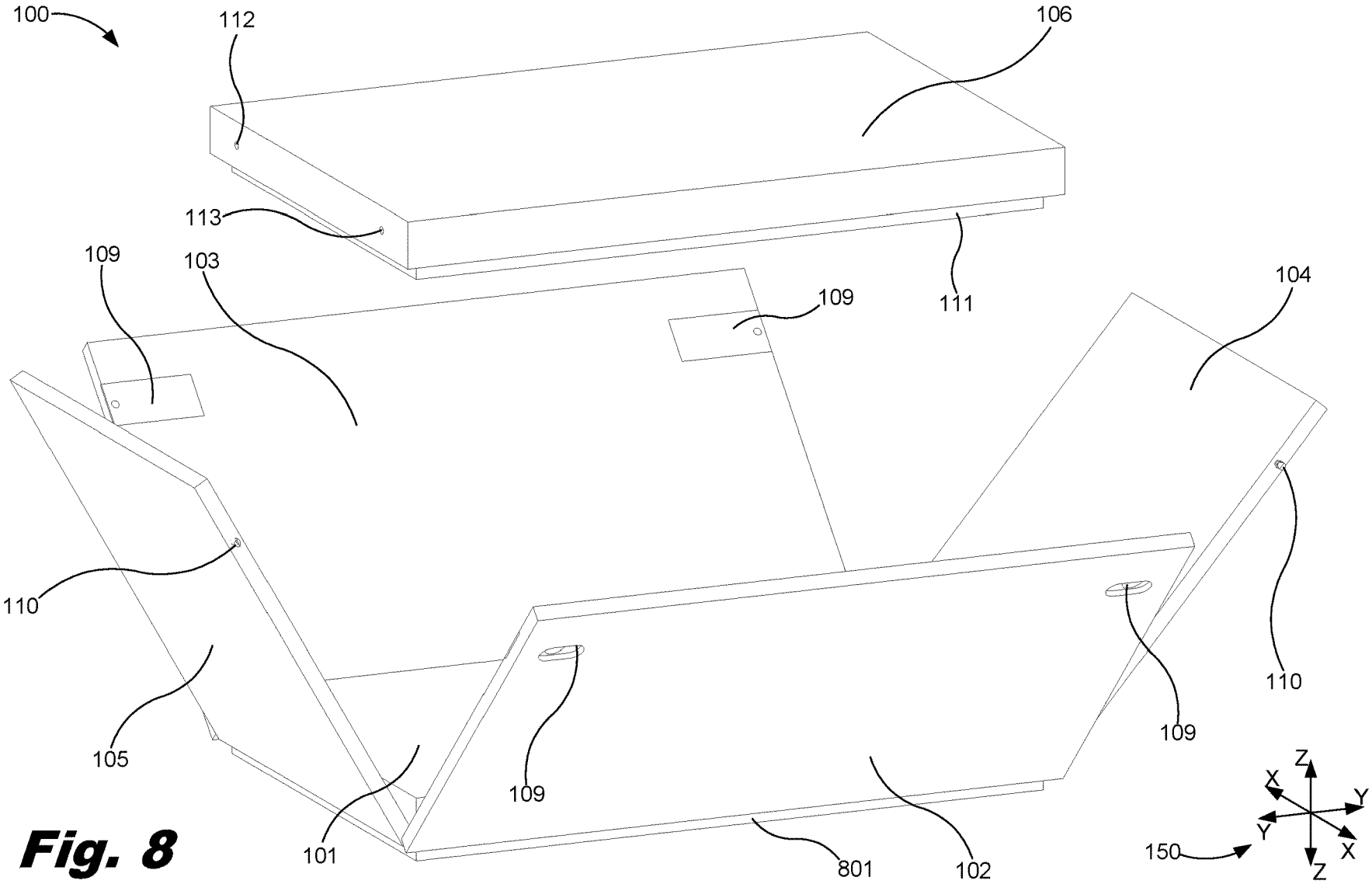
FIG. 8 is an isometric view of the storage device of FIG. 1 in a partially assembled state, according to one exam pie of the principles described herein.
Figure 9:
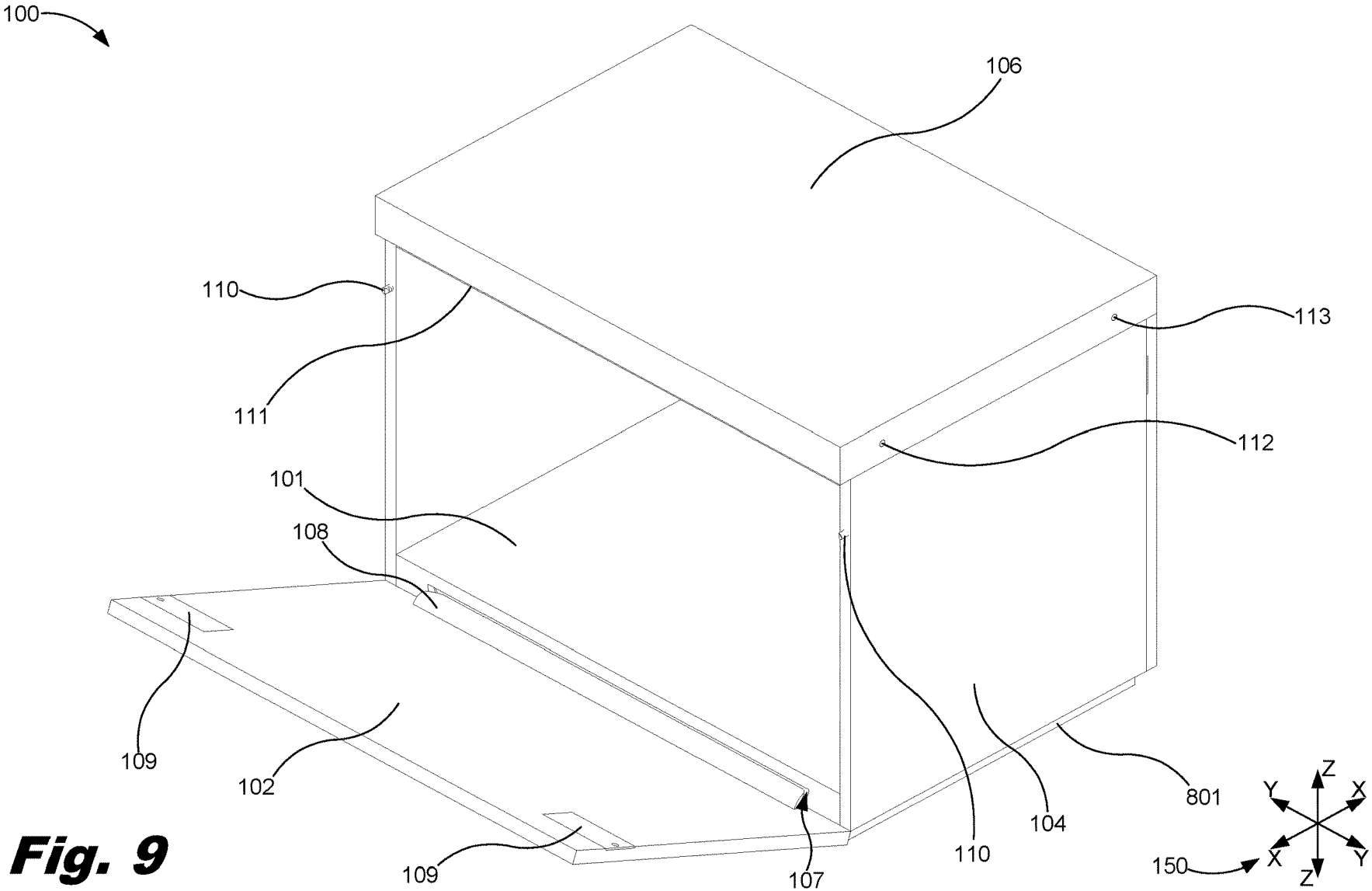
FIG. 9 is an isometric view of the storage device of FIG. 1 in a partially assembled state, according to one exam pie of the principles described herein.

FIG. 7 is a cutaway side view of the protrusion (108) of the third side panel (104) within circle A of FIG. 6, according to one example of the principles described herein. FIG. 8 is an isometric view of the storage device (100) of FIG. 1 in a partially assembled state, according to one example of the principles described herein. The protrusions (108) each include a number of portions that assist in alignment and coupling of the side panels (102, 103, 104, 105) to the base (101). In the partially assembled state, the protrusions (108) are initially inserted into the voids (107) in an initial position as depicted in FIG. 8. When the protrusions (108) are initially inserted into the voids (10-7), the protrusions (108) loosely fit in the voids (107) due to the radius of the tapered ends (FIG. 3, 201) partially engaging with the voids (107). For example, the distance between the tapered ends (201) and the curved side walls (405) defined in the voids (107) is greater than zero. As a result, the side panels (102, 103, 104, 105) may move laterally until one of the tapered ends (201) makes contact with one of the curved side walls (405) defined in the voids (107). As the side panels (102, 103, 104, 105) transition from the initial position to a vertical position as depicted in FIG. 9, the fit between the protrusions (108) and the voids (1 on tightens due to the distance between the tapered ends (201) and the curved side walls (405) defined in the voids (107) coming closer to zero. As the distance between the tapered ends (201) and the curved side walls (405) comes closer to zero as the side panels (102, 103, 104, 105) transition from the initial position to a vertical position, the protrusions (108) self-align with the voids (108). As a result, the protrusions (108), when inserted into the voids (107) and transitioned to a vertical position as depicted in FIG. 9, restrict movement of the side panels (102, 103, 104, 105) relative to the base (101) in at least one coordinate direction. For example, when oriented as depicted in FIG. 9, the first (102) and second (103) side panels are restricted from movement in at least the X-direction, and the third (104) and fourth (105) side panels are restricted from movement in the Y-direction. As the side panels (102, 103, 104, 105) move to the vertical position perpendicular to the top surface (401) of the base (101) and a top surface (501) of the lid (106) as depicted in, for example, FIGS. 9-11, 15, and 17-19, the protrusions (108) cause movement of the side panels (102, 103, 104, 105) in the X, Y and Z directions to decrease until the side panels (102, 103, 104, 105) are ultimately unable to move in any coordinate direction when completely vertical. In one example, the movement of the protrusions (108) in the X, Y and Z directions within the voids (107) becomes more restricted as the side panels (102, 103, 104, 105) are brought into a more vertical orientation.

With reference to FIGS. 6 and 7, the protrusions (108) include a main body portion (701). In one example, the protrusion (108) of each side panel (102, 103, 104, 105) is coupled to its respective side panel (102, 103, 104, 105) using fastening devices such as nails, screws, bolts, other fastening devices, or combinations thereof. In another example, the protrusions (108) are monolithically formed with their respective side panels (102, 103, 104, 105).

As to the shape and function of the protrusions (108), the shape of the protrusions (108) may be referred to as a comma-shape or a teardrop shape. Each protrusion (108) includes an extension (102). The extension (102) of each protrusion extends downward from the main body portion (701). The extension (702) restricts movement of the side panels (102, 103, 104, 105) in the X-direction relative to the first (102) and second (103) side panels, and in the Y-direction relative to the third (104) and fourth (105) side panels. In this manner, once the extension (702) is rotated within the void (107) as the side panels (102, 103, 104, 105) are brought to the vertical position, the extension (702) restricts movement of the side panels (102, 103, 104, 105) away from the base (101) along a direction of the plane parallel to the top surface (401) of the base (101).

The protrusions (108) also include a sloping face (703) beginning at an apex (104) of the protrusions (108) and terminating at the bottom of the extensions (702). The apex (704) of the sloping face (703) abuts the second void wall (404} of the opening of the void (107) when the side panels (102, 103, 104, 105) are brought into a perpendicular position relative to a top surface (401) of the base (101). A bottom surface f705) of the protrusions (108) rest on top of the first void wall (403) that runs along the bottom of the void (107).

The distance between the apex (704) and the bottom surface (705) is approximately equivalent to the distance, D: of FIG. 4, between the first void wall (403) and the second void wall (404) such the protrusion (108) and the void (107) form a transition fit in the Z-direction of these two elements such that the protrusion (108) and the void (107) are held precisely when fully engaged with one another, yet not so tightly engaged that they cannot be disassembled. In this manner, the apex (704) and the bottom surface (705) of the protrusion (108) secure the side panels (102, 103, 104, 105) to the base (101) in a third coordinate direction; namely, the Z-direction.

With reference to FIG. 7, and FIGS. 8-11, 15, and 17-19, a distance, $D_2$, between an inner surface of the side panels (102, 103, 104, 105) where the protrusion (108) begins, and an interface surface (706) of the extension (702) of the protrusions (108) is approximately equivalent to a thickness of the first void wall (403). In this manner, a base lip (801) is formed by the side panels (102, 103, 104, 105) as coupled to the base (101) and the side walls (402) of the base (101). As will be described in more detail below, the base lip (801) of a first storage device (100) allows for the first storage device (100) to be stackable on and secured to a second storage device (100) due to the base lip (801) coupling to the interior of the coupled side panels (102, 103, 104, 105) of the second storage device (100).

With reference to FIGS. 2 and 3, the protrusions (108) further include tapered ends (201) as mentioned above. The tapered ends (201) match and the curved side walls (405) defined in the void (107). The tapered ends (201) secure the side panels (102, 103, 104, 105) to the base (101) in a second coordinate direction; namely, the Y-direction relative to the first (102) and second (103) side panels, and in the X-direction relative to the third (104) and fourth (105) side panels. Like other features of the protrusions (108), the tapered ends (201) and the curved side walls (405) form a transition fit such that the tapered ends (201) and the curved side walls (405) are held precisely when fully engaged with one another, yet not so tightly engaged that they cannot be disassembled.

With the interfaces of the protrusions (108) including the extensions (702), the sloping face (703), the apex (704), the bottom surface (705), and the interface surface (706) interfacing with the void (107) including the first void wall (403), the second void wall (404), the curved side walls (405), and internal portions of the void (107), the side panels (102, 103, 104, 105) are able to be selectively coupled to the base (101). As mentioned above, the coupling of the side panels (102, 103, 104, 105) to the base (101) in this manner creates a transition fit between these elements. A transition fit may be defined as any fit between elements of a device that holds those elements together precisely and securely, while still allowing the elements to be disassembled. In a transition fit, the tolerances between the elements may vary to provide the precise and secure hold between the elements.

Figure 10:
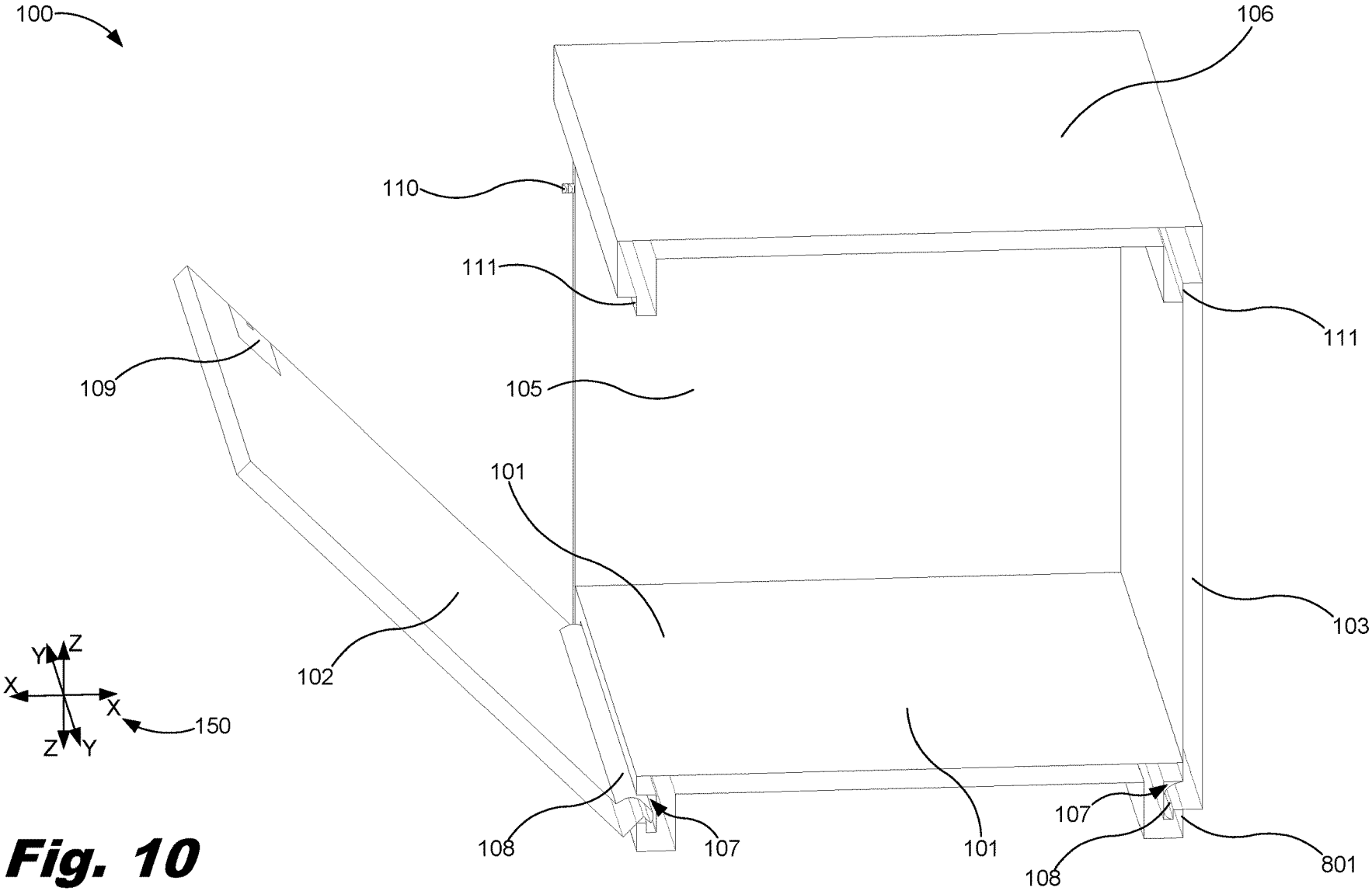
FIG. 10 is an isometric view of the storage device of FIG. 1 in a partially assembled state, according to one example of the principles described herein.
Figure 11:
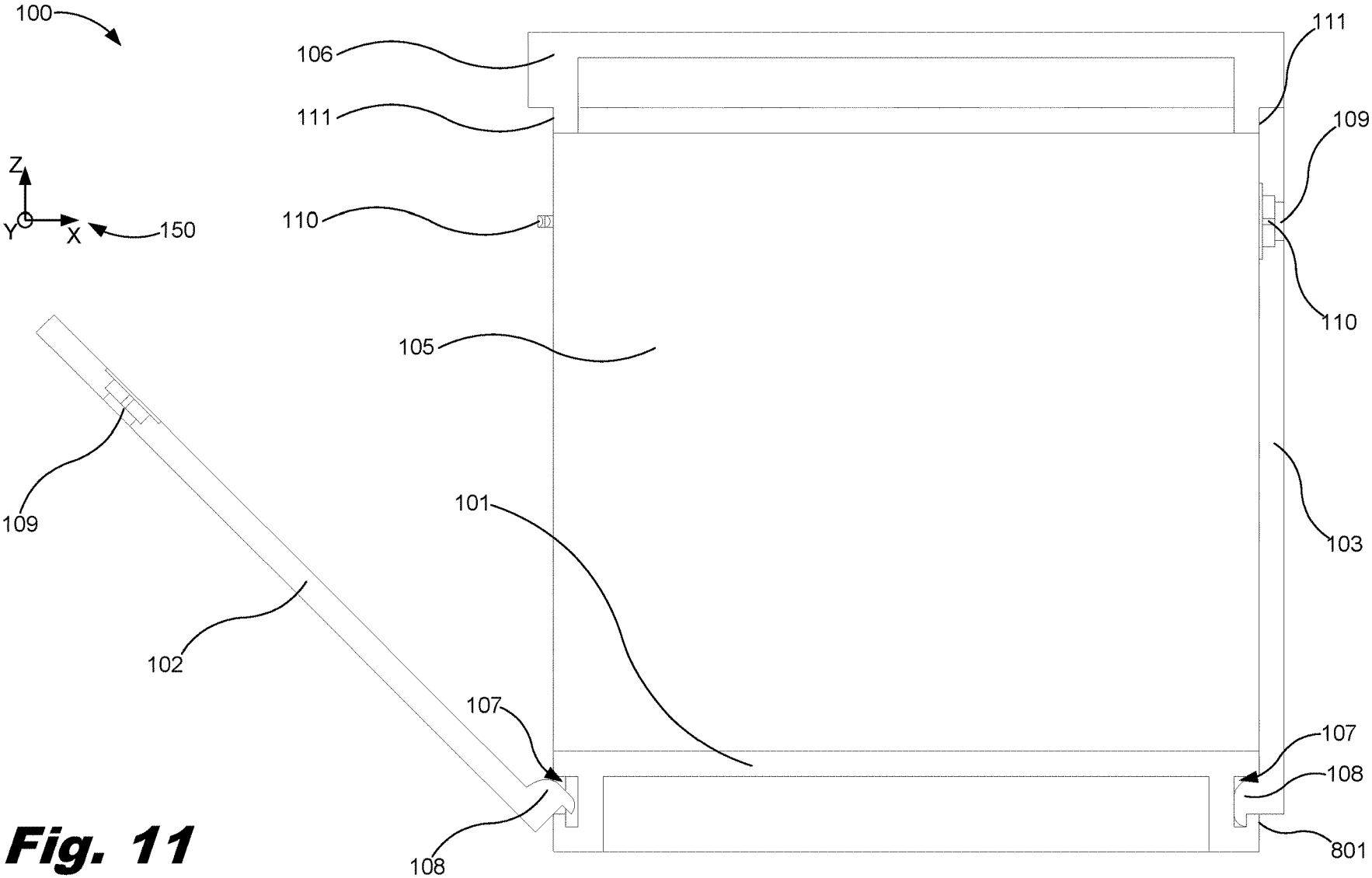
FIG. 11 is a cut-away side view of the storage device of FIG. 1 in a partially assembled state, according to one example of the principles described herein.
Figure 12:
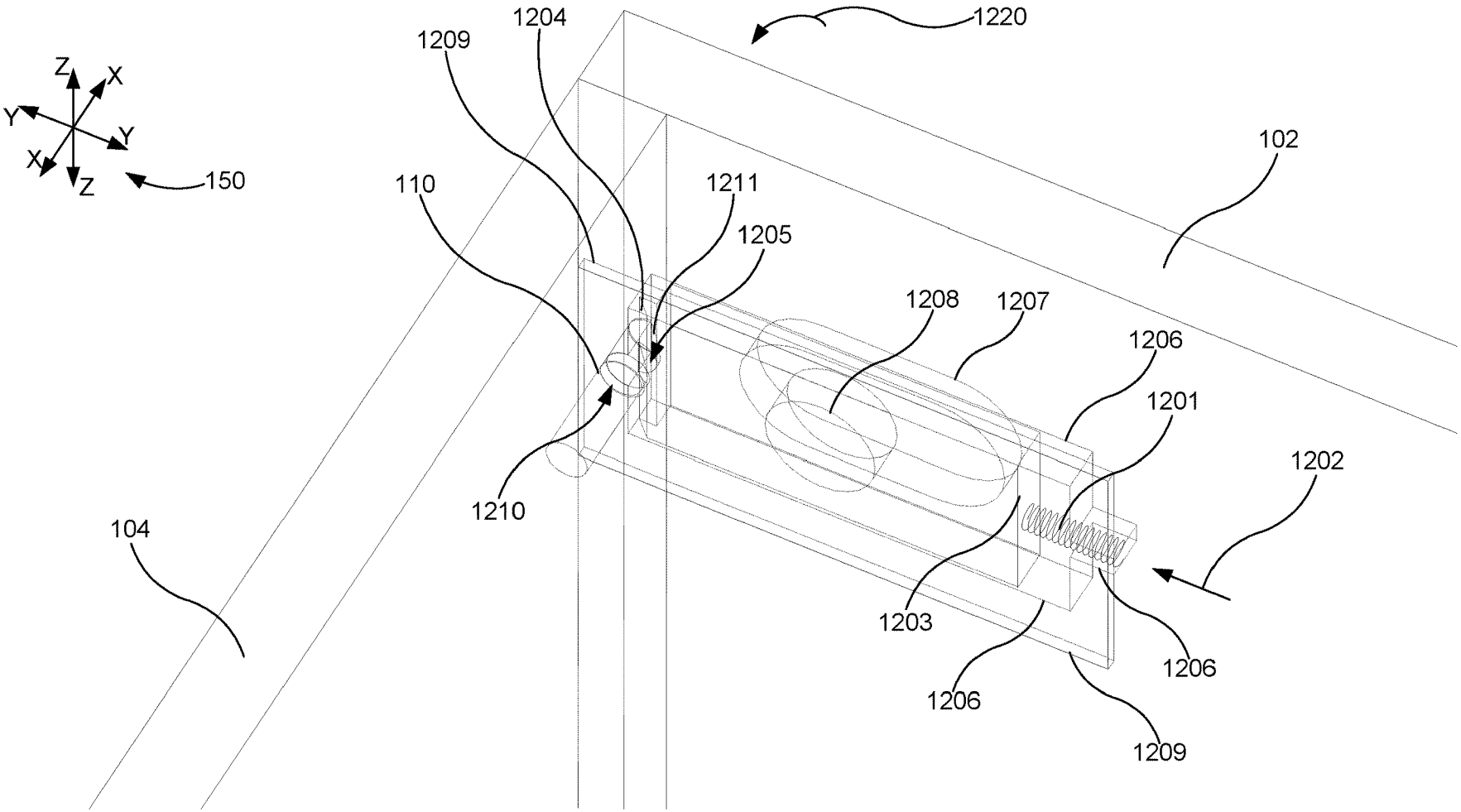
FIG. 12 is an isometric view of a coupling device used to couple adjacent side panels of the storage device of FIG. 1, according to one example of the principles described herein.
Figure 13:
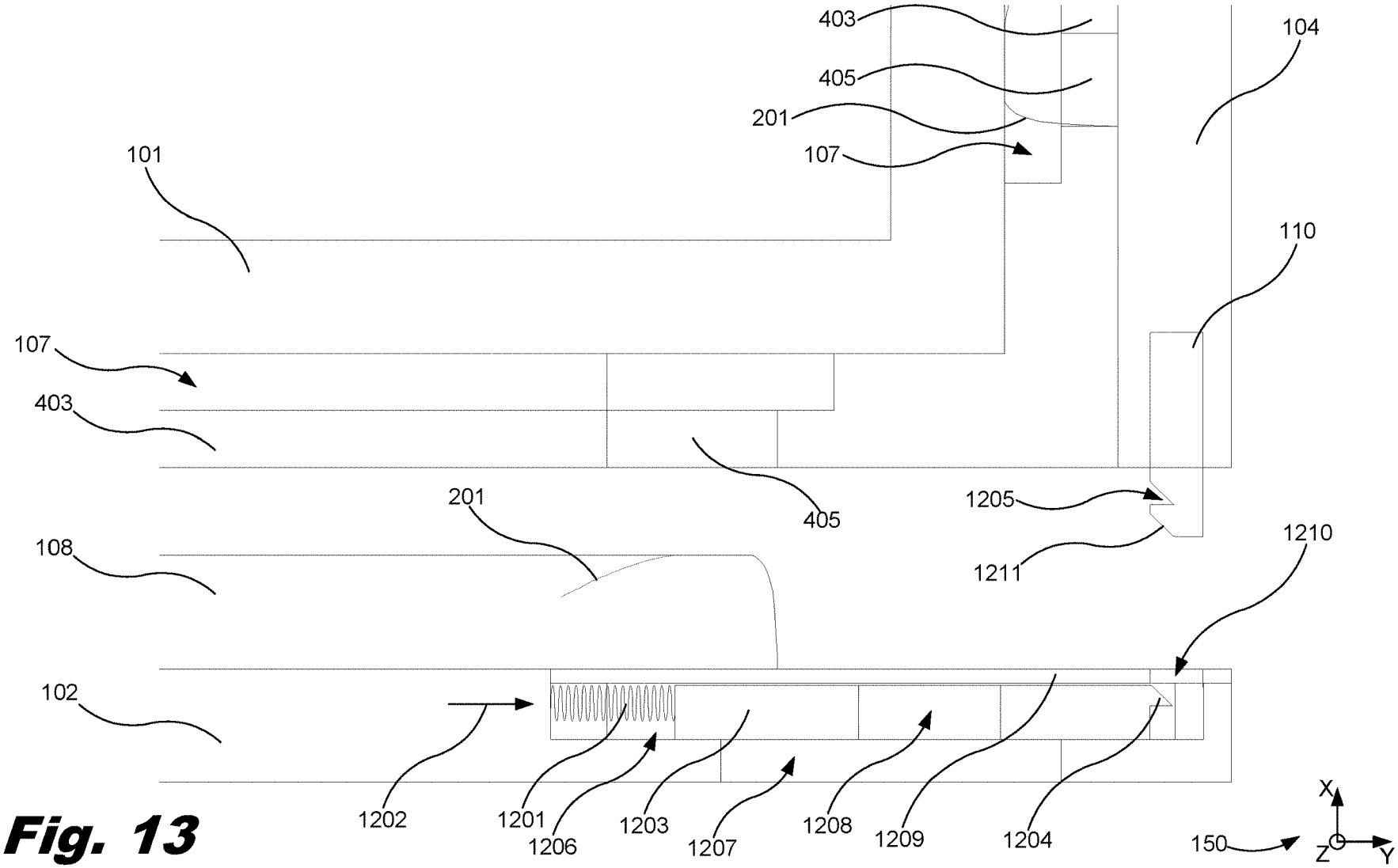
FIG. 13 is a cut-away top view of the coupling device of FIG. 12 previous to coupling the adjacent side panels, according to one example of the principles described herein.

Having described the transition fit between the side panels (102, 103, 104, 105) and the base (101), the coupling between the side panels (102, 103, 104, 105) will now be described in more detail in connection with FIGS. 6, and 8 through 14. Having already introduced FIGS. 6 and 8, FIG. 9 is an isometric view of the storage device (100) of FIG. 1 in a partially assembled state, according to one example of the principles described herein. Further, FIG. 10 is an isometric view of the storage device (100) of FIG. 1 in a partially assembled state, according to one example of the principles described herein. Still further, FIG. 11 is a cut-away side view of the storage device (100) of FIG. 1 in a partially assembled state, according to one example of the principles described herein. Yet further, FIG. 12 is an isometric view of a coupling device (109, 110) used to couple adjacent side panels (102, 103, 104, 105) of the storage device (100) of FIG. 1, according to one example of the principles described herein. FIG. 13 is a cut-away top view of the coupling device (109, 110) of FIG. 12 previous to coupling the adjacent side panels (102, 103, 104, 105), according to one example of the principles described herein. Further, FIG. 14 is a cut-away top view of the coupling device (109, 110) of FIG. 12 after coupling the adjacent side panels (102, 103, 104, 105), according to one example of the principles described herein.

As mentioned above, the side panels (102, 103, 104, 105) are coupled to one another as the side panels (102, 103, 104, 105) are brought into a vertical position in which the side panels (102, 103, 104, 105) are coupled to the base (101) and oriented perpendicular to the top surface (401) of the base (101) and the top surface (501) of the lid (106). In FIGS. 9-11,15, and 17-19, a number of the side panels (102, 103, 104, 105) are depicted in this orientation.

In order to secure the side panels (102, 103, 104, 105) to one another, and to ensure that the side panels (102, 103, 104, 105) remain in the vertical position, a number of coupling devices including the spring-loaded catches (109) and mating grooved pin (110) mentioned above are included in the side panels (102, 103, 104, 105). The figures depict the spring-loaded catches (109) as being embedded in the first (102) and second (103) side panels, and the grooved pins (110) as being embedded in the third (104) and fourth (105) side panels. However, in another example, the spring-loaded catches (109) may be embedded in the third (104) and fourth (105) side panels, and the grooved pins (110) may be embedded in the first (102) and second (103) side panels. In still another example, the spring-loaded catches (109) and grooved pins (110) may be embedded within any of the side panels (102, 103, 104, 105) in any arrangement.

Figure 14:
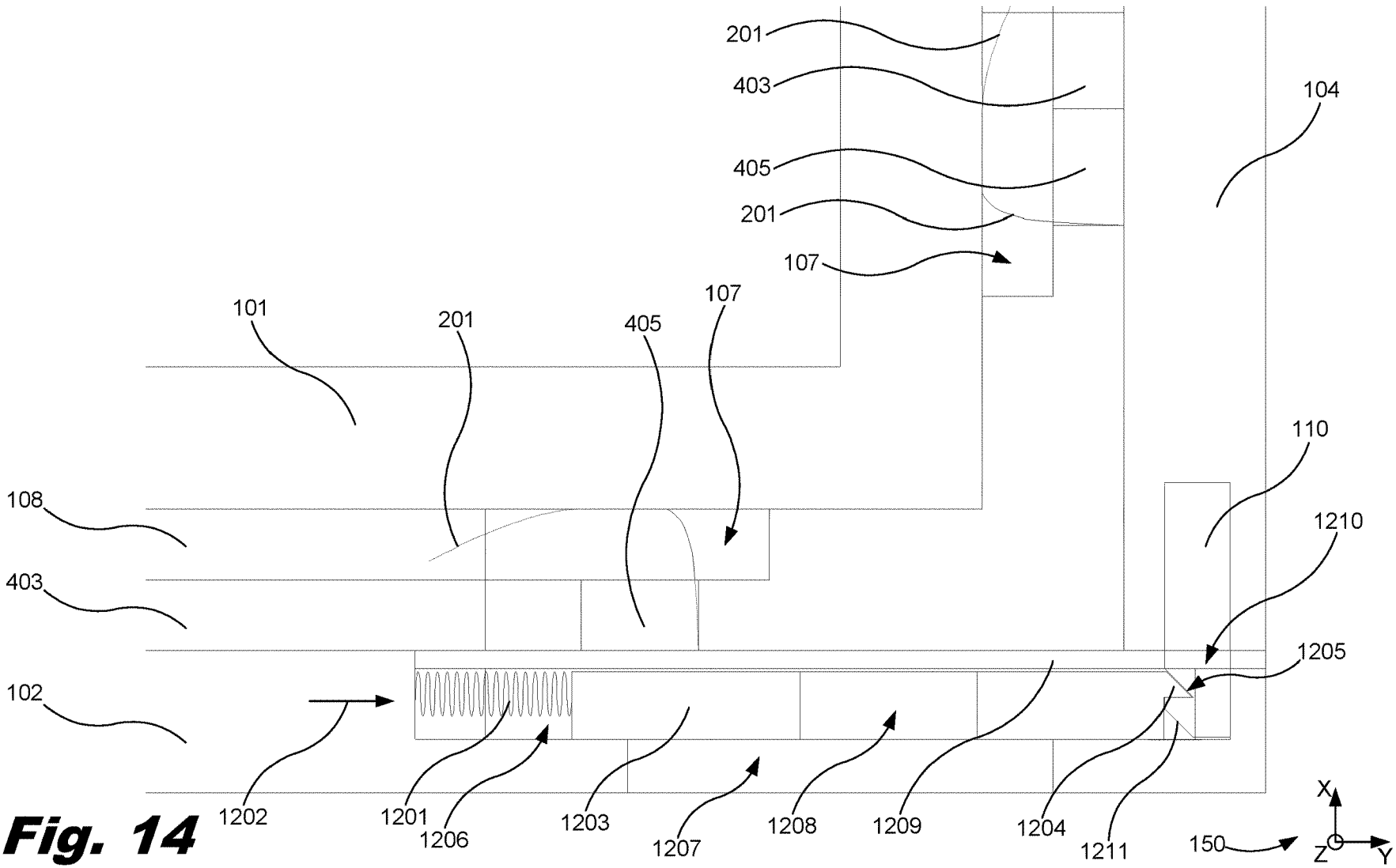
FIG. 14 is a cut-away top view of the coupling device of FIG. 12 after coupling the adjacent side panels, according to one example of the principles described herein.

With reference to FIGS. 12 through 14, the spring-loaded catches (109) include a catch spring (1201) biased in the direction of arrow 1202 to force a catch plate (1203) in the same direction. The catch plate (1203) includes an angled edge (1204) that is dimensioned to interface with and seat in a groove (1205) defined in the grooved pin (110).

The catch spring (1201) and the catch plate (1203) are embedded within a recess (1206) defined within the side panel (102, 103, 104, 105). The recess (1206) is formed by removing material from the inside surface of the side panel (102, 103, 104, 105). An aperture (1201) is defined in the recess (1206) such that the recess (1206) opens to the outside surface of the side panel (102, 103, 104, 105). The aperture (1207) allows a user to access the catch plate (1203) embedded within the recess (1206). More specifically, a finger hole (1208) is defined within the catch plate (1203). The finger hole (1208) allows a user to insert his or her finger into the finger hole (1208) via the aperture (1207) in order to apply force opposite the biasing force provided by the catch spring (1201) and opposite arrow 1202 in order to disengage the angled edge (1204) form the groove (1205) of the pin (110). In this manner, the user is able to decouple the first side panel (102) from the third side panel (104).

The remainder of the recess (1206) not including the aperture (1207), and a faceplate (1209) hold the catch spring (1201) and catch plate (1203) within the recess (1206). The faceplate (1209) is also recessed within the side panel (102, 103, 104, 105). In this manner, the spring-loaded catches (109) are formed into the side panel (102, 103, 104, 105) such that the spring-loaded catches (109) are flush with the inner and outer sides of the side panel (102, 103, 104, 105). This creates a more aesthetically pleasing and cleaner look for the storage device (100). Further, the storage device (100) is able to be stacked directly adjacent another storage device (100) without space between the storage devices (100) since no hardware protrudes from the sides of the storage devices (100).

Figure 15:
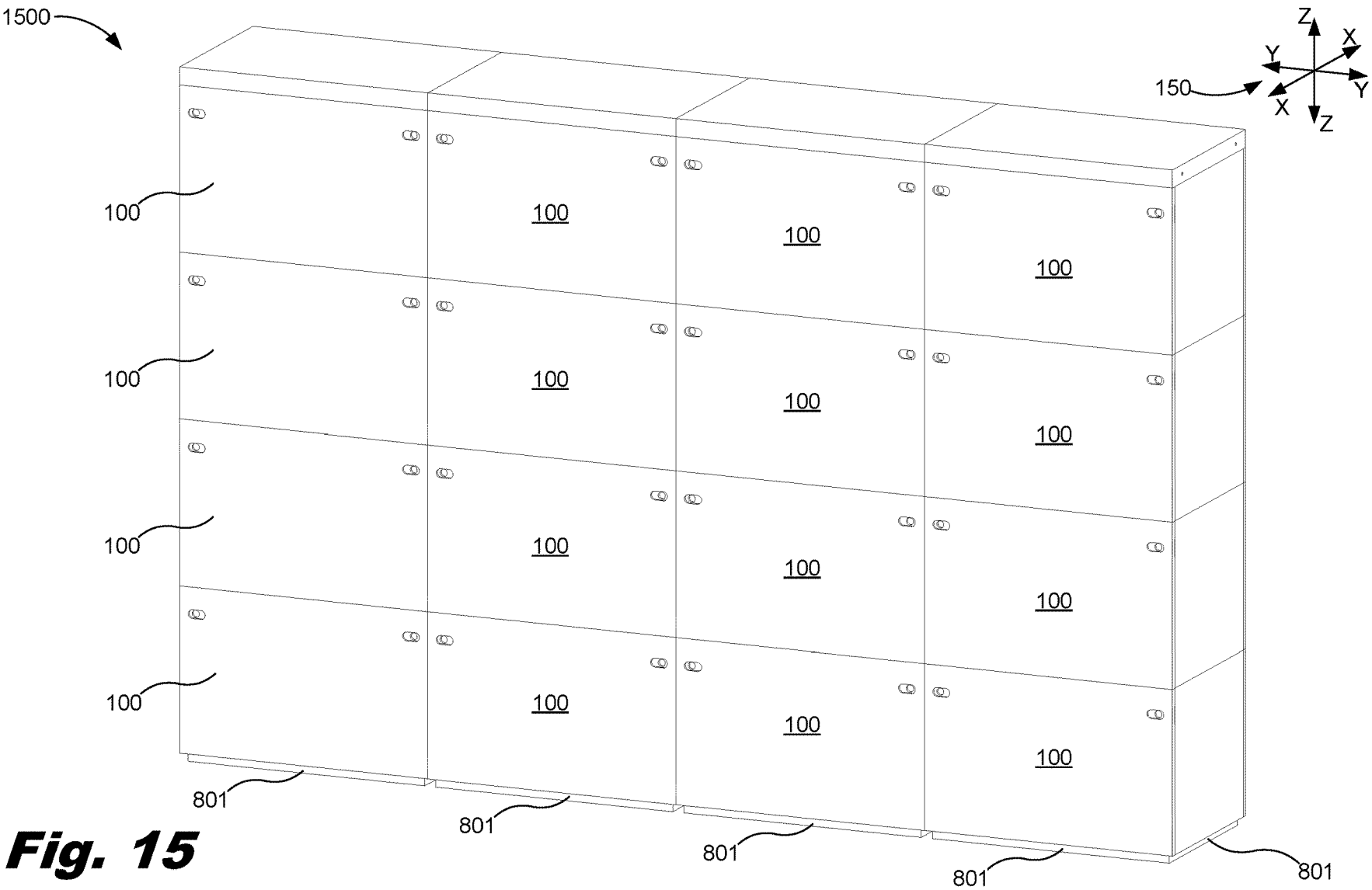
FIG. 15 is an isometric view of a plurality of storage devices in a stacked arrangement, according to one example of the principles described herein.

A faceplate aperture (1210) is defined in the faceplate (1209), through which the pin (110) is allowed to enter. Thus, once the first side panel (102) is brought to interface with the third side panel (104), for example, as indicated by arrow 1220, the pin (110) enters the faceplate aperture (1210) engages the angled edge (1204) of the catch plate (1203) with an angled, leading edge (1211) of the pin (110), and moves the catch plate (1203) in the opposite direction of arrow 1202 overcoming the spring bias of the catch spring (1201). The angled edge (1204) of the catch plate (1203) moves along the pin (110) until it reaches the groove (1205) of the pin (110). The bias of the catch spring (1201) forces the catch plate (1203) into the groove (1205) of the pin (110), and the first side panel (102) is coupled to the third side panel (104). With the understanding of how a storage device (100) is assembled as described above, the manner in which the storage devices may be assembled into a stacked array will now be described in connection with FIGS. 15 through 18. FIG. 15 is an isometric view of a plurality of storage devices (100) in a stacked arrangement (1500), according to one example of the principles described herein.

Figure 16:
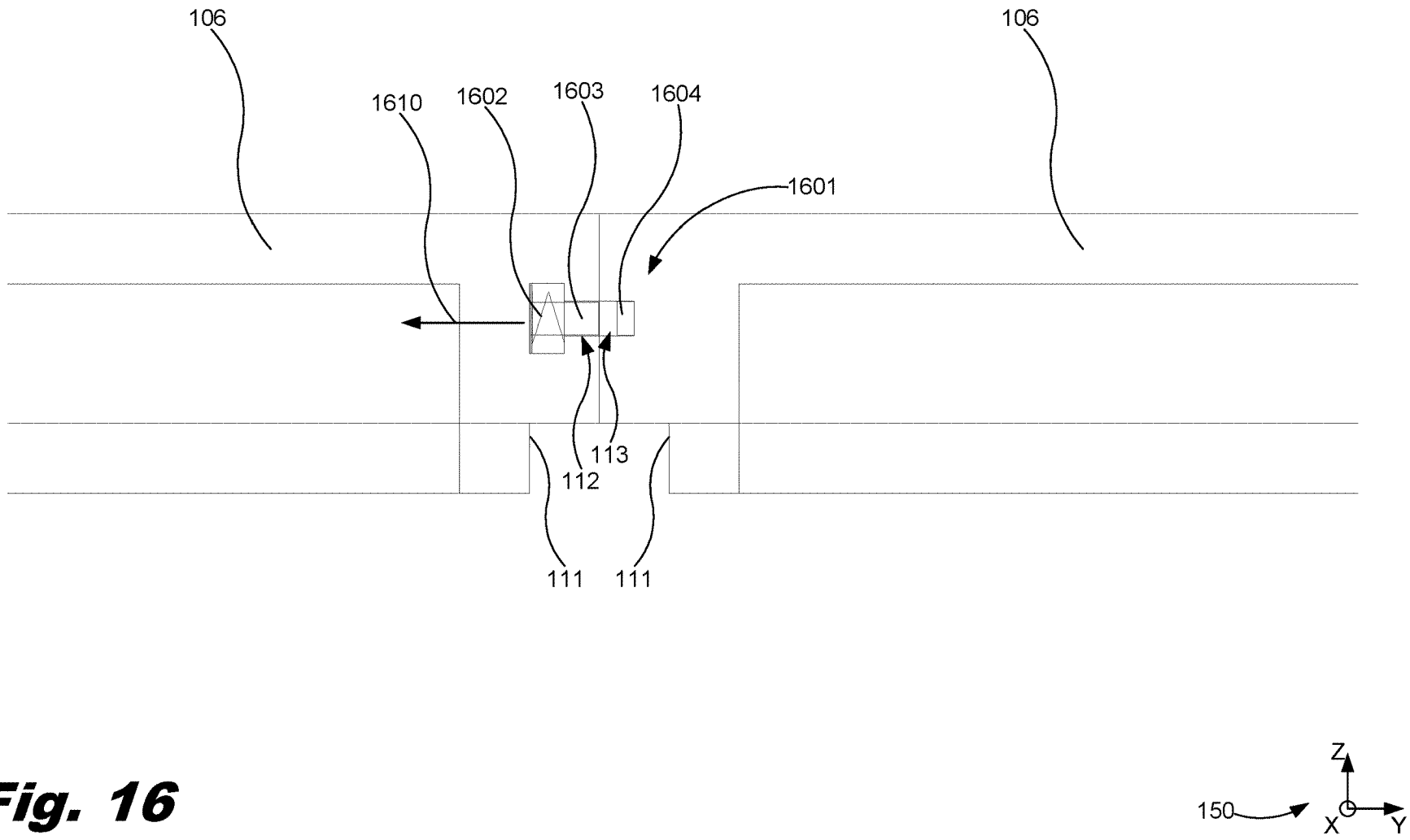
FIG. 16 is a cut-away side view of a lid pin coupling device used to align and couple adjacent storage devices for arrangement like unto the arrangement of FIG. 15, according to one example of the principles described herein.
Figure 17:
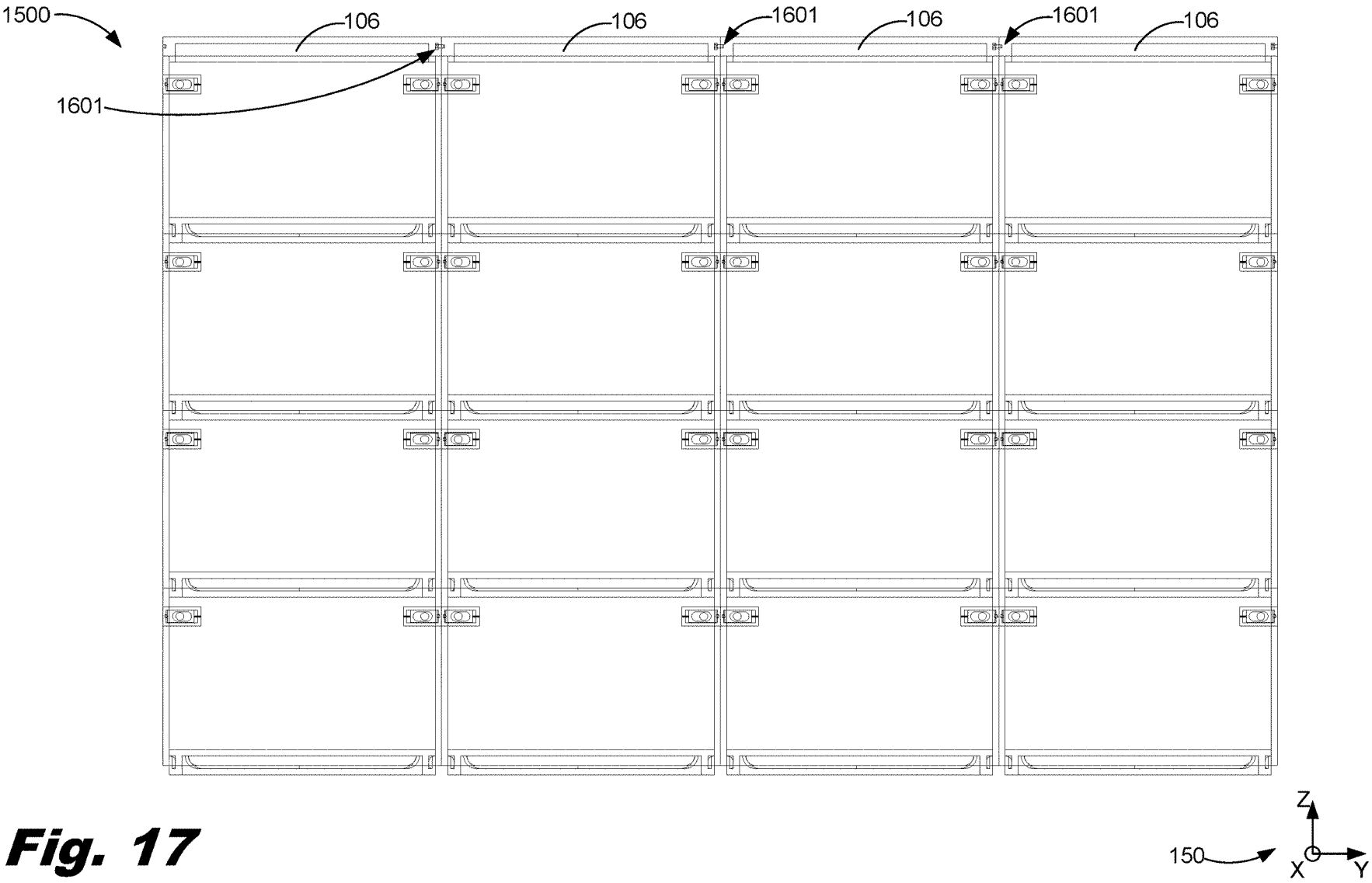
FIG. 17 is a cut-away front view of the plurality of storage devices of FIG. 15 in the stacked arrangement, according to one example of the principles described herein.
Figure 18:
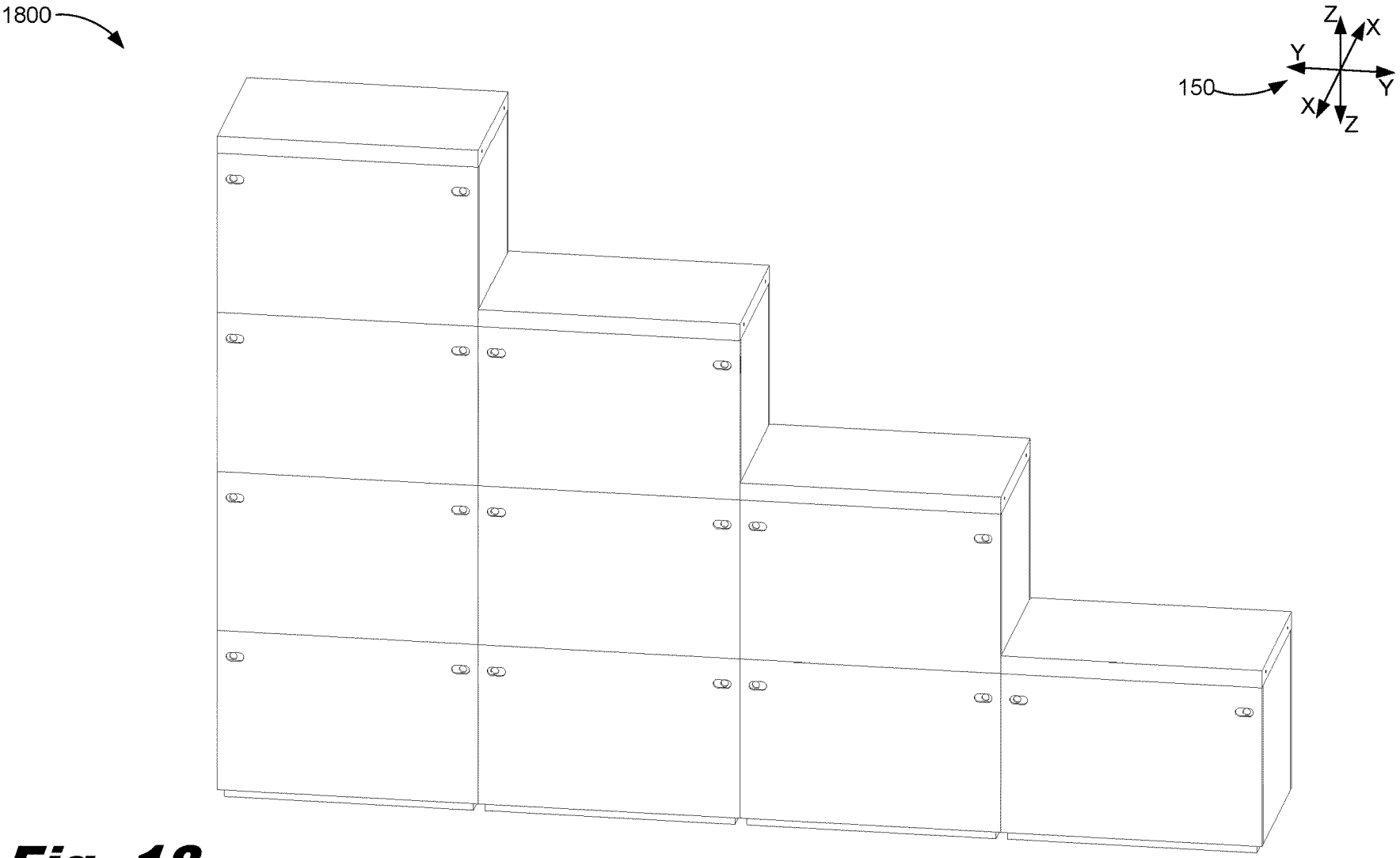
FIG. 18 is an isometric view of a plurality of storage devices in a stepped arrangement, according to one example of the principles described herein.

Further, FIG. 16 is a cut-away side view of a lid pin coupling device used to align and couple adjacent storage devices (100) for arrangement like unto the arrangement (1500) of FIG. 15, according to one example of the principles described herein. Still further, FIG. 17 is a cut-away front view of the plurality of storage devices (100) of FIG. 15 in the stacked arrangement (1500), according to one example of the principles described herein. FIG. 18 is an isometric view of a plurality of storage devices (100) in a stepped arrangement (1900), according to one example of the principles described herein.

A plurality of storage devices (100) may be arranged in an array as depicted in FIGS. 15 through 18. FIGS. 15 through 17 depict a stacked arrangement (1500) whereas FIG. 18 depicts a stepped arrangement (1800). The storage devices (100) are coupled together in the vertical direction by not including a lid (106) for the storage devices (100) that are not located at the top of the arrangement (1500, 1800). As mentioned above, the base lip (801) formed by the side panels (102, 103, 104, 105) as coupled to the base (101) and the side walls (402) of the base (101) may be inserted into an open-toped storage device (100). in this example, the horizontal portion of the base lip (801) interfaces with the tops of the side panels (102, 103, 104, 105), and the vertical portion of the base lip (801) interfaces with the interior sides of the side panels (102, 103, 104, 105). Thus, the base lip (801) interfaces with the side panels (102, 103, 104, 105) in a manner identical to how the lid (106) interfaces with the side panels (102, 103, 104, 105). The lip (111) of the lid (106) has the same dimensions as the base lip (801). Thus, the entire array of storage devices (100) has sides that are flush with no elements of any of the storage devices (100) protruding from a side of the arrangement (1500, 1800).

In FIG. 16, a lid pin coupling device (1601) is depicted. In FIG. 16, two lids (106) are depicted as being adjacent to one another and abutting. The lid pin coupling device (1601) includes a lid pin spring (1602) coupled to a lid pin (1602) and biased in the direction of arrow 1610 such that the lid pin (1602) is drawn in the direction of arrow 1610 and into the first hole (112). A magnet (1604) is embedded within the second hole (113). When the two lids (106) are brought together and abutting as shown in FIG. 16, the magnet (1604) pulls on the lid pin (1603) and overcomes the biased spring force of the lid pin spring (1602). Thus, the magnet (1604) pulls the lid pin (1603) into the second hole (113) in the direction opposite arrow 1610.

When a user desires to decouple the lids (106), the user pulls the lids (106) apart. The pulling of the lids apart creates more of a gap between the two lids (106), and causes the magnet (1604) to no longer attract the lid pin (1603) due to the increased distance. The lid pin spring (1602) then pulls the lid pin (1603) back into the first hole (112) in the direction of arrow 1610.

In one example, each side of the lid (106) may include a number of first holes (112) including the lid pin (1603) and the lid pin spring (1602), a number of second holes (113) including the magnet (1604), or a combination thereof. Further, in one example, the lids (106) may be manufactured to include aligned and mating first (112) and second (113) holes such that coupling the lids (106) together may be achieved by bringing any side of the lids (106) into contact with each other. By using the lid pin coupling devices (1601), the storage devices (100) may be coupled to one another, and increase stability of the storage devices (100) while in a stacked arrangement (1500, 1800). FIG. 17 depicts the lid pin coupling devices (1601) with the lid pin (1603) engaged within the second hole (113) and coupling the lids (106) together. Further, FIG. 18 depicts an alternative arrangement (1800) of the storage devices (100). in FIG. 18, the lid pin coupling devices (1601) are not engaged since two lids (106) are not adjacent to one another, but are located at separate levels of storage devices (100).

With the storage devices arranged as depicted in FIGS. 15 through 18, the storage devices (100) may be individually opened as depicted in FIGS. 9, 10, and 11. Thus, even when arranged as in FIGS. 15 through 18, the interior of the storage devices (100) may be accessed. This conveniently allows a user to access items within the storage devices (100) without completely disassembling the storage devices (100). Further, this allows the user to access the items in the storage devices (100) without disturbing the arrangement (1500, 1800) of the storage devices (100).

Figure 19:
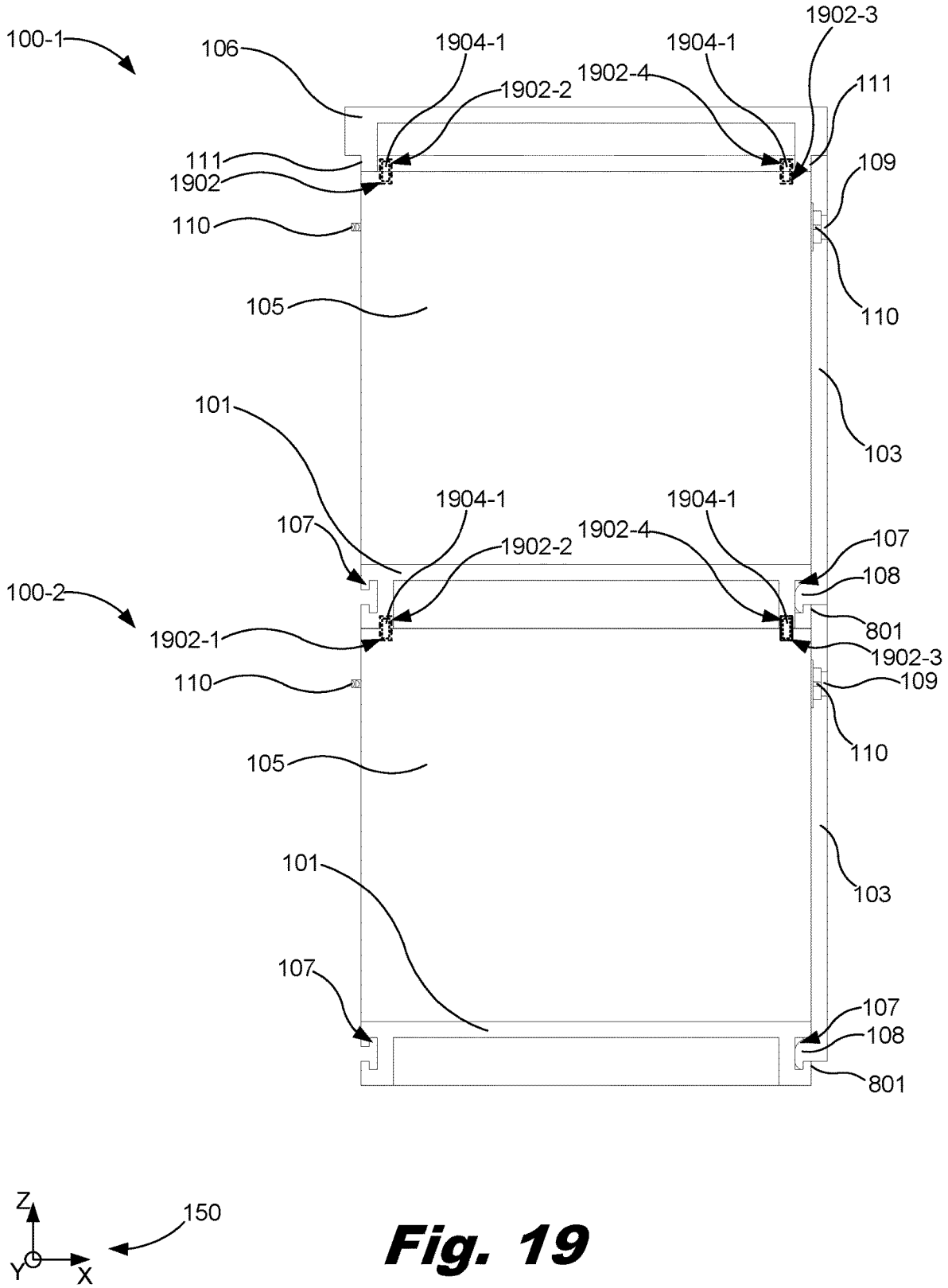
FIG. 19 is a cut-away side view of a number of storage devices in a stacked arrangement, according to one example of the principles described herein.

FIG. 19 is a cut-away side view of a number of storage devices (100-1, 100-2) in a stacked arrangement, according to one example of the principles described herein. As illustrated, a first storage device (100-1) is stacked on top of a second storage device (100-2). In one example, to add stability between storage devices (100-1, 100-2) when arranging the storage devices (100-1, 100-2) in a stacked arrangement, and to add stability to the sides of a particular one of the storage devices (100-1, 100-2) when the first side panel (102) is removed from the storage device (100-1, 100-2), each of the storage devices (100-1, 100-2} may in dude a number of coupling devices (1902 and 1904). In one example, the coupling devices (1902, 1904) include a number of dowels (1904) and a number of recesses (1902). The recesses (1902) are formed in a top portion of the third side panel (104-2) and in a top portion of the fourth side panel (105-2) as illustrated in FIG. 19. For example, a first recess (1902-1) is formed in the top portion of the fourth side panel (105-2). A third recess (1902-3) is formed in the top portion of the fourth side panel (105-2). Further, a second recesses (1902-2) and a fourth recess (1902-4) are created in a bottom portion of the base (101-1) and the lid (106) as illustrated in FIG. 19. In this example, the first recess (1902-1) and the second recess (1902-2) align when the storage devices (100) are in a stacked arrangement of FIG. 19. Further, the third recess (1902-3) and the fourth recess (1902-4) align when the storage devices (100) are in a stacked arrangement of FIG. 19. The recesses (1902) are sized such that a metal or wooden dowel (1904) may be inserted into the recesses (1902) to removably secure the storage devices (100) together to add stability as mentioned above.

To arrange the storage devices (100) in a stacked arrangement, the second storage device (100-2) is place on a surface, such as a floor. A first dowel (1904-1) is inserted in the first recess (1902-1) of the fourth side panel (105-2). A second dowel (1904-2) is inserted in the third recess (1902-3) of the fourth side panel (105-2). Although not illustrated, other dowels may be placed in other recesses in the third side panel (104). With the first dowel (1904-1) protruding from the first recess (1902-1) and the second dowel (1904-2) protruding from the third recess (1902-3), the first storage device (100-1) is placed on top of the second storage device (100-2). With the first storage device (100-1) placed on top of the second storage device (100-2), the storage devices (100) are aligned such that the first dowel (1904-1) is inserted in the second recess (1902-1) of the base (101-1). The second dowel (1904-2) is inserted in the fourth recess (1902-3) of the base (101-1). As a result, the dowels (1904) removably secure the storage device (100-1) to the second storage device (100-2), This adds stability to the storage device (100) in the stacked arrangement.

Further, the recesses (1902) and dowels (1904) add stability between the second side panel (103), the third side panel (104), and the fourth side panel (105) of the storage devices (100). As depicted in FIG. 19, the recesses (1902) are also formed in the side panels and the lid (106), and a dowel (1904) is inserted therein. In this manner, the lid (106) is used to further secure the second side panel (103), the third side panel (104), and the fourth side panel (105) in addition to the coupling devices (109, 110) used to couple adjacent side panels (102, 103, 104, 105) of the storage device (100). This reduces or eliminates the ability of the third side panel (104) and the fourth side panel (105) from spreading apart from one another in the Y-direction if the first side panel (102) or the second side panel (103) are removed from the storage device (100).

While this example has been described with reference to two recesses created in the top portion of the fourth panel and the third panel, any number of recesses may be created in any side panel, lid, or base of the storage device. For example, a storage device may include three recesses on the lid of the storage device. In this example, the storage device may include corresponding recesses in the base.

Figure 20:
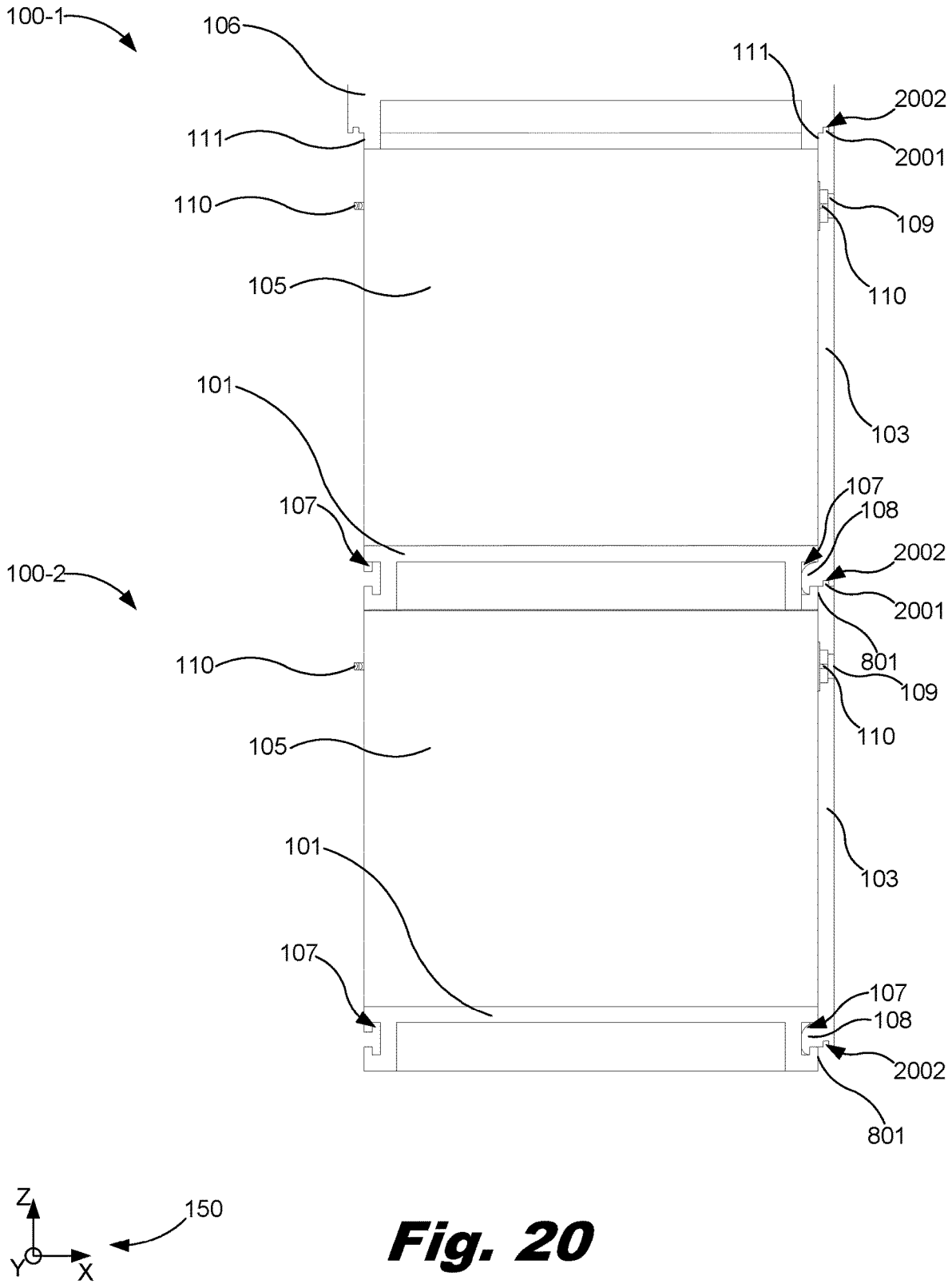
FIG. 20 is a cut-away side vie\"I of a number of storage devices in a stacked arrangement, according to another example of the principles described herein.

While this example has been described with reference to the coupling devices being recesses and dowels, the coupling devices may be other mechanisms. For example, the coupling devices may include a tongue and groove system, a number of fasteners, a number of voids and protrusions, other mechanisms, or combinations thereof. FIG. 20 is a cut-away side view of a number of storage devices in a stacked arrangement, according to another example of the principles described herein. FIG. 20 depicts the tongue and groove example in which a tongue (2001) may be formed on at least one of the first side panel (102), the second side panel (103), the third side panel (104), and the fourth side panel (105). A groove (2002) may be defined in the lip (111) of the lid (106) and the bottom of the side panels (102, 103, 104, 105) to receive the tongues (2001).

In one example, the third side panel (104) and the fourth side panel (105) include the tongues (2001) formed thereon. In this example, the first side panel (102) and the second side panel (103) are able to be selectively decoupled from the storage devices (100) without being obstructed by the tongues (2001) and grooves (2002). In another example, all of the side panels (102, 103 104, 105) include the tongues (2001). In this example, the grooves (2002) defined in the lip (111) of the lid (106) may be formed around the entirety of the lid (106), the bottoms of neighboring side panels (102, 103 104, 105), or combinations thereof.

Having described a first example of the storage device of FIGS. 1 through 20, a second example of the storage device will now be described in connection with FIGS. 21 through 41. Identical elements described in connection with the example of the storage device of FIGS. 1 through 20 may be included in the example of the storage device of FIGS. 21 through 41, and their description is provided herein in connection with FIGS. 1 through 20 and elsewhere and apply mutatis mutandis to the examples described in connection with FIGS. 21 through 41.

Examples described herein provide a storage device including a base comprising a number of voids defined therein, a number of side panels selectively coupled to the base; and a protrusion coupled to each side panel to couple the side panels to the base by restricting movement of the side panels relative to the base in at least two coordinate directions once inserted into the voids. The protrusion includes an extension to seat in a bottom portion of the void, the extension extending past a first wall of the opening of the void and downward into the base past the void to secure the side panels to the base in a first coordinate direction. The protrusion also includes tapered ends where the tapered ends matching a number of curved side walls defined in the void. The tapered ends securing the side panels to the base in a second coordinate direction. The protrusion also includes a sloping face beginning at an apex of the protrusion and terminating at the bottom of the extension; and a securing device coupled to each of the side panels to secure the side panels to an adjacent one of the side panels. The apex of the sloping face abuts a second wall of the opening of the void when the side panels are brought into a perpendicular position relative to a top surface of the base, the apex and a bottom surface of the protrusion securing the side panels to the base in a third coordinate direction.

The securing devices include two latches coupled to each of a first two of the side panels. The first two of the side panels are on opposite sides of the storage device. The securing devices also include two slidable coupling devices coupled to each of a second two of the side panels. The second two of the side panels are on opposite sides of the storage device. The latches coupled to the first two of the side panels couple to the slidable coupling devices coupled to the second two of the side panels. The latches each include a latch void.

The slidable coupling devices each include a latch housing including a latch housing void defined therein to receive an end of the latch, and a latch slider housed within the latch housing including a latchbolt protruding from a body of the latch slider to allow the latch to enter the latch housing void of the latch housing and past the latch slider. The slidable coupling devices also include a spring disposed between the latch housing and the latch slider to bias the latch slider within the latch housing in a first direction. The spring forces the latch slider into the latch void as the latch forces the latch slider in a second direction opposite the first direction as the latch enters the latch housing void of the latch housing and past the latch slider.

The latchbolt protruding from the body of the latch slider is angled such that the introduction of the latch into the latch housing void of the latch housing and past the latch slider forces the spring in a second direction opposite the first direction as the forces the latch runs along the angled latchbolt. The securing devices include a first backing substrate located on a first side of the latch slider and the latch housing, a second substrate located on a second side of the latch slider and the latch housing, a face plate to secure the slidable coupling devices to the second two of the side panels, and a finger ring press fitted into a finger ring void defined in the latch slider.

The first backing substrate and the second backing substrate are made of nylon. The securing devices of the side panels secure the side panels to one another in three coordinate directions. The securing devices are flush with the surfaces of the side panels such that no portion of the spring-loaded catch protrudes past a surface of the side panels.

The protrusions each include an extension to seat in a bottom portion of the void. The extension extends past a first wall of the opening of the void and downward into the void to secure the side panels to the base in a first coordinate direction. The protrusions also each include tapered ends. The tapered ends match a number of curved side walls defined in the void, and the tapered ends secure the side panels to the base in a second coordinate direction. The protrusions also each include a sloping face beginning at an apex of the protrusion and terminating at the bottom of the extension.

The apex of the sloping face abuts a second wall of the opening of the void when the side panels are brought into a perpendicular position relative to a top surface of the base. The apex and a bottom surface of the protrusion secures the side panels to the base in a third coordinate direction. The protrusions are dimensioned such that the side panels are secured to the base in at least two coordinate directions when the extension is inserted into the void and the extension extends past the first wall of the opening of the void and downward into the void. Further, the protrusions are dimensioned such that the side panels are secured to the base in three coordinate directions when the protrusion is inserted into the void and the side panels are brought into a perpendicular position relative to a top surface of the base. The distance between a first portion of the extension proximal to the side panel and the exterior surface of the storage device is equal to the thickness of the first wall of the opening of the void.

The storage device includes a lid dimensioned to be flush with an outside surface of the side panels when the side panels are coupled to on another. The lid includes a number of recesses defined in a portion of the perimeter of the lid to receive a portion of the latch extending above the first two of the side panels, and an angled front portion. The angled front portion of the lid matches an angled top portion defined in the second two of the side panels adjacent to the lid. Further, the angled front portion of the lid and the angled top portion of the second two of the side panels cause the second two of the side panels to clear the lid as the second two of the side panels are engaged to the base in a seated position. The lid includes a lip around the bottom edge of the lid. The lip is dimensioned to fit into an interior of the storage device when the side panels are coupled to one another.

Examples described herein provide a storage system. The storage system includes a number of storage devices. Each storage device includes a base, a number of side panels selectively coupled to the base, and two latches coupled to each of a first two of the side panels where the first two of the side panels being on opposite sides of the storage device. Further, each storage device includes two slidable coupling devices coupled to each of a second two of the side panels, the second two of the side panels being on opposite sides of the storage device. The latches coupled to the first two of the side panels couple to the slidable coupling devices coupled to the second two of the side panels. The latches each includes a latch void. The slidable coupling devices each include a latch housing comprising a latch housing void defined therein to receive an end of the latch, a latch slider housed within the latch housing comprising a latchbolt protruding from a body of the latch slider to allow the latch to enter the latch housing void of the latch housing and past the latch slider, and a spring disposed between the latch housing and the latch slider to bias the latch slider within the latch housing in a first direction. The spring forces the latch slider into the latch void as the latch forces the latch slider in a second direction opposite the first direction as the latch enters the latch housing void of the latch housing and past the latch slider.

The storage system also includes a protrusion coupled to each of the side panels, and a number of voids defined in the base. The protrusions, once inserted into the voids, restrict movement of the side panels relative to the base in at least two coordinate directions. The protrusions each include an extension to seat in a bottom portion of the void. The extension extends past a first wall of the opening of the void and downward into the void to secure the side panels to the base in a first coordinate direction. The protrusions also each include tapered ends. The tapered ends match a number of curved side walls defined in the void, and the tapered ends securing the side panels to the base in a second coordinate direction. The protrusions also each include a sloping face beginning at an apex of the protrusion and terminating at the bottom of the extension.

Each storage device includes a lid dimensioned to be flush with an outside surface of the side panels when the side panels are coupled to on another. The lid includes a number of recesses defined in a portion of the perimeter of the lid to receive a portion of the latch extending above the first two of the side panels, and an angled front portion. The angled front portion of the lid matches an angled top portion defined in the second two of the side panels adjacent to the lid. The angled front portion of the lid and the angled top portion of the second two of the side panels cause the second two of the side panels to dear the lid as the second two of the side panels are engaged to the base in a seated position.

Examples described herein provide a storage device. The storage device includes a protrusion extending from a side panel, and a void defined in a base. The protrusion includes an extension to seat in a bottom portion of the void, the extension extending past a first wall of the opening of the void and downward into the void to secure the side panels to the base in a first coordinate direction. The protrusion also includes tapered ends where the tapered ends matching a number of curved side walls defined in the void, the tapered ends securing the side panels to the base in a second coordinate direction. The protrusion also includes a sloping face beginning at an apex of the protrusion and terminating at the bottom of the extension. The protrusion, once inserted into the void, restricts movement of the side panel relative to the base in at least two coordinate directions.

The storage device also includes a securing device coupled to each of the side panels to secure the side panels to an adjacent one of the side panels. The securing devices include two latches coupled to each of a first two of the side panels, the first two of the side panels being on opposite sides of the storage device, and two slidable coupling devices coupled to each of a second two of the side panels. The second two of the side panels are located on opposite sides of the storage device. Further, the latches coupled to the first two of the side panels couple to the slidable coupling devices coupled to the second two of the side panels. The latches each include a latch void.

The slidable coupling devices each include a latch housing including a latch housing void defined therein to receive an end of the latch. The slidable coupling devices also each include a latch slider housed within the latch housing including a latchbolt protruding from a body of the latch slider to allow the latch to enter the latch housing void of the latch housing and past the latch slider. The slidable coupling devices also each include a spring disposed between the latch housing and the latch slider to bias the latch slider within the latch housing in a first direction. The spring forces the latch slider into the latch void as the latch forces the latch slider in a second direction opposite the first direction as the latch enters the latch housing void of the latch housing and past the latch slider.

The latchbolt protruding from the body of the latch slider is angled such that the introduction of the latch into the latch housing void of the latch housing and past the latch slider forces the spring in a second direction opposite the first direction as the forces the latch runs along the angled latchbolt. The securing devices include a first backing substrate located on a first side of the latch slider and the latch housing, a second substrate located on a second side of the latch slider and the latch housing, a face plate to secure the slidable coupling devices to the second two of the side panels, and a finger ring press fitted into a finger ring void defined in the latch slider.

As will be described in connection with the example of FIGS. 21 through 41, the storage device (2100) may include a lid (106) with angled portions (2106), a front side panel (102) and a back side panel (103) that each include an top angled portion (2101) and a bottom angled portion (2102), a pair of slidable coupling devices (2110) for each of the front side panel (102) and a back side panel (103), and a pair of latches (2201) for each of the other side panels (104, 105).

Figure 21:
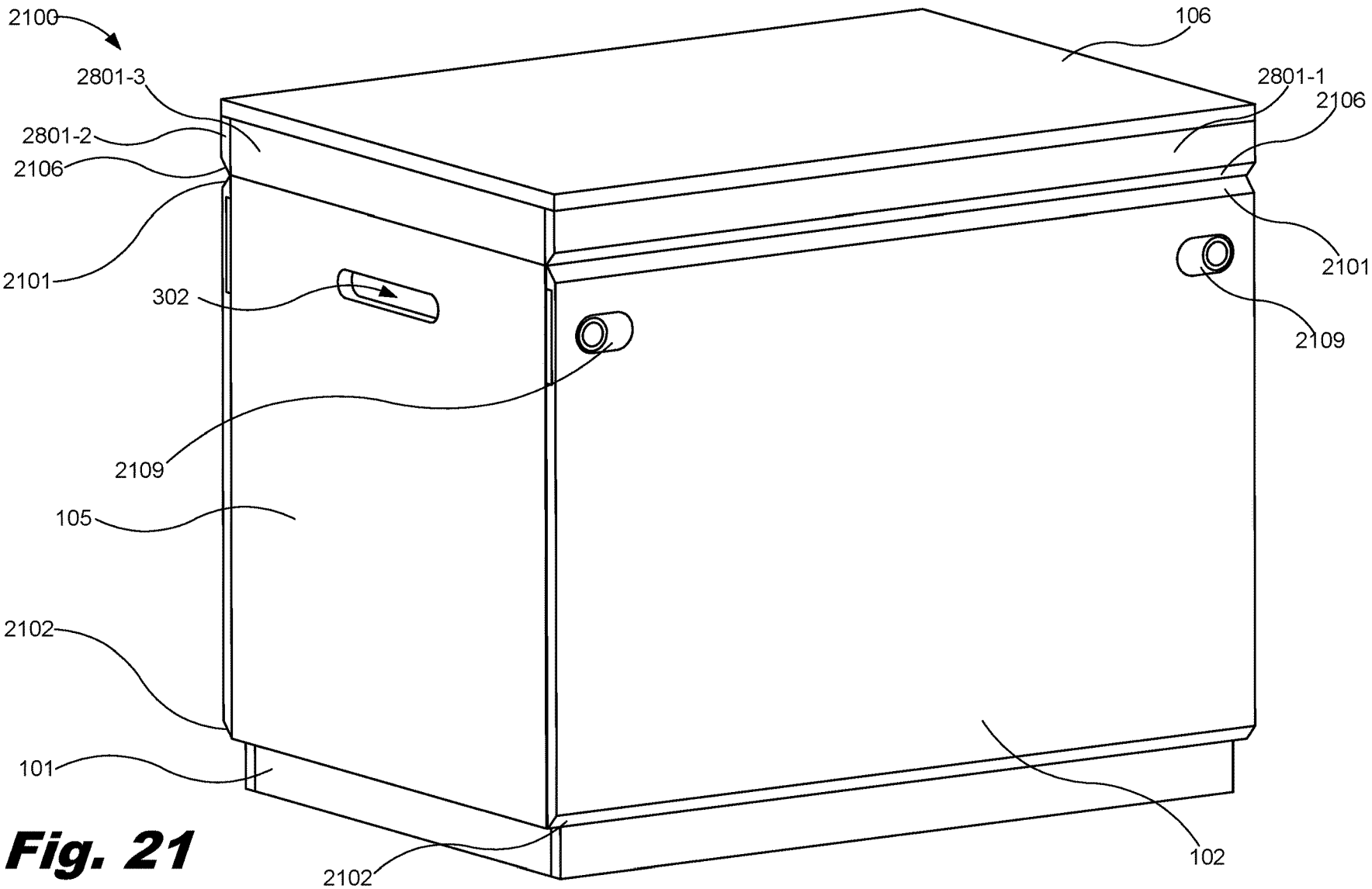
FIG. 21 is a perspective view of a storage device including a slidable coupling device, according to another example of the principles described herein.
Figure 22:
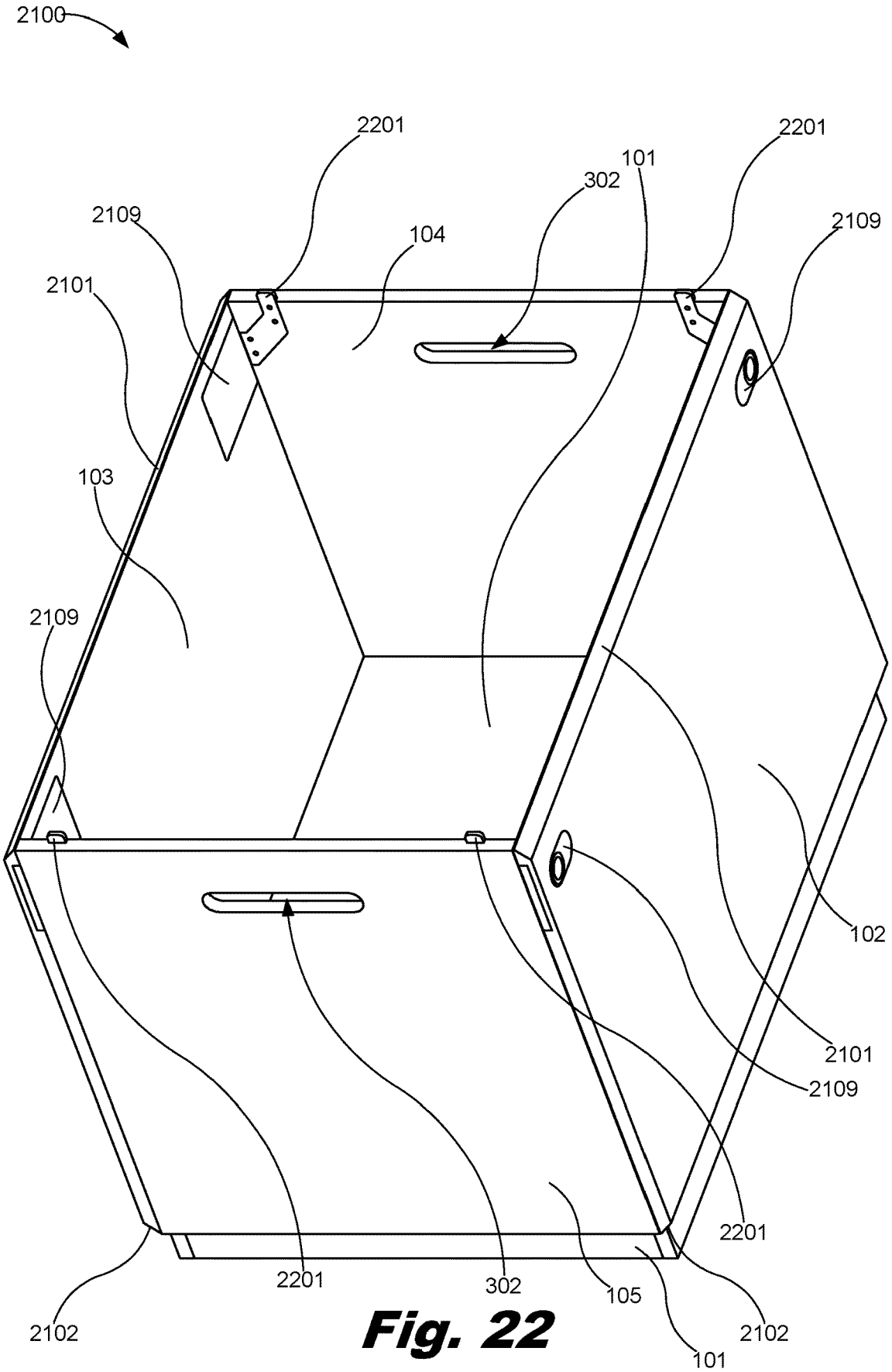
FIG. 22 is a perspective view of the storage device of FIG. 21 with a lid of the storage device removed, according to one example of the principles described herein.

Reference will now be made to FIGS. 21 and 22. FIG. 21 is a perspective view of the storage device (2100) including a slidable coupling device (2109), according to another example of the principles described herein. Further, FIG. 22 is a perspective view of the storage device (2100) of FIG. 21 with a lid (106) of the storage device (2100) removed, according to one example of the principles described herein. The storage device (2100) may include a lid (106). Along with the description provided herein with regard to the lid (106), the lid (106) of the example of FIGS. 21 through 41 include angled portions (2106) formed on face plates (2801-1, 2802-2) of the lid (106).

Further, the front side panel (102) and a back-side panel (103) each include top angled portions (2101) and bottom angled portions (2102). The angled portions (2106) of the lid (106) and top angled portions (2101) and bottom angled portions (2102) of the front side panel (102) and a back-side panel (103) serve to ensure that there is no interference between the lid (106) and the front side panel (102) and a back-side panel (103) when the front side panel (102) and a back-side panel (103) are coupled to and decoupled from the storage device (2100). The example of the storage device (100) of FIGS. 1 through 20 include squared edges that may be obstructed with the side walls (502, FIG. 5) of the lid (106) as the lip (111, FIG. 5) is recessed into the top surface of the storage device (100).

Figure 23:
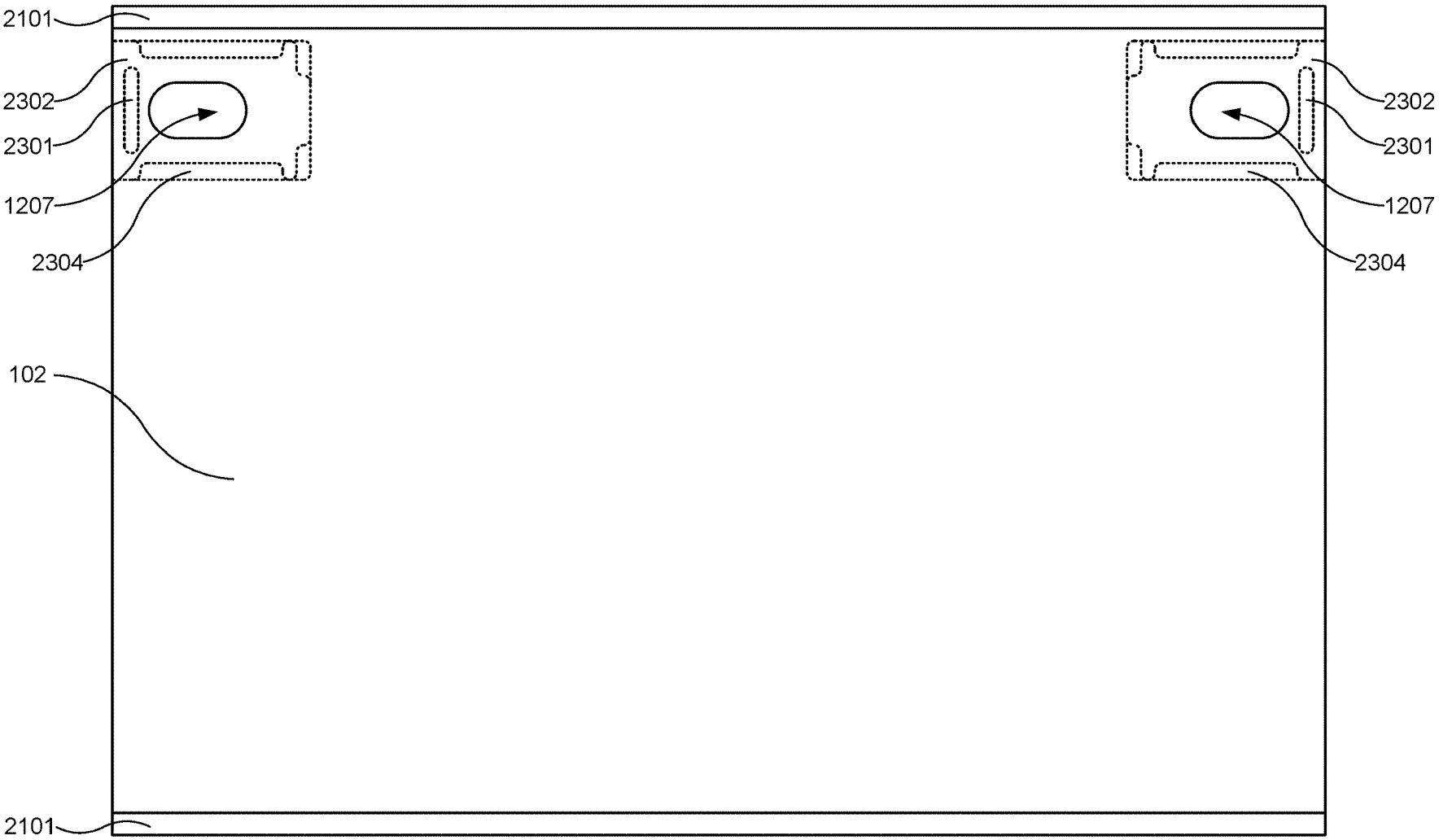
FIG. 23 is an elevation al view of the exterior of a side of the storage device of FIG. 21, according to one example of the principles described herein.
Figure 24:
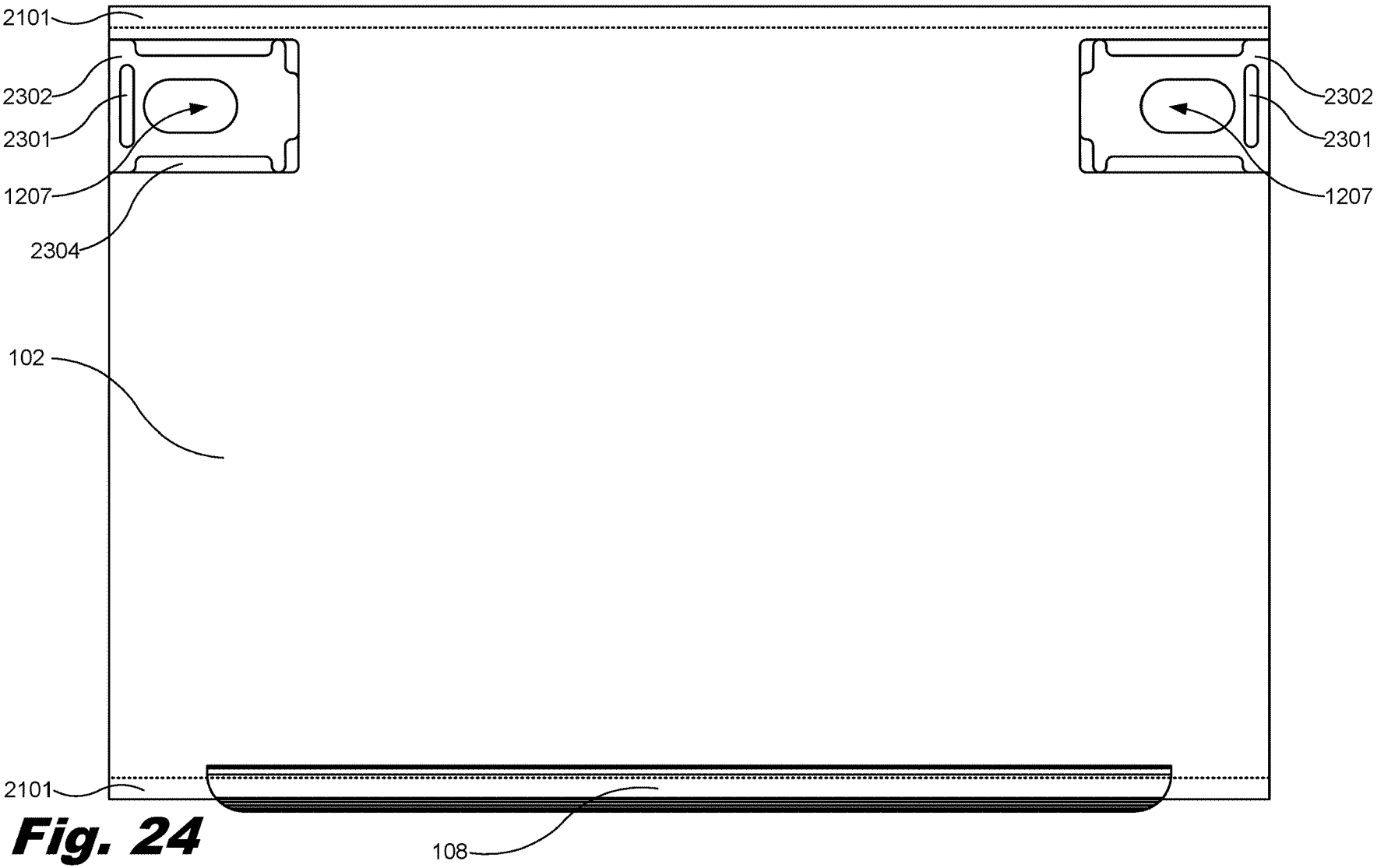
FIG. 24 is an elevational view of the interior of a side of the storage device of FIG. 21 with the slidable coupling device removed, according to one example of the principles described herein.
Figure 25:
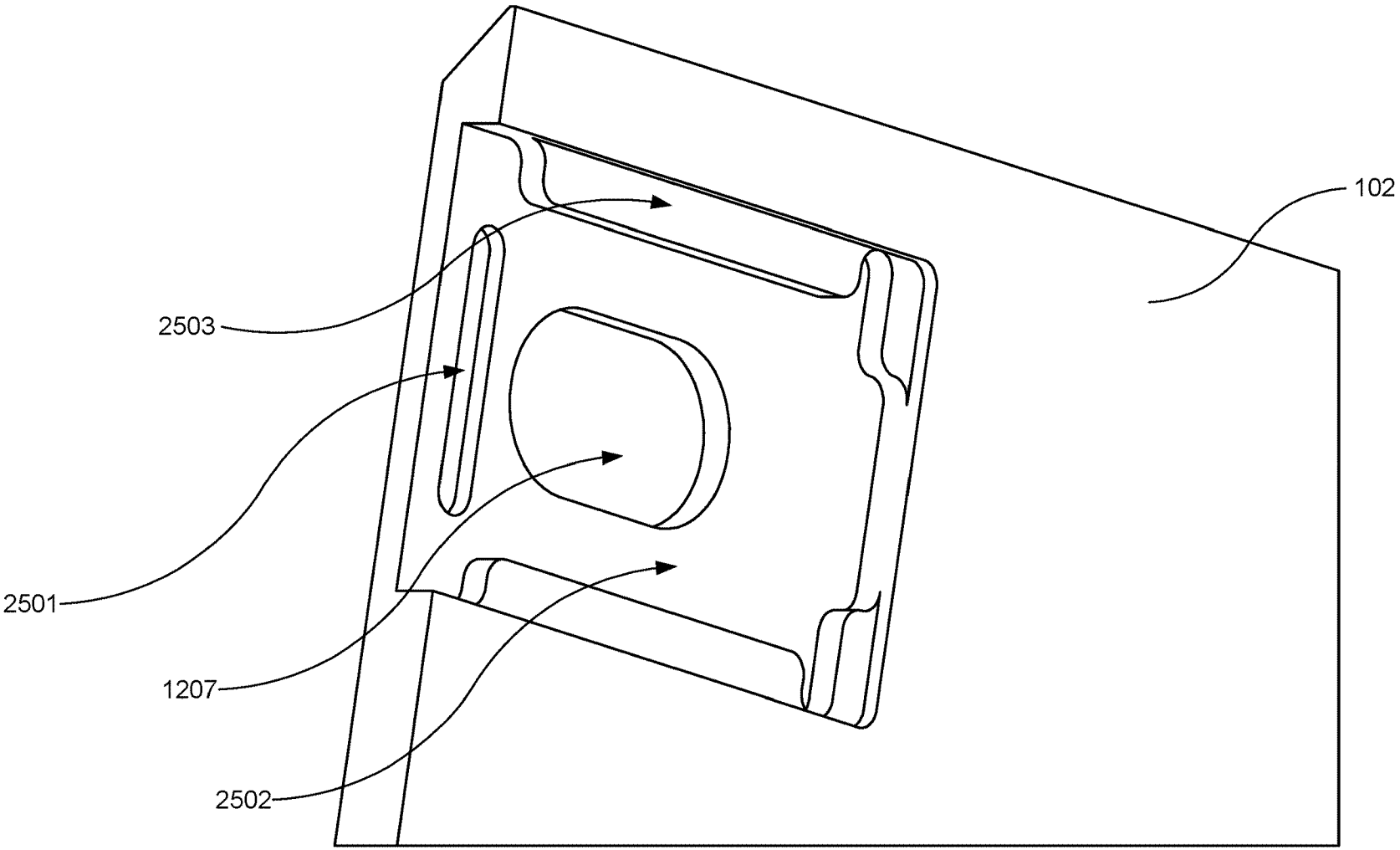
FIG. 25 is a perspective view of the interior of the side of the storage device of FIG. 24 with the slidable coupling device removed, according to one example of the principles described herein.

FIG. 23 is an elevational view of the exterior of a front side panel (102) or back side panel (103) of the storage device (2100) of FIG. 21, according to one example of the principles described herein. Further, FIG. 24 is an elevational view of the exterior of a front side panel (102) or back side panel (103) of the storage device (2100) of FIG. 21 with the slidable coupling device (2109) removed, according to one example of the principles described herein. Still further, FIG. 25 is a perspective view of the interior of the exterior of a front side panel (102) or back side panel (103) of the storage device (2100) of the storage device (2100) of FIG. 24 with the slidable coupling device (2109) removed, according to one example of the principles described herein. Although the front side panel (102) is depicted in FIGS. 23 through 25, the backside panel (103) is identical to the front side panel (102), and the description of the front side panel (102) applies mutatis mutandis to the back-side panel (103).

in FIGS. 23 and 24, the top angled portion (2101) and a bottom angled portion (2102) are depicted wholly and in ghost. respectively to indicate which side of the front side panel (102) the top angled portion (2101) and a bottom angled portion (2102) are formed with that in ghost being formed on the opposite side depicted. The top angled portion (2101) and a bottom angled portion (2102) may be angled with respect to the front of the front side panel (102) at any angle that will allow the front side panel (102) to clear all portions of the lid (106).

The front side panel (102) also includes a number of recesses defined on the interior side of the front side panel (102), and an aperture (1207). The aperture (1207) allows elements of the slidable coupling device (2109) to be exposed to the user in order to operate the slidable coupling device (2109) to open the storage device (2100). The recesses provide space within the front side panel (102) in which the elements of the slidable coupling device (2109) may be housed and provide a flush profile such that the elements of the slidable coupling device (2109) do not protrude from planes created by the front side panel (102). In one example, the recesses are defined by the shapes and dimensions of the elements of the slidable coupling device (2109). FIG. 25 is a perspective view of the interior of the side panel (102, 103) of the storage device (2100) of FIG. 24 with the slidable coupling device (2109) removed, according to one example of the principles described herein. The aperture (1207) allows a finger ring (3014) to protrude through the side panels (102, 103) of the storage device (2100) to allow the user to access and use the finger ring (FIG. 30, 3014) to actuate the functions of the slidable coupling device (2109). The recesses may include a latch recess (2501} that provides an area into which the latches (2201), once inserted into and coupled to the slidable coupling device (2109), may seat. The recesses may also include a latch housing recess (2502) in which the latch housing (3005), the latch slider (3009), and the second friction-decreasing backing (3015} are seated when the slidable coupling device (2109) is coupled to the front side panel (102). The recesses may also include a face plate recess (2503) in which a face plate (3001) and a first friction-decreasing backing (3003) as the face plate (3001) is used to secure the remaining portions of the slidable coupling device (2109) to the front side panel (102).

Figure 26:
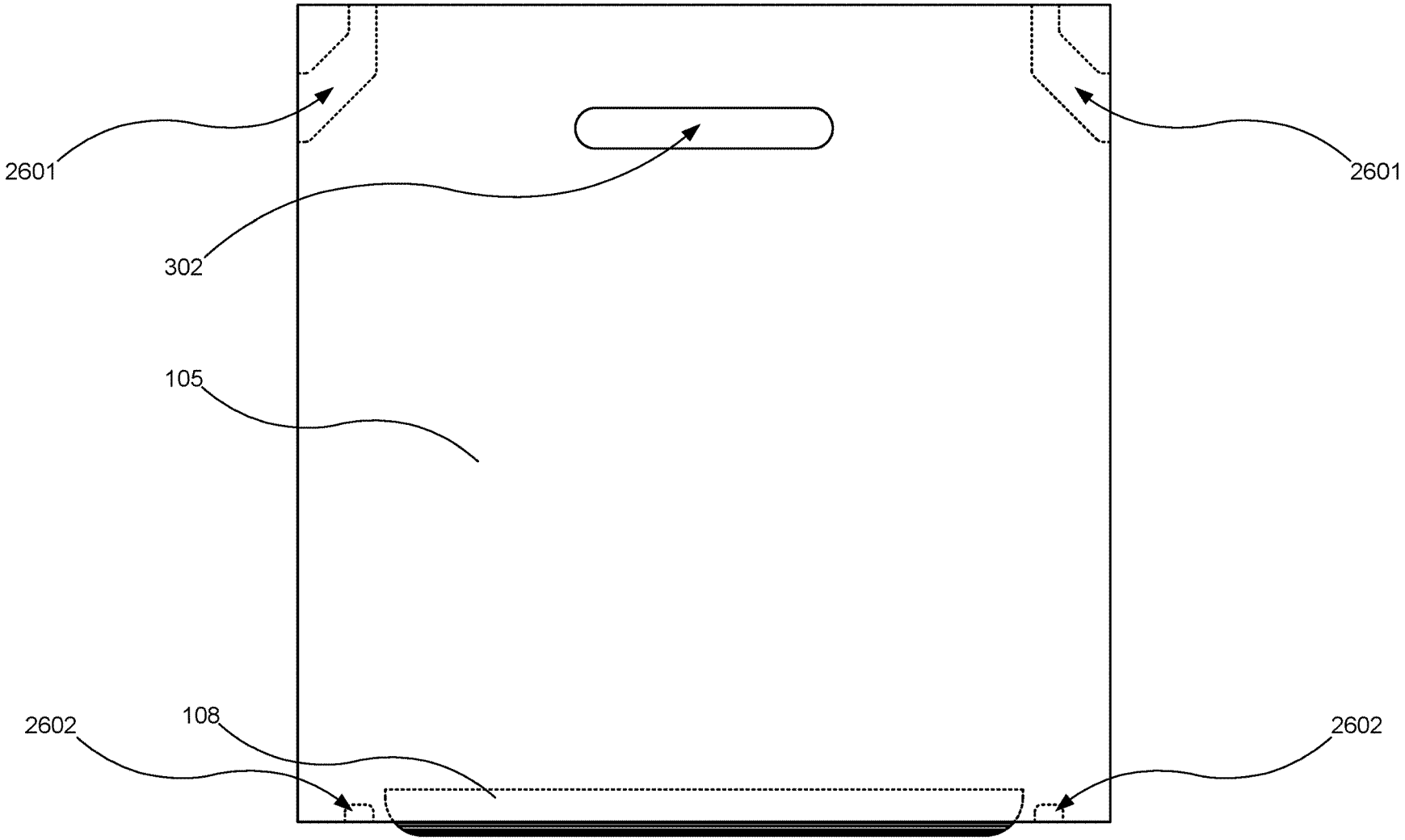
FIG. 26 is an elevational view of the exterior of a side of the storage device of FIG. 21, according to one example of the principles described herein.
Figure 27:
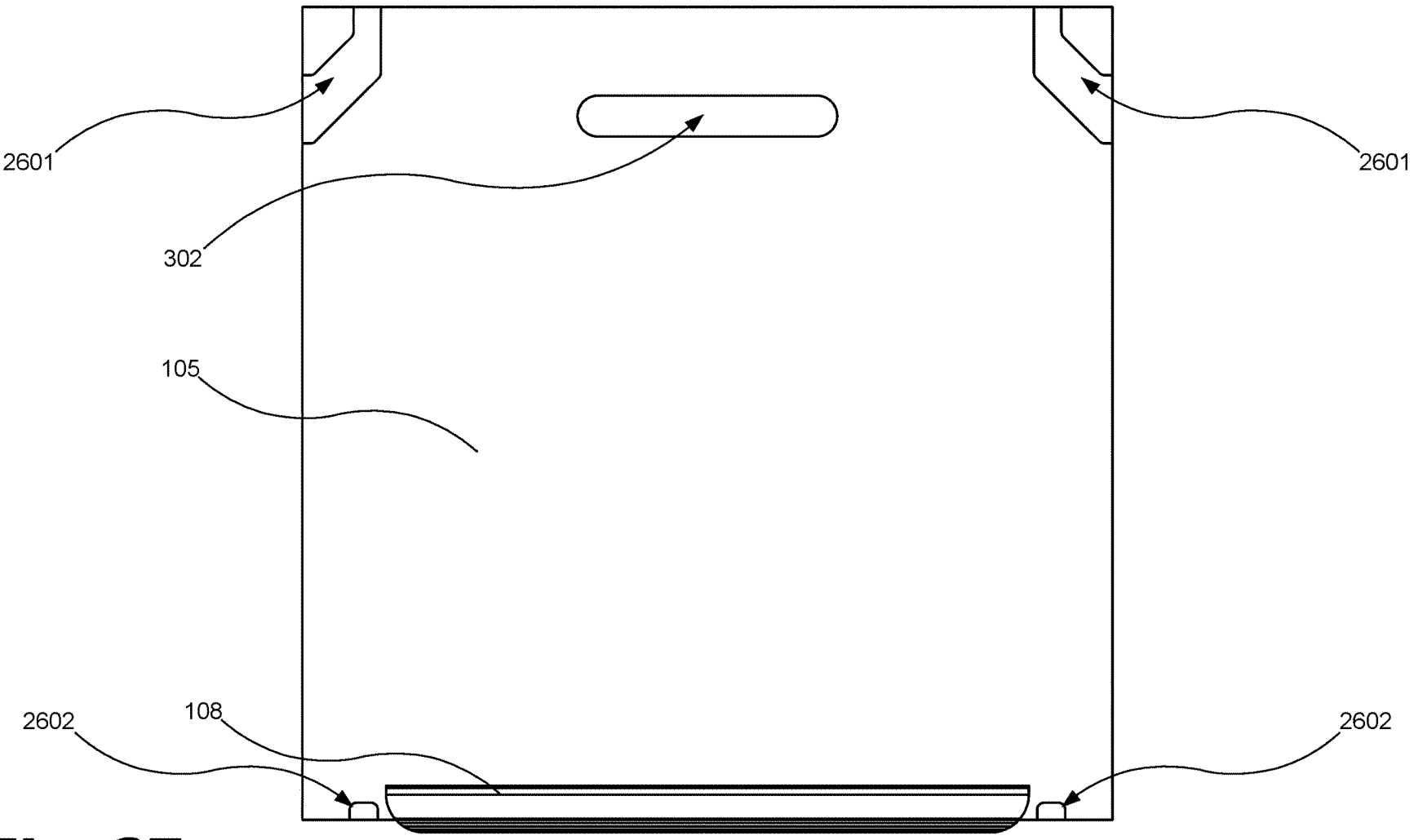
FIG. 27 is an elevational view of the interior of a side of the storage device of FIG. 21 with a latch removed, according to one example of the principles described herein.

FIG. 26 is an elevational view of the exterior of a side (104, 105) of the storage device (2100) of FIG. 21, according to one example of the principles described herein. Further, FIG. 27 is an elevational view of the interior of a side (104, 105) of the storage device (2100) of FIG. 21 with the latch (2201) removed, according to one example of the principles described herein. Although the side panel (104) is depicted in FIGS. 26 and 27, the other side (105) is identical to the side panel (104) depicted, and the description of the side panel (104) applies mutatis mutandis to the other side panel (105). Specifically, the side panel (104) of FIGS. 26 and 27 includes a latch body recesses (2601) defined in the side panel (104) in which the latch (2201) is seated and coupled to the side panel (104). When seated in the latch body recess (2601), the latch (2201) extends past the side panel (104) in a first direction so that the latch (2201) may couple with the slidable coupling device (2109), and extends past the side panel (104) in a second direction so that the latch (2201) may be used to couple a first storage device (2100) to a second storage device (2100) as the storage devices (2100) are stacked on one another. Thus, the side panel (104) may also include a latch tip recess (2602) into which a tip (FIG. 37, 3701) of the latch (2201) may be seated when a first storage device (2100) is stacked on another storage device (2100). In this manner, the latch (2201) serves to also couple two storage devices (2100) together. Further, as described herein, the side panel (104), like the front side panel (102) and the back-side panel (103), may also include the protrusion (108) used to couple the side panels (102, 103, 104, 105) to the base (101).

Figure 28:
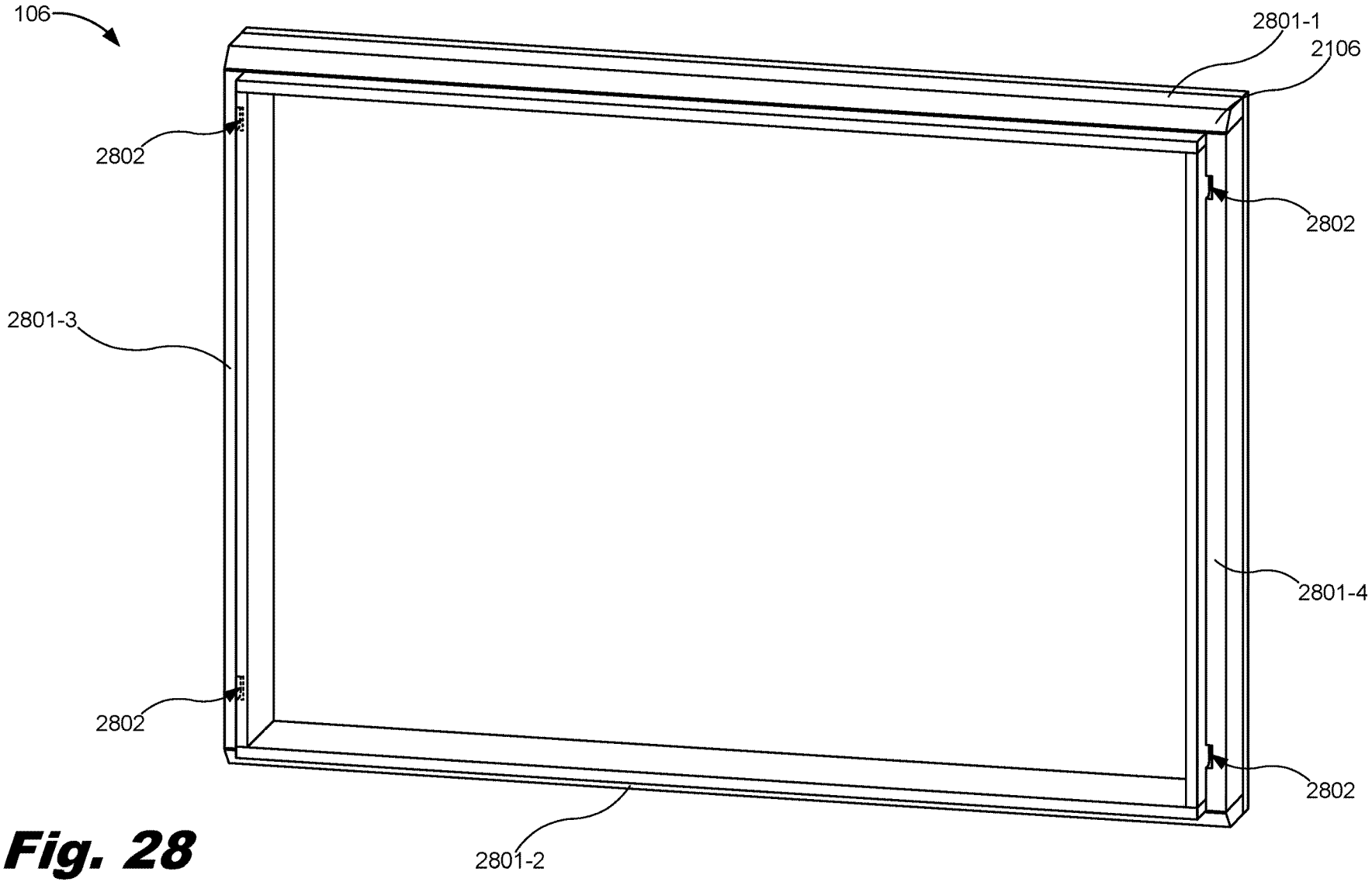
FIG. 28 is a perspective view of a lid of the storage device of FIG. 21, according to one example of the principles described herein.
Figure 29:
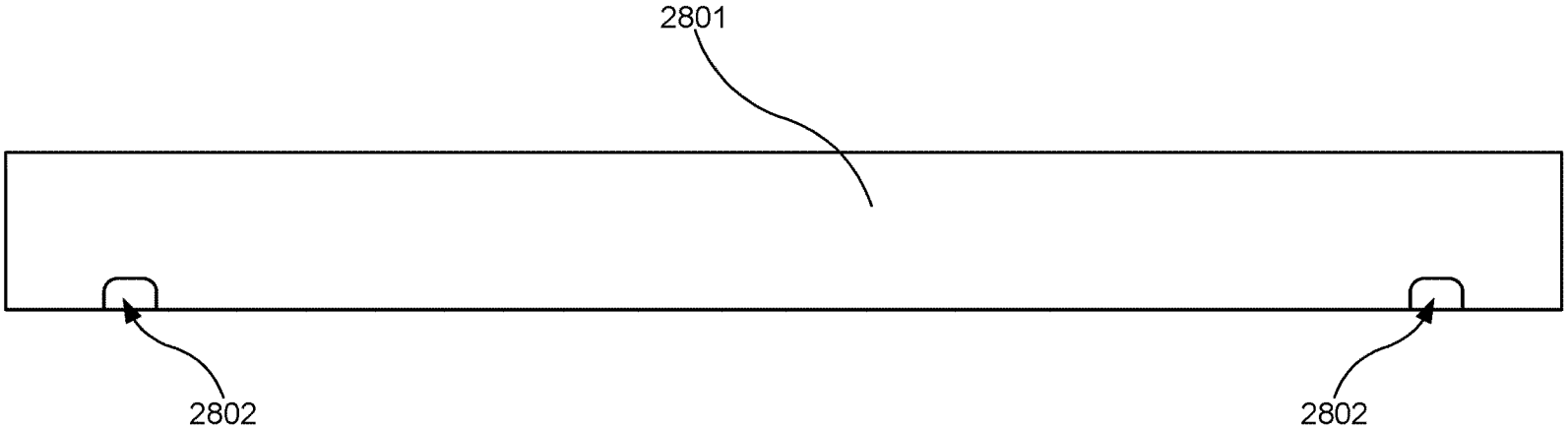
FIG. 29 is an elevational view of a top side panel of the storage device, according to one example of the principles described herein.

FIG. 28 is a perspective view of a lid (106) of the storage device (2100) of FIG. 21, according to one exam pie of the principles described herein. Further, FIG. 29 is an elevational view of a top side panel (2801) of the storage device (2100), according to one example of the principles described herein. The lid (106) includes a side panel (2801) on both ends of the lid (106) that border the side panels (104, 105) when the lid (106) is coupled to the storage device (2100). A number of lid voids (2802) are defined in each of the top side panels (2801). The lid voids (2802) are dimensioned to fit the tip (FIG. 37, 3701) of the latch (2201) may be seated when the lid is coupled to the storage device (2100). In this manner, the lid (106) is secured to the storage device (2100) in at least two coordinate directions, while still allowing the lid (106) to be removed by lifting the lid (106) away from the top of the storage device (2100).

Figure 30:
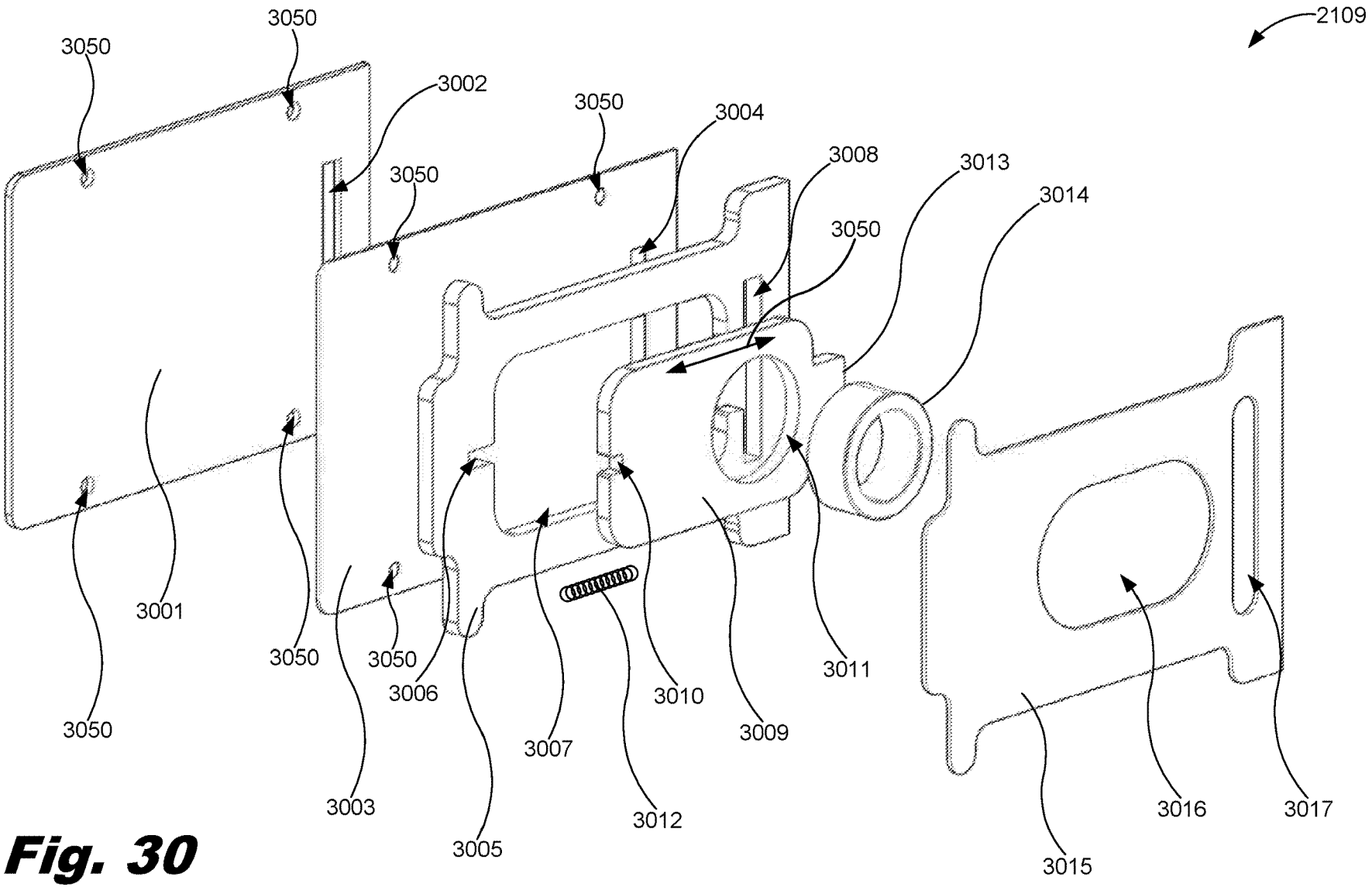
FIG. 30 is an exploded isometric view of the slidable coupling device of the storage device of FIG. 21, according to one example of the principles described herein.
Figure 31:
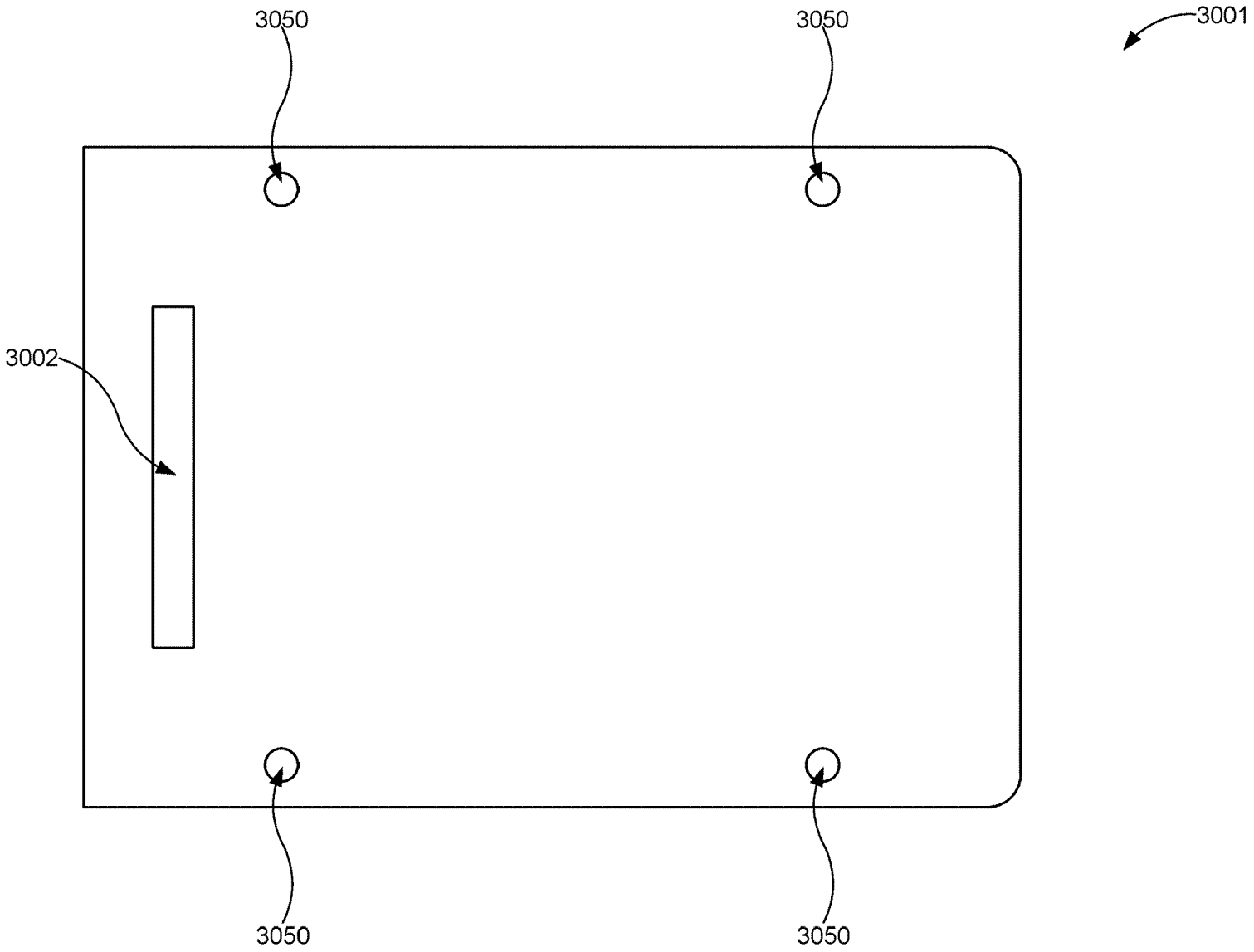
FIG. 31 is an elevation al view of a face plate of the slid able coupling device of FIG. 30, according to one example of the principles described herein.
Figure 32:
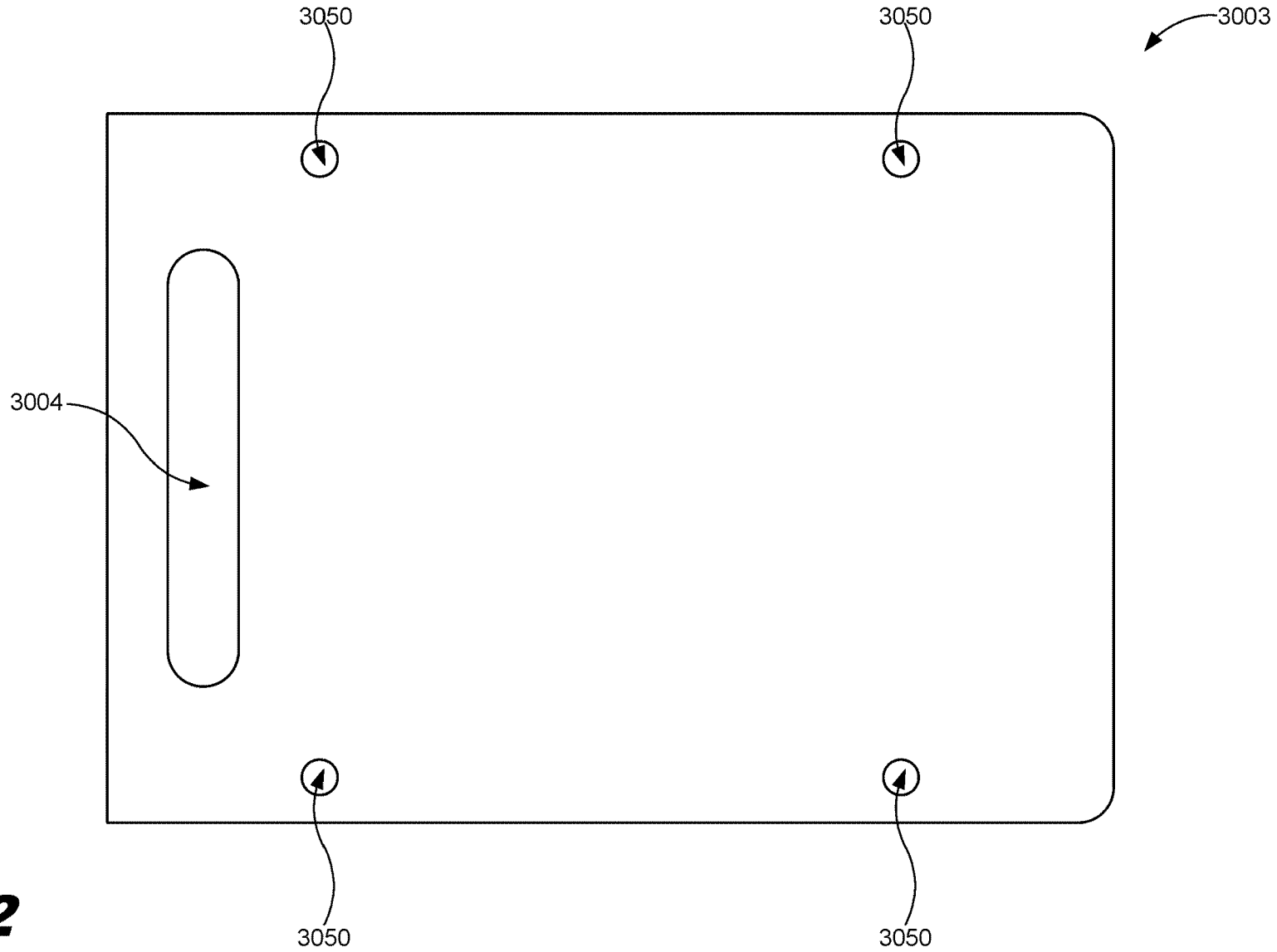
FIG. 32 is an elevational view of a first friction-decreasing backing of the slidable coupling device of FIG. 30, according to one example of the principles described herein.
Figure 33:
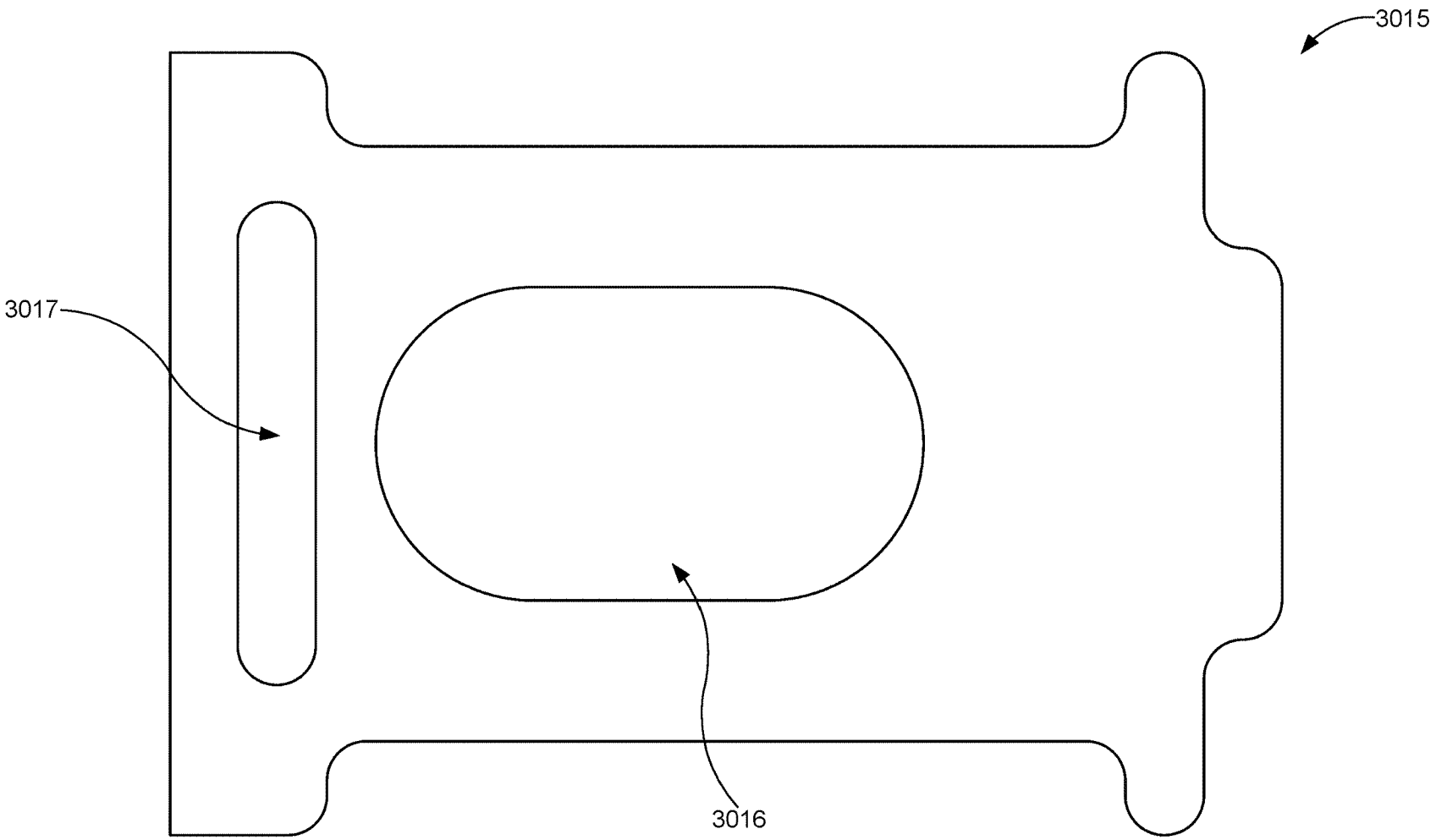
FIG. 33 is an elevation al view of a second friction-decreasing backing of the slidable coupling device of FIG. 30, according to one example of the principles described herein.
Figure 34:
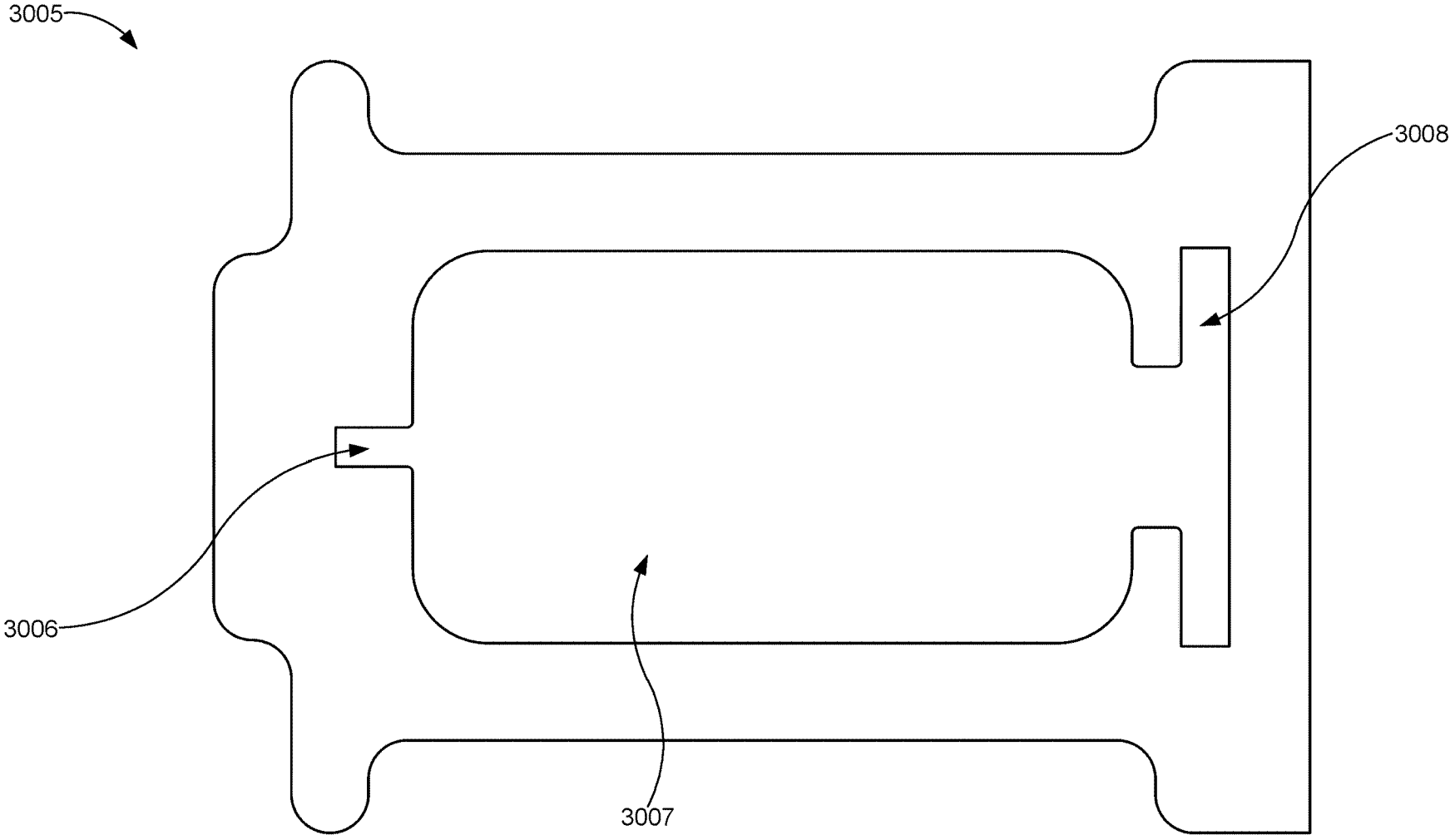
FIG. 34 is an elevational view of a latch housing of the slidable coupling device of FIG. 30, according to one example of the principles described herein.
Figure 35:
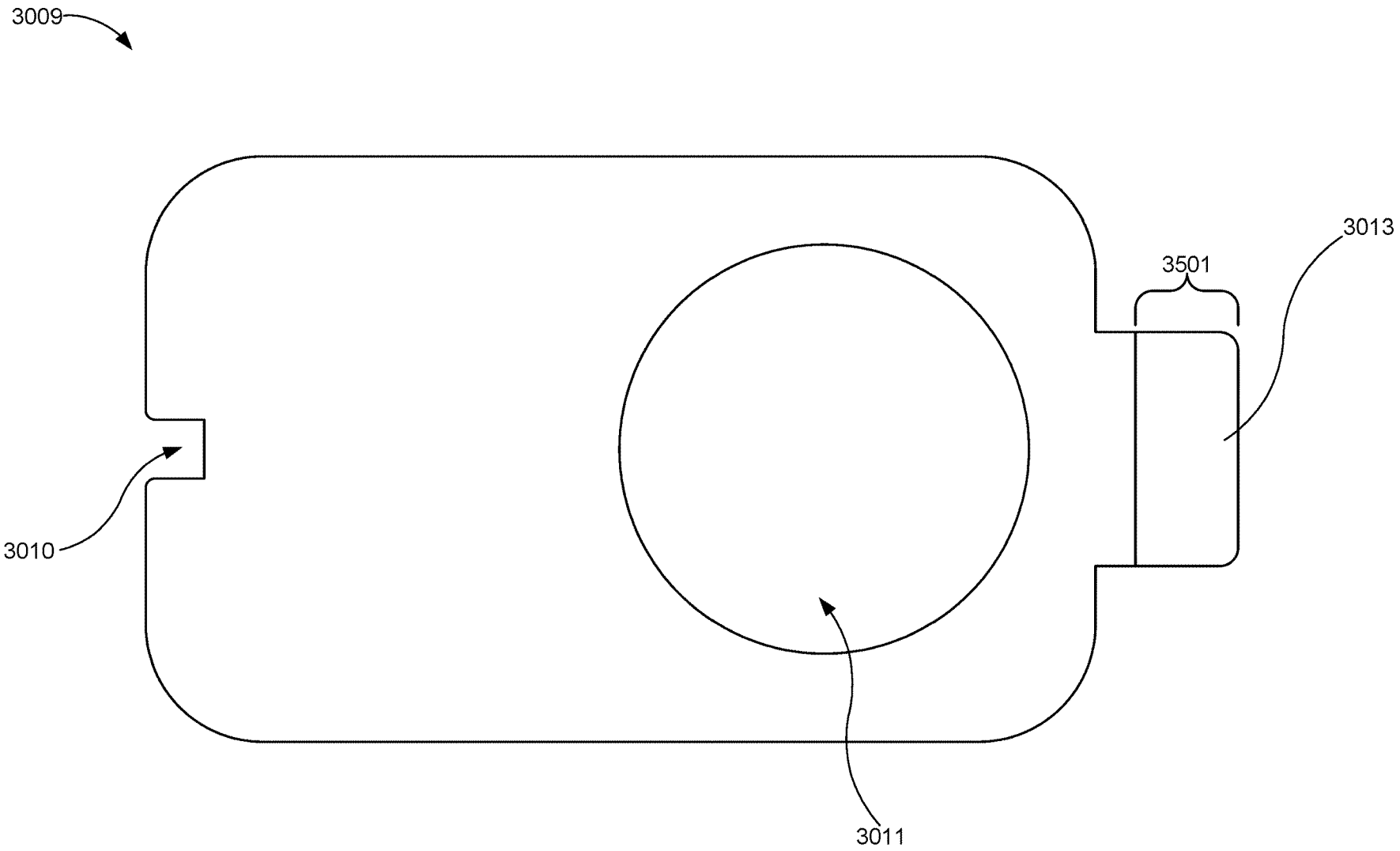
FIG. 35 is an elevation al view of a latch slider of the slidable coupling device of FIG. 30, according to one example of the principles described herein.
Figure 36:
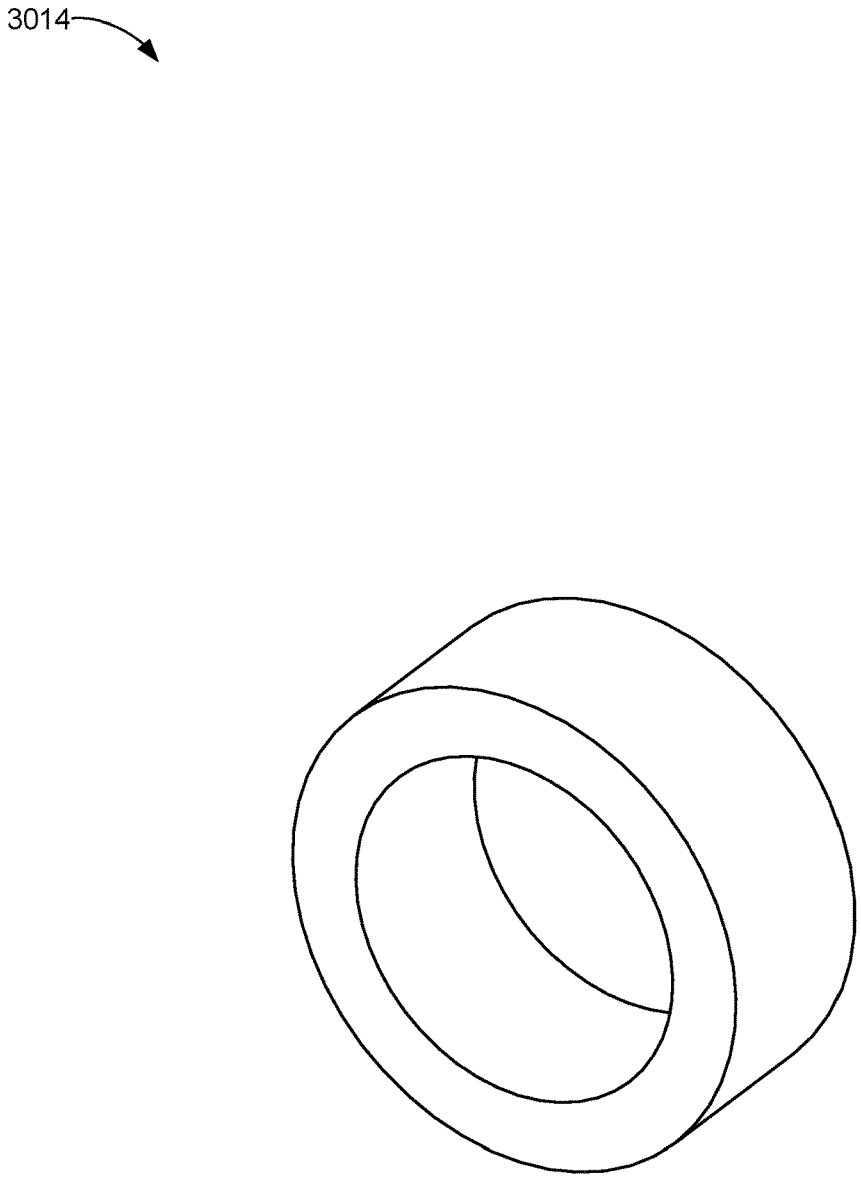
FIG. 36 is perspective view of a finger ring of the slidable coupling device of FIG. 30, according to one example of the principles described herein.

FIGS. 30 through 36 will now be addressed to describe the slidable coupling device (2109) and its various elements. FIG. 30 is an exploded isometric view of the slidable coupling device (2109) of the storage device (2100) of FIG. 21, according to one example of the principles described herein. FIG. 31 is an elevational view of a face plate (3001) of the slidable coupling device (2109) of FIG. 30, according to one example of the principles described herein. FIG. 32 is an elevational view of a first friction-decreasing backing (3003) of the slidable coupling device (2109) of FIG. 30, according to one example of the principles described herein. FIG. 33 is an elevational view of a second friction-decreasing backing (3015) of the slidable coupling device (2109) of FIG. 30, according to one example of the principles described herein. FIG. 34 is an elevational view of a latch housing (3005) of the slidable coupling device (2109) of FIG. 30, according to one example of the principles described herein. FIG. 35 is an elevational view of a latch slider (3009) of the slidable coupling device (2109) of FIG. 30, according to one example of the principles described herein. FIG. 36 is perspective view of a finger ring (3014) of the slidable coupling device (2109) of FIG. 30, according to one example of the principles described herein.

The slidable coupling device (**2*i*09) includes a face plate (3001), a first friction-decreasing backing (3003}, a latch housing (3005), a latch slider (3009), a finger ring (3014), and a second friction-decreasing backing (3015). Each of these elements will now be described in turn. The face plate (3001) may include a number of coupling apertures (3050) defined therein to allow a coupling device such as a screw to be screwed into the surfaces of the first side panel (102) and second side panel (103). The face plate (3001) may also include a latch aperture (3002) through which the latch (2201) may extend as the end side panels (104, 105) are coupled to the front and back side panels (102, 103). Once the latch (2201) is extended through the latch aperture (3002), the latch (2201) may be captured by the latch slider (3009), and, by this action, couple the end side panels (104, 105) to the front and back side panels (102, 103**).

The slidable coupling device (2109) also includes the latch housing (3005) and the latch slider (3009). The latch housing (3005) houses the latch slider (3009), and, when the slid able coupling device (2109) is coupled to the side panel (102, 103), the latch slider (3009) slides within the latch slider aperture (3007) defined in the latch housing (3005). Further, a spring (3012) may be retained within spring recesses (3006, 3010) defined in the latch housing (3005) and the latch slider (3009), respectively, to bias the latch slider (3009) in the right direction as viewed in FIG. 30. In this manner, a user, when coupling the end side panels (104, 105) to the front and back side panels (102, 103), may overcome the bias provided by the spring (3012) by forcing the latch slider (3009) to the left as viewed in FIG. 30, allowing the latch (2201) to enter the slidable coupling device (2109) and releasing the bias force on the latch slider (3009) to allow the latch slider (3009) to move back to the right and secure the latch (2201) to the slidable coupling device (2109) as described herein.

The latch housing (3005), like the face plate (3001), includes a latch aperture (3008) through which the latch (2201) may extend as the end side panels (104, 105) are coupled to the front and back side panels (102, 103). The latch slider (3009) includes a latchbolt (3013) that protrudes from a body of the latch slider (3009). The latchbolt (3013) may be inserted into a slider aperture (FIG. 37, 3702) when the latch (2201) is introduced into the slidable coupling device (2109) and the spring (3012) biasedly forces the latch slider (3009) to the right as viewed in FIG. 30.

In one example, the latchbolt (3013) may include an angled portion (3501) as depicted in FIG. 35 where the angled portion begins at a distance from the end of the latchbolt (3013). In this example, a user may not apply force in the left direction as viewed in FIG. 30 to move the latchbolt (3013) from the latch aperture (3008) to allow the latch (2201) to pass through. Instead, the angled portion (3501) of the latchbolt (3013) causes the slidable coupling device (2109) to function as a slam latch where the end side panels (104, 105) may be coupled to the front and back side panels (102, 103) by just forcing the latch (2201) into the slidable coupling device (2109) and allowing the latch (2201) to force the latch slider (3009) to the left as viewed in FIG. 30 as the force placed on the latch (2201) over the angled portion (3501) of the latchbolt (3013) overcomes the bias force of the spring (3012). Once the latch (2201) passes the latchbolt (3013) of the latch slider (3009), the spring (3012) forces the latch bolt (3013) of the latch slider (3009) into the slider aperture (FIG. 37, 3702) and couples the latch (2201) of the end side panels (104, 105) to the slidable coupling device (2109) of the front and back side panels (102, 103). In this manner, a user is able to "slam" or couple the end side panels (104, 105) to the front and back side panels (102, 103).

The slidable coupling device (2109) may also include a finger ring (3014). The finger ring (3014) may be press fitted into a finger ring aperture (3011) defined within the latch slider (3009). The finger ring (3014) provides a surface the user may apply a force to actuate the slidable coupling device (2109).

The slidable coupling device (2109) may also include a first friction-decreasing backing (3003) and a second friction-decreasing backing (3015). The first friction-decreasing backing (3003) and a second friction-decreasing backing (3015) may each be made of nylon or other material that causes the kinetic friction between the latch slider (3009) and other elements within the slidable coupling device (2109) such as the face plate (3001) and the latch housing (3005) to be reduced. The first friction-decreasing backing (3003) may be located between the face plate (3001) and both the latch housing (3005) and latch slider (3009). The placement of the first friction-decreasing backing (3003) between the face plate (3001) and the latch housing (3005) and latch slider (3009) reduces the friction that the latch slider (3009) may otherwise experience between the face plate (3001) and the latch slider (3009). Further, like the face plate (3001), the first friction-decreasing backing (3003) may include a number of coupling apertures (3050) defined therein that match up with the coupling apertures (3050) defined in the faceplate (3001) to allow a coupling device such as a screw to be screwed into the surfaces of the first side panel (102) and second side panel (103).

The second friction-decreasing backing (3015) may be located between the latch housing recess (2502) of the side panel (102, 103) and both the latch housing (3005) and latch slider (3009). The placement of the second friction-decreasing backing (3015) between the latch housing recess (2502) of the side panel (102, 103) and both the latch housing (3005) and latch slider (3009) reduces the friction that the latch slider (3009) may otherwise experience between portions of the latch housing recess (2502) and the latch slider (3009). The second friction-decreasing backing (3015) may include a latch aperture (3008) through which the latch (2201) may extend to the latch recess (2501) as the end side panels (104, 105) are coupled to the front and back side panels (102, 103). Further, the second friction-decreasing backing (3015) may include a finger ring aperture (3016) defined therein that allows the finger ring (3014) to protrude through the second friction-decreasing backing (3015) to make the finger ring (3014) accessible to the user.

Figure 37:
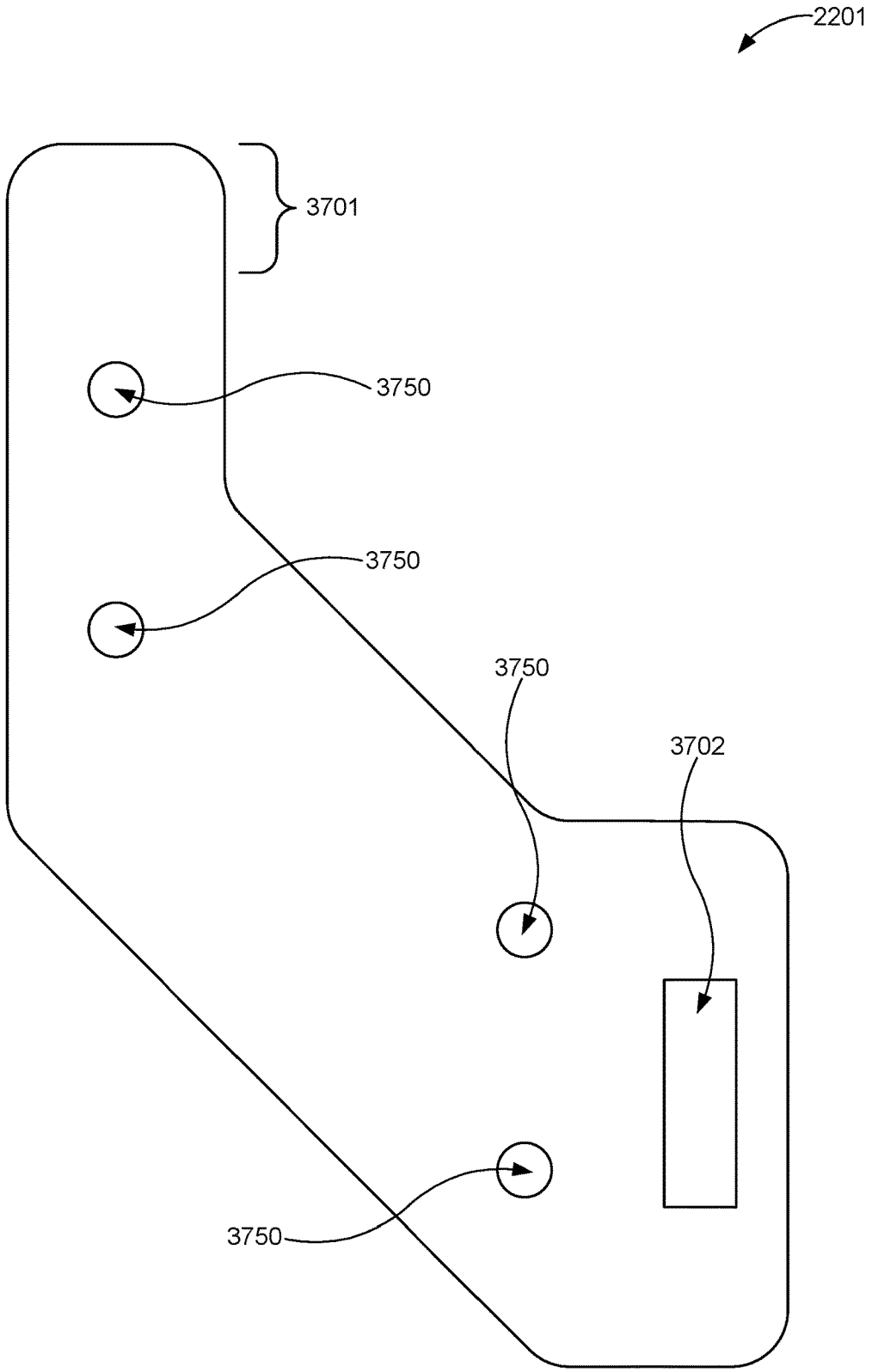
FIG. 37 is an elevation al view of a latch of the side of the storage device depicts in FIGS. 25 and 26 that couples with the slidable coupling device of FIG. 30, according to one example of the principles described herein.

FIG. 37 is an elevational view of a latch (2201) of the side of the storage device (2100) depicts in FIGS. 25 and 26 that couples with the slidable coupling device (2109) of FIG. 30, according to one example of the principles described herein. The latch (2201) may include a tip (3701) that is shaped to fit inside the lid voids (2802) defined in each of the top side panels (2801) of the lid (106) and into the latch tip recess (2602) defined in the side panels (104). The latch (2201) may also include a slider aperture (3702) defined therein. The slider aperture (3702) is dimensioned to accept the latchbolt (3013) of the latch slider (3009) when the latch (2201) is introduced into the slidable coupling device (2109).

Figure 38:
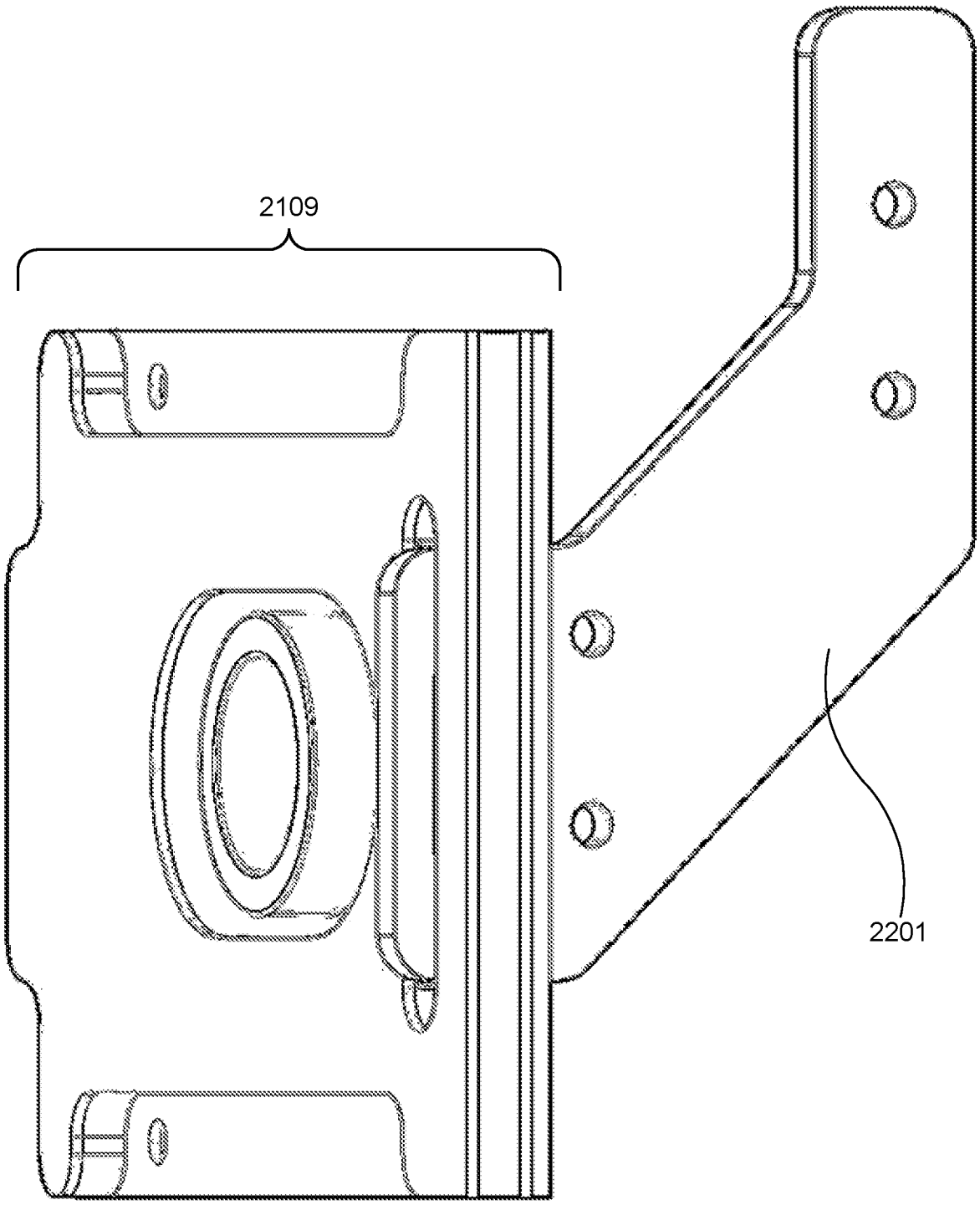
FIG. 38 is a perspective view of the slidable coupling device of FIG. 30 coupled to the latch of FIG. 36, according to one example of the principles described herein.
Figure 39:
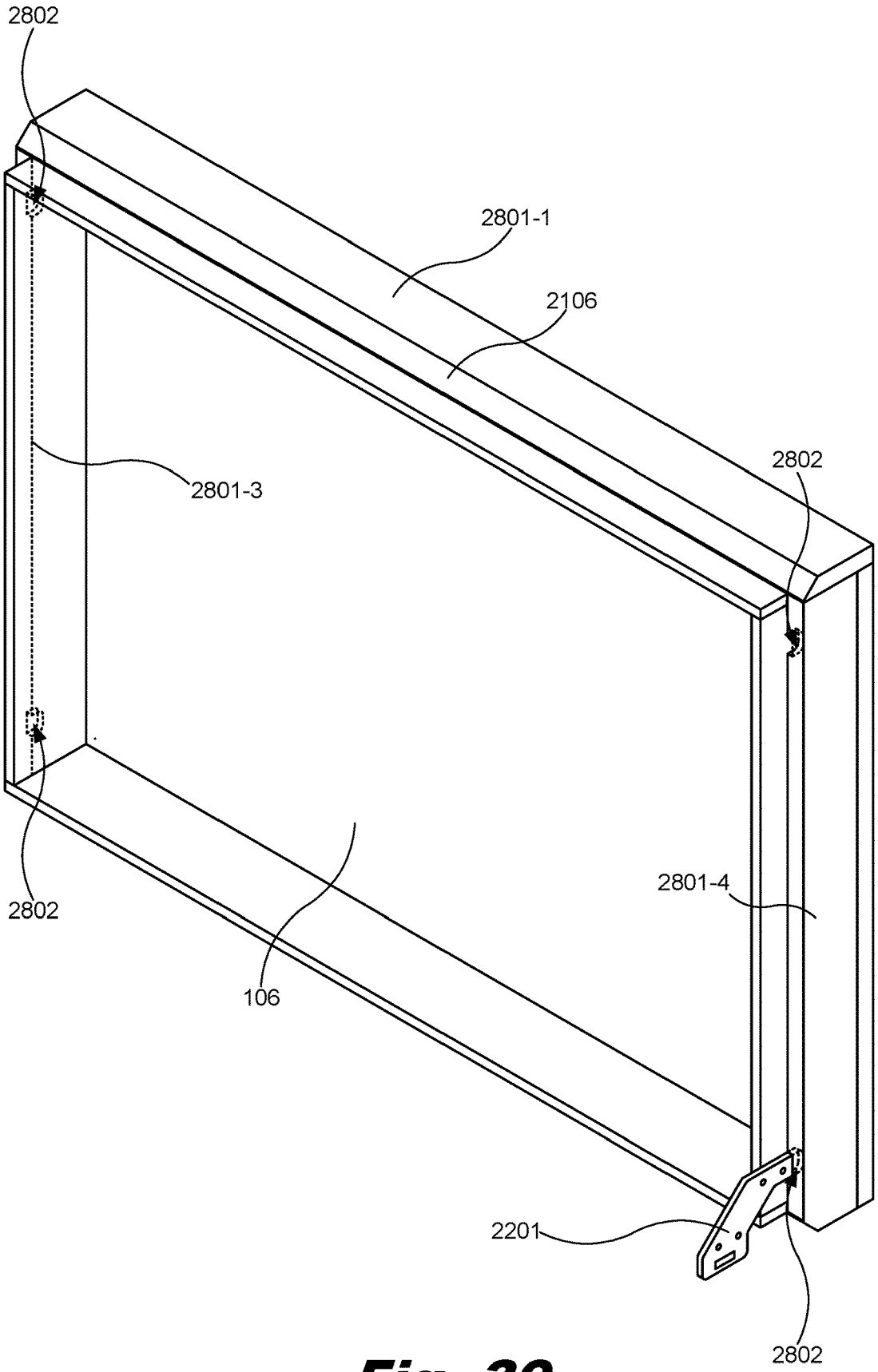
FIG. 39 is a perspective view of the lid of FIG. 28 with a latch of FIG. 37 coupled thereto, according to one example of the principles described herein.

FIG. 38 is a perspective view of the slidable coupling device (2109) of FIG. 30 coupled to the latch (2201) of FIG. 36, according to one example of the principles described herein. The side panels (102, 103, 104, 105) to which the slidable coupling device (2109) and the latch (2201) are respectfully coupled to have been removed in FIG. 38 to show details as to how the slidable coupling device (2109) and the latch (2201) interface with one another. The latch (2201) includes extensions including the tip (3701) and the portion of the latch (2201) that includes the slider aperture (3702) both extend past the dimensions of the end side panels (104, 105) so that these portions of the latch (2201) can interface with, for example, the slidable coupling device (2109) coupled to the front and back side panels (102, 103) and extend into the lid voids (2802) defined in each of the top side panels (2801) of the lid (106) and the latch tip recesses (2602) defined in the side panels (104). By way of illustration of this, FIG. 39 is a perspective view of the lid (106) of FIG. 28 with a latch (2201) of FIG. 37 coupled thereto, according to one exam pie of the principles described herein. The tip (3701) of the latch (2201) is inserted into the lid voids (2802) defined in each of the top side panels (2801} of the lid (106) as depicted in FIG. 37, and in this manner, the latch (2201) also secures the lid to the storage device (2100).

In the examples described herein, various elements and functions of the storage devices (100, 2100) may be incorporated into a storage device. Further, as to the examples of the storage device (100, 2100) described herein, the side panels (102, 103, 104, 105), base (101), and lid (106), or at least portions thereof may be made of different materials including metal, wood, plastics, composite materials, thermal insulating materials, other materials, or combinations thereof. Further, in an example, the side panels (102, 103, 104, 105), base (101), and lid (106), or at least portions thereof may include indicia or graphics marked or formed on surfaces thereof.

Further, in the examples described herein, the side panels (102, 103, 104, 105) and the manner in which they are coupled to a base using the protrusions (108), and coupled to one another using the spring-loaded catches (109) and slidable coupling devices (2109} may be used in connection with a myriad of use cases. For example, the present systems and methods may be used partially or it their entireties in coupling construction panels together, in first responder's temporary housing enclosures, in food and drink coolers, and any other instance where a box-like structure may be utilized.

The specification and figures describe a storage device. The storage device includes a base, and a number of side panels selectively coupled to the base. Each of the side panels include a protrusion. The base includes a number of voids defined therein. The protrusions, once inserted into the voids, restrict movement of the side panels relative to the base in at least two coordinate directions. This storage device provides (1) a three-axis stability between a number of side panels and a base of the storage device; (2) three-axis stability between adjacent side panels using a latch and pin system; (3) three-axis shear stability between adjacent storage devices that are arranged in an array due a coupling device that uses retractable magnetic pins incorporated into each of the lids of the storage devices; (4) for a system where all components are internal to and flush with the side panels with respect to both the exterior and interior of the side panels in order to allow for stacking in any configuration; (5) or a system where no parts or tools are required for assembly or disassembly of the storage devices, resulting in a more easily constructed storage device; (6) side panels that open from either front or back when assembled or stacked providing access to the interior of the storage devices from with side of a stack of storage device; (7) lids that link to form single top surface that may be used as a table top or other working surface; (8) stability that is maintained between adjacent storage devices, among many other aspects.

The preceding description has been presented to illustrate and describe examples of the principles described. This description is not intended to be exhaustive or to limit these principles to any precise form disclosed. Many modifications and variations are possible in light of the above teaching.

What is claimed is:

1. A storage system comprising:

a plurality of storage devices, each of the storage devices comprising:

a base comprising a number of voids defined therein;

a number of side panels selectively coupled to the base; and a protrusion coupled to each of the side panels to couple the side panels to the base by restricting movement of the side panels relative to the base in at least two coordinate directions once inserted into the voids, the protrusion comprising:

an extension to seat in a bottom portion of the void, the extension extending past a first wall of an opening of the void and downward into the base past the void to secure the side panels to the base in a first coordinate direction;

tapered ends, the tapered ends matching a number of curved side walls defined in the void, the tapered ends securing the side panels to the base in a second coordinate direction; and a sloping face beginning at an apex of the protrusion and terminating at the bottom of the extension, the apex of the sloping face abutting a second wall of the opening of the void when the side panels are brought into a perpendicular position relative to a top surface of the base, the apex and a bottom surface of the protrusion securing the side panels to the base in a third coordinate direction; and a securing device coupled to each of the side panels to secure the side panels to an adjacent one of the side panels.

2. The storage system of claim 1, wherein the securing device includes:

two latches coupled to each of a first two of the side panels, the first two of the side panels being on opposite sides of the storage device; and two slidable coupling devices coupled to each of a second two of the side panels, the second two of the side panels being on opposite sides of the storage device, wherein the latches coupled to the first two of the side panels couple to the slidable coupling devices coupled to the second two of the side panels.

3. The storage system of claim 2, wherein:

the latches each include a latch void, and the slidable coupling devices each include:

a latch housing comprising a latch housing void defined therein to receive an end of the latch;

a latch slider housed within the latch housing comprising a latchbolt protruding from a body of the latch slider to allow the latch to enter the latch housing void of the latch housing and past the latch slider; and a spring disposed between the latch housing and the latch slider to bias the latch slider within the latch housing in a first direction, wherein the spring forces the latch slider into the latch void as the latch forces the latch slider in a second direction opposite the first direction as the latch enters the latch housing void of the latch housing and past the latch slider.

4. The storage system of claim 3, wherein the latchbolt protruding from the body of the latch slider includes an angled portion such that introduction of the latch into the latch housing void of the latch housing and past the latch slider forces the spring in a second direction opposite the first direction as the latch runs along the angled portion of the latchbolt.

5. The storage system of claim 3, wherein the securing device comprises:

a first backing substrate located on a first side of the latch slider and the latch housing;

a second backing substrate located on a second side of the latch slider and the latch housing;

a face plate to secure the slidable coupling devices to the second two of the side panels; and a finger ring press fitted into a finger ring void defined in the latch slider.

6. The storage system of claim 5, wherein the first backing substrate and the second backing substrate are made of nylon.

7. The storage system of claim 2, wherein at least one of the storage devices includes:

a lid dimensioned to be flush with an outside surface of the side panels when the side panels are coupled to on another, the lid comprising:

a number of recesses defined in a portion of a perimeter of the lid to receive a portion of the latch extending above the first two of the side panels; and an angled front portion, the angled front portion of the lid matching an angled top portion defined in the second two of the side panels adjacent to the lid, wherein the angled front portion of the lid and the angled top portion of the second two of the side panels cause the second two of the side panels to clear the lid as the second two of the side panels are engaged to the base in a seated position.

8. The storage system of claim 7, further comprising:

a lid pin coupling device, the lid pin coupling device including:

a first recess defined in a first lid;

a second recess defined in a second lid;

a lid pin disposed within the first recess;

a magnet disposed in the second recess; and a lid spring coupled to the lid pin and biased away from a direction of the magnet, wherein a distance between the lid pin and the magnet is such that the magnet overcomes a bias force of the lid spring to draw the lid pin at least partially into the second recess when the first lid is brought into an abutting position with the second lid.

9. The storage system of claim 7, wherein the lid comprises a lip around a bottom edge of the lid, the lip being dimensioned to fit into an interior of a first storage device when the side panels are coupled to one another.

10. The storage system of claim 1, wherein:

the base of at least one of the storage devices includes a base lip formed by the side panels as coupled to the base, the base lip having:

a horizontal portion to interface with tops of the side panels, and a vertical portion to interface with interior sides of the side panels.

11. The storage system of claim 1, further comprising at least one coupling device coupling a first storage device to a second storage device placed on top of the first storage device.

12. The storage system of claim 1, further comprising:

at least a first recess defined in at least one of the side panels of a first storage device;

at least a second recess defined in the base of a second storage device; and a dowel inserted into the first recess and the second recess.

13. The storage system of claim 1, further comprising a tongue and groove system formed between at least a first side panel of a first storage device and at least a second side panel of a second storage device.

14. The storage system of claim 1, wherein the securing device of the side panels secure the side panels to one another in three coordinate directions.

15. The storage system of claim 1, wherein the securing devices are flush with surfaces of the side panels such that no portion of the securing devices protrudes past a surface of the side panels.

16. The storage system of claim 1, wherein at least portions of the side panels, the base, and a lid are made of metal, wood, plastics, composite materials, thermal insulating materials, or combinations thereof.

17. A storage system comprising:

a plurality of storage devices, each of the storage devices comprising:

a base comprising a plurality of voids defined therein;

a number of side panels selectively coupled to the base; and a protrusion coupled to each of the side panels to couple the side panels to the base by restricting movement of the side panels relative to the base in at least two coordinate directions once inserted into the voids;

a lid dimensioned to be flush with an outside surface of the side panels when the side panels are coupled to on another:

a lid pin coupling device, the lid pin coupling device including:

a first recess defined in a first lid of a first storage device;

a second recess defined in a second lid of a second storage device;

a lid pin disposed within the first recess;

a magnet disposed in the second recess; and a lid spring coupled to the lid pin and biased away from a direction of the magnet, wherein a distance between the lid pin and the magnet is such that the magnet overcomes a bias force of the lid spring to draw the lid pin at least partially into the second recess when the first lid is brought into an abutting position with the second lid.

18. The storage system of claim 17, wherein the protrusion includes:

an extension to seat in a bottom portion of the voids, the extension extending past a first wall of an opening of the void and downward into the base past the void to secure the side panels to the base in a first coordinate direction;

tapered ends, the tapered ends matching a number of curved side walls defined in the void, the tapered ends securing the side panels to the base in a second coordinate direction; and a sloping face beginning at an apex of the protrusion and terminating at a bottom of the extension, the apex of the sloping face abutting a second wall of the opening of the void when the side panels are brought into a perpendicular position relative to a top surface of the base, the apex and a bottom surface of the protrusion securing the side panels to the base in a third coordinate direction.

19. The storage system of claim 17, wherein at least one of the storage devices includes:

a lid dimensioned to be flush with an outside surface of the side panels when the side panels are coupled to on another, the lid comprising:

a number of recesses defined in a portion of a perimeter of the lid to receive a portion of a latch extending above the first two of the side panels; and an angled front portion, the angled front portion of the lid matching an angled top portion defined in the second two of the side panels adjacent to the lid, wherein the angled front portion of the lid and the angled top portion of the second two of the side panels cause the second two of the side panels to clear the lid as the second two of the side panels are engaged to the base in a seated position.

20. The storage system of claim 17, further comprising at least one coupling device coupling a first storage device to a second storage device placed on top of the first storage device.

* * * * *